US012228374B2

(12) United States Patent
Salinas et al.

(10) Patent No.: US 12,228,374 B2
(45) Date of Patent: Feb. 18, 2025

(54) ADAPTER ASSEMBLY OR OTHER MOUNTING FEATURES FOR FIREARM OPTIC

(71) Applicant: AXTS INC, Redmond, OR (US)

(72) Inventors: Anibal Salinas, Redmond, OR (US); Seth K. Peterson, Redmond, OR (US); Joshua A. Underwood, Redmond, OR (US)

(73) Assignee: AXTS INC., Redmond, OR (US)

( * ) Notice: Subject to any disclaimer, the term of this patent is extended or adjusted under 35 U.S.C. 154(b) by 14 days.

(21) Appl. No.: 17/861,068

(22) Filed: Jul. 8, 2022

(65) Prior Publication Data

US 2023/0011632 A1 Jan. 12, 2023

Related U.S. Application Data

(60) Provisional application No. 63/220,314, filed on Jul. 9, 2021.

(51) Int. Cl.
*F41G 11/00* (2006.01)

(52) U.S. Cl.
CPC ..... *F41G 11/001* (2013.01)

(58) Field of Classification Search
CPC ..... F41G 11/001; F41G 11/003; F41G 1/30
See application file for complete search history.

(56) References Cited

U.S. PATENT DOCUMENTS

| | | | | |
|---|---|---|---|---|
| 796,226 | A * | 8/1905 | Kurig | F41G 1/44 89/200 |
| 2,589,738 | A | 3/1952 | Sedberry | |
| 2,805,602 | A | 9/1957 | Moore | |
| 3,698,747 | A | 10/1972 | Wing | |
| 4,374,484 | A | 2/1983 | Bekker | |
| 5,900,583 | A * | 5/1999 | Russo | H02G 3/20 248/343 |
| 6,327,806 | B1 * | 12/2001 | Paige | F41G 1/30 42/130 |

(Continued)

OTHER PUBLICATIONS

J.K. Army Airsoft & Tactical Shop, "C&C P320 LFCW Legion Front Co-Witness Style RMR Mount Base Plate for SIGN/VFC P320 M17 M18 GBBP Series", https://shop.jkarmy.com/c-c-p320-lfcw-legion-front-co-witness-style-rmr-mount-base-plate-for-sig-vfc-p320-m17-m18-gbbp-series.html; at least as early as Jul. 8, 2021.

(Continued)

*Primary Examiner* — Joshua E Freeman
(74) *Attorney, Agent, or Firm* — Schwabe Williamson & Wyatt

(57) ABSTRACT

An adapter assembly for mounting an optic on a firearm using nuts mountable on bolts, threaded studs, or threaded posts is provided. The adapter assembly may include a bracket having a bottom section to mount to a firearm assembly, and a top side to receive the optic; wherein the threaded posts are integrally formed on the top side of the bracket, or wherein the bracket includes: pockets arranged to mate with at least part of heads of the bolts or studs, the pockets on a bottom side of the bracket; and through openings to receive shanks of the bolts or a different part of the heads of the bolts, or shanks of the studs. Other embodiments may be disclosed and/or claimed.

32 Claims, 55 Drawing Sheets

(56) References Cited

U.S. PATENT DOCUMENTS

| | | | | |
|---|---|---|---|---|
| 7,946,074 | B2 * | 5/2011 | Nemec | F41G 1/033 42/137 |
| 8,082,688 | B2 * | 12/2011 | Elpedes | F41G 1/30 42/131 |
| 8,832,983 | B1 * | 9/2014 | Wolf | F41G 1/00 42/76.01 |
| 9,062,936 | B2 * | 6/2015 | Zimmer | F41C 3/00 |
| 9,506,726 | B2 * | 11/2016 | Wolf | F41G 1/26 |
| 9,696,114 | B1 * | 7/2017 | Cabrera | F41G 1/10 |
| 10,024,628 | B2 * | 7/2018 | Toner | F41G 1/16 |
| 10,352,654 | B2 * | 7/2019 | Costet | F41G 11/001 |
| 10,753,710 | B2 * | 8/2020 | Niswander | F41G 11/003 |
| 10,782,099 | B2 * | 9/2020 | Zimmer | F41G 11/006 |
| 10,876,815 | B1 * | 12/2020 | Wingfield | F41G 1/16 |
| 10,948,267 | B2 * | 3/2021 | Zimmer | F41G 11/006 |
| 10,962,332 | B2 * | 3/2021 | Curry | F41A 21/488 |
| 11,002,517 | B1 * | 5/2021 | Holly | F41G 1/30 |
| 11,112,214 | B2 * | 9/2021 | Niswander | F41G 11/001 |
| 11,300,382 | B2 * | 4/2022 | Holly | F41G 11/002 |
| 11,460,274 | B2 * | 10/2022 | Dawson, Jr. | F41G 11/001 |
| 2005/0047857 | A1 * | 3/2005 | Soppelsa | F41G 1/26 403/376 |
| 2008/0148928 | A1 | 6/2008 | McClellan | |
| 2011/0000121 | A1 * | 1/2011 | Uhl | F41G 1/41 359/850 |
| 2014/0096426 | A1 | 4/2014 | Schafer | |
| 2014/0230305 | A1 * | 8/2014 | Zimmer | F41C 3/00 42/111 |
| 2014/0237881 | A1 | 8/2014 | Mack | |
| 2015/0241175 | A1 * | 8/2015 | Wolf | F41G 11/005 42/124 |
| 2017/0059277 | A1 * | 3/2017 | Justice | F41G 11/003 |
| 2018/0087871 | A1 * | 3/2018 | Toner | F41G 1/16 |
| 2018/0195835 | A1 * | 7/2018 | Crispin | F41G 1/30 |
| 2018/0266791 | A1 * | 9/2018 | Vardi | F41G 1/30 |
| 2019/0049217 | A1 * | 2/2019 | Costet | F41G 1/16 |
| 2019/0257620 | A1 * | 8/2019 | Zimmer | F41C 3/00 |
| 2019/0331461 | A1 * | 10/2019 | Zimmer | F41G 1/17 |
| 2020/0025520 | A1 * | 1/2020 | Niswander | F41G 11/003 |
| 2020/0232601 | A1 * | 7/2020 | Chavez | F16M 11/041 |
| 2020/0326157 | A1 * | 10/2020 | Curry | F41A 21/484 |
| 2021/0231400 | A1 | 7/2021 | Salinas | |
| 2021/0231407 | A1 | 7/2021 | Salinas | |
| 2021/0254933 | A1 * | 8/2021 | Langdon | F41A 17/72 |
| 2021/0270572 | A1 * | 9/2021 | Dawson, Jr. | F41G 11/001 |
| 2022/0136801 | A1 * | 5/2022 | Niswander | F41G 11/001 42/111 |
| 2022/0268553 | A1 * | 8/2022 | Roth | F41G 11/001 |
| 2023/0266089 | A1 | 8/2023 | Krnezic | |

OTHER PUBLICATIONS

CH Precision Weapons, "SIG p320 Legion (M17/M18) w/R1P/DPP Cut to Trijicon RMR/SRO Holosun 407C / 507C / 508C /508T w/Glock Dovetail", https://chpws.com/product/sig-p320-x-five-legion-rmr-sro-holosun-407-507-508-adapter-plate/; at least as early as Jul. 8, 2021.

* cited by examiner (Background)

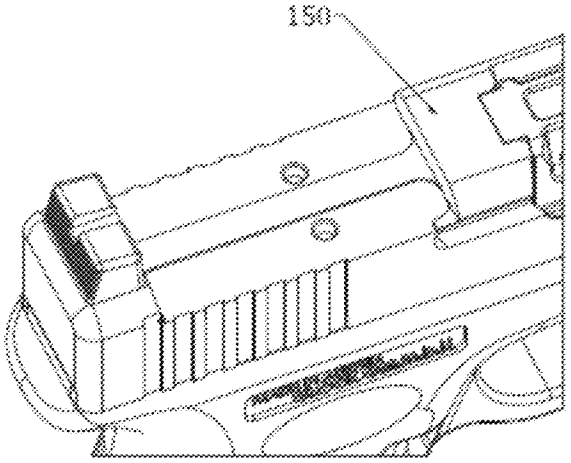
FIG. 1B (Background)
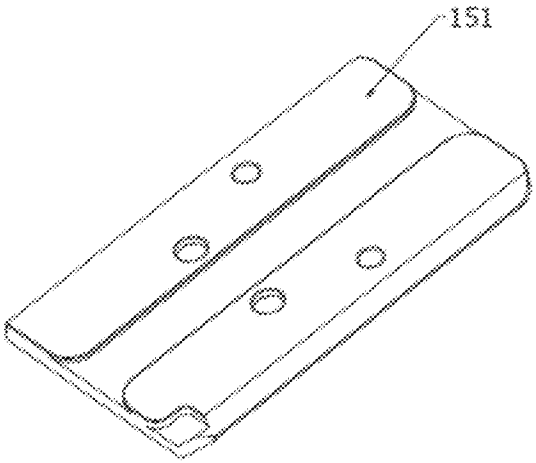
FIG. 1C (Background)
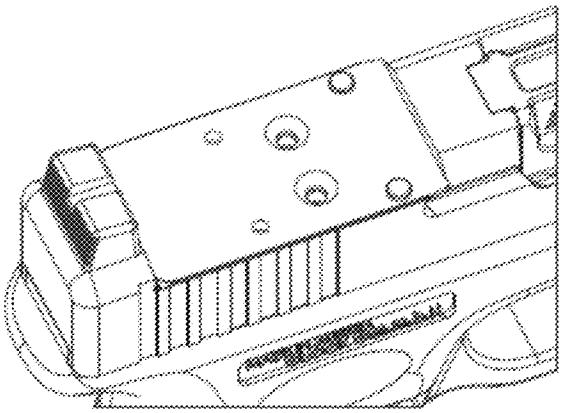
FIG. 1D (Background)
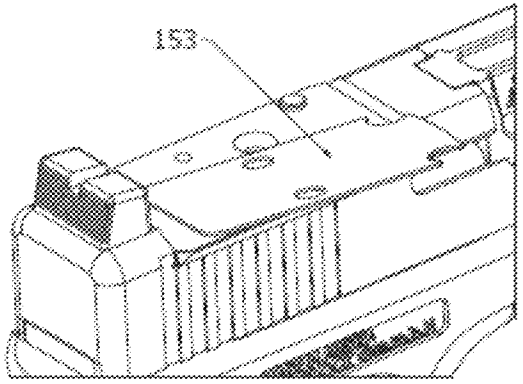
FIG. 1E (Background)
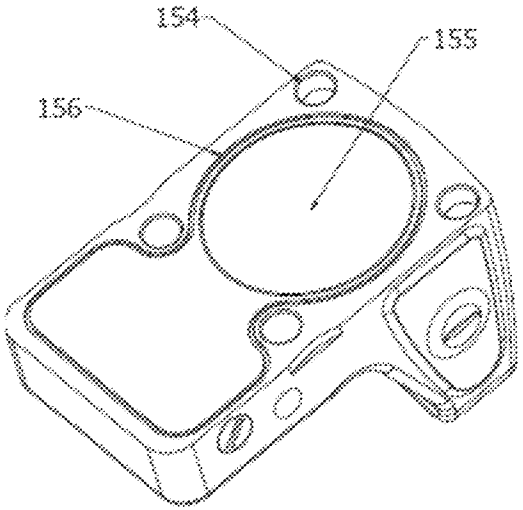
FIG. 1F (Background)
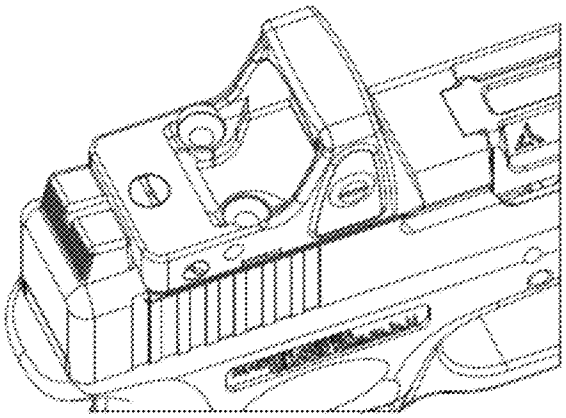
FIG. 1G (Background)

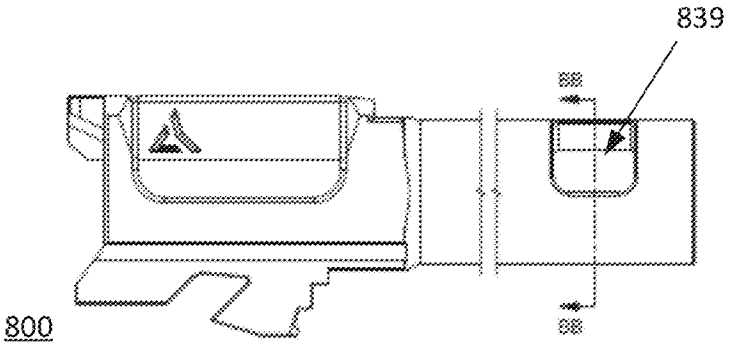
FIG. 8A
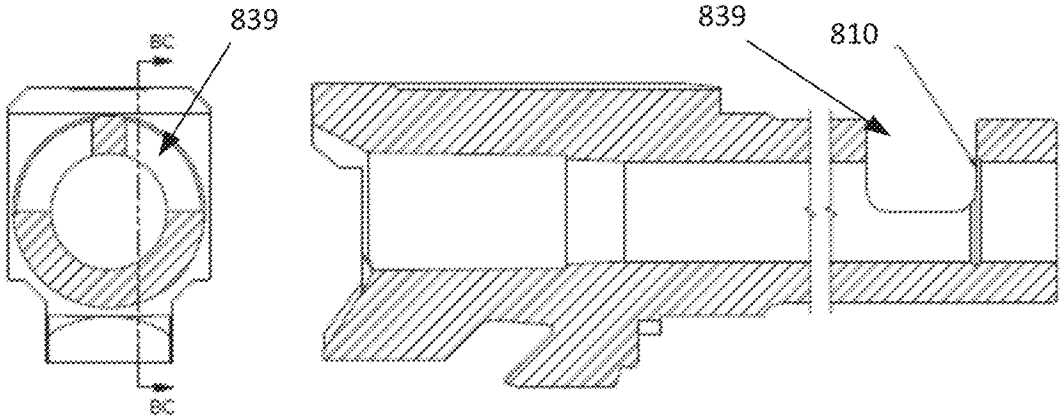
FIG. 8C
FIG. 8B

DETAIL K
ROUND TAPER PROFILE (Scale 1.5)

ADAPTER ASSEMBLY OR OTHER MOUNTING FEATURES FOR FIREARM OPTIC

PRIORITY

This application claims priority to U.S. Provisional Application No. 63/220,314 filed on Jul. 9, 2021, which is incorporated by reference herein. This application incorporates by reference U.S. Patent Publication 2021/0231407 entitled "Optic Guard for Firearm".

BACKGROUND

Typical firearms propel a bullet or other type of projectile through the expansion of gas within a firearm barrel. The majority of the gas may be expelled out of the front of the firearm barrel together with the bullet. However, some firearms may exploit a portion of the gas to reduce recoil.

An accessory called a compensator can be used to retrofit a firearm with recoil reduction. These accessories are attached to the muzzle end of the barrel. However, this increases the total length of the firearm.

BRIEF DESCRIPTION OF THE DRAWINGS

FIG. 1B illustrates a partial top view of a slide with an MOS (modular optic system) cover plate removed.

FIG. 1C illustrates a bottom view of an MOS adapter plate.

FIG. 1D illustrates a slide assembly in which the MOS adapter plate of FIG. 1C is installed on the slide of FIG. 1B.

FIG. 1E illustrates installation of a sealing plate on the slide assembly of FIG. 1D.

FIG. 1F illustrates a bottom view of an RMR (rugged miniature reflex) optic.

FIG. 1G illustrates the RMR optic of FIG. 1F and the sealing plate of FIG. 1E installed on the slide assembly of FIG. 1D.

FIG. 8A illustrates a side view of another barrel in which rifling may be preserved between the muzzle end of the barrel and a location coinciding with a front-most edge of the egress.

FIG. 8B illustrates a cross-sectional view taken across a width of the barrel of FIG. 8A.

FIG. 8C illustrates a cross-sectional view taken along line BC of FIG. 8B.

FIGS. 22A, 22B, 22C, 22D, and 21E show an exploded view, an isometric view, a top view, and a front view, and a cross-sectional side view, respectively, of another compensator system with a threaded barrel.

DETAILED DESCRIPTION

Slide Assembly to Provide Gas Compensation to Reduce Recoil

Services have been offered to bore openings in a slide assembly to guide gas propelled from a chamber of a firearm in a direction to provide recoil reduction. The service provider obtains a slide assembly from the customer, removes material from various components of the slide assembly, and then returns the slide assembly to the customer.

In some services, the service provider removes material from a top half of the barrel to form a gas port. The service provider may also remove material from the top and/or sides of the slide around the gas port in the barrel in an attempt to vent some of the gas exiting the gas port out top and/or sides the slide. However, if these slide vents are not effective at venting the gas exiting the gas port, then the unvented gas may distribute carbon particles throughout the firearm, which may eventually degrade operation of the firearm.

Also, removing the material from the gas port in the barrel may leave burs that may contact a bullet passing by the gas port (on its way to the muzzle)—changing its trajectory. These burs may also strip material from the passing bullet. This stripped material, like the carbon particles, may be distributed through the firearm, which may eventually degrade operation of the firearm (also the stripped material is a safety concern for the shooter and/or bystanders).

Figure 1A:
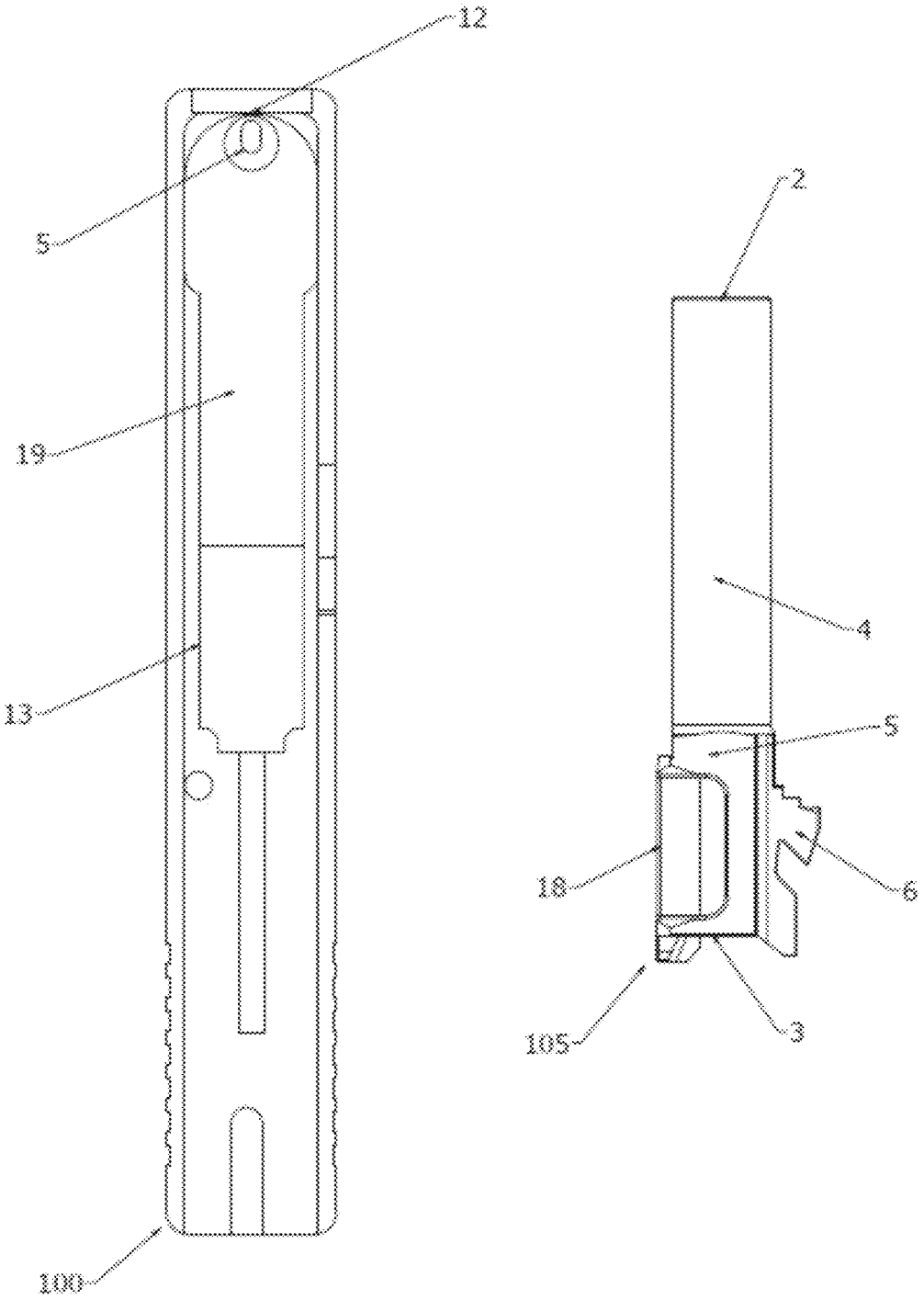
FIG. 1A illustrates a slide assembly including a bottom view of a slide and a side view of a barrel.

FIG. 1A illustrates a slide assembly including a bottom view of a slide 100 and a side view of a barrel 105. In this example, the slide 100 and barrel 105 are Glock-compatible. A Glock-compatible firearm component is compatible with the Glock design (but may be produced by a third party).

The barrel 105 includes a breech 3, a muzzle 2, and a length including a cylindrical bore length segment 4 (which includes the bore of the barrel 105) and a non-cylindrical barrel hood segment 5 (which includes the chamber of the barrel 105).

When the barrel 105 is locked into the slide 100, a tip of the muzzle end of the barrel 105 protrudes from the front of the slide 100. There are gaps between the rest of the bore length segment and the interior of the top and the sides of the slide 100. In particular, the width (w1) of the interior of the slide 100 corresponds to the width of the barrel hood, which accommodates rearward movement of the slide 100 relative to the barrel 105 following firing of the firearm. A wear marking 19 can be seen on the underside of the top of the slide 100 where the top of the barrel hood 18 (e.g., the side opposite the lugs 6) slides against the underside of the top of the slide 100 during this movement (the length of this wear marking 19 corresponds to the length of stroke of the firearm). In this slide assembly, these gaps are continuous from the opening 13 (which receives the top 18 of the barrel hood) past the sight mount 5 to the front interior wall 12 of the slide.

Figure 2A:
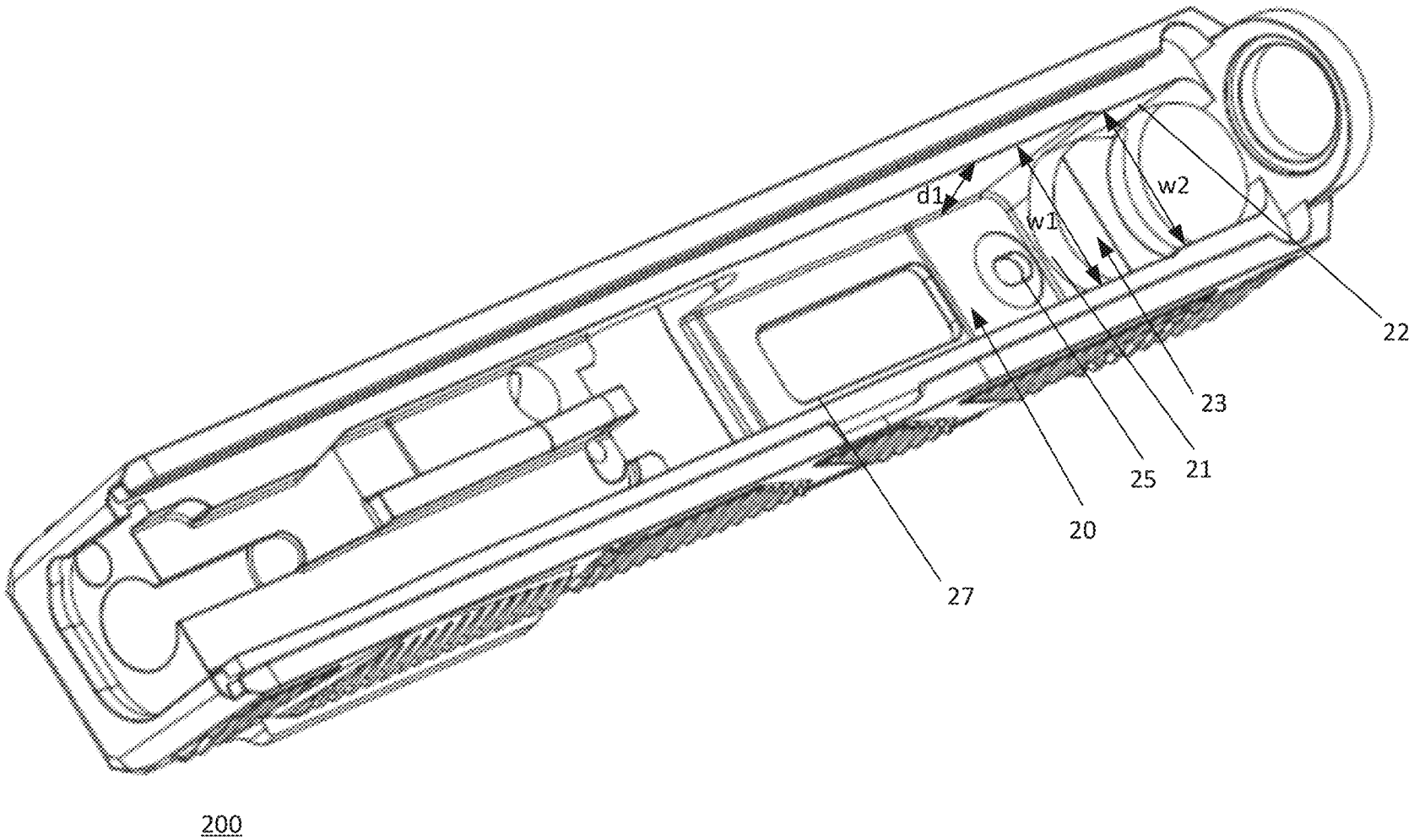
FIG. 2A illustrates a bottom view of a slide for a slide assembly to provide a firearm with gas compensation to reduce recoil.
Figure 2B:
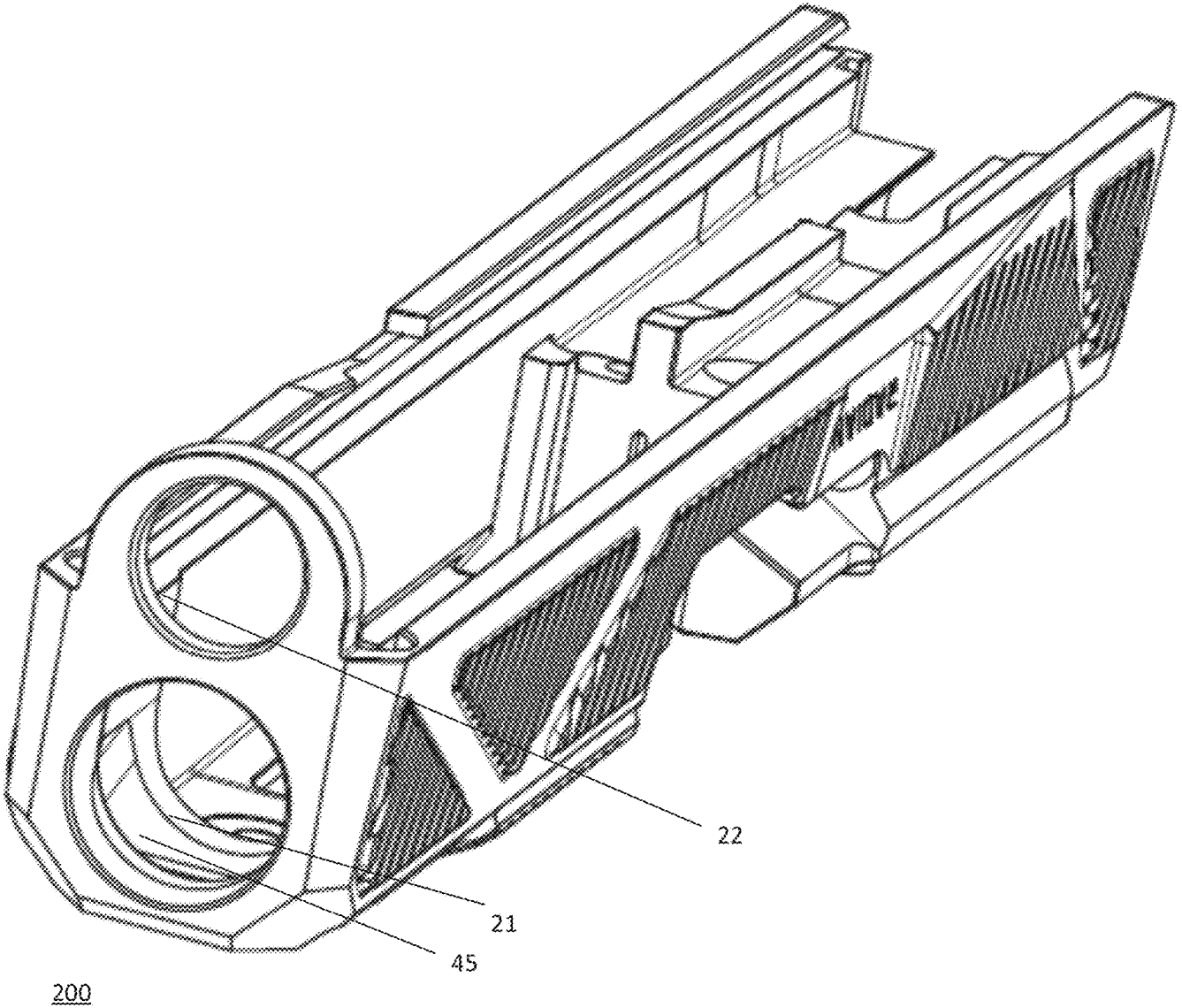
FIG. 2B illustrates a front view of the slide of FIG. 2A.

FIG. 2A illustrates a bottom view of a slide 200 for a slide assembly to provide a firearm with gas compensation to reduce recoil. FIG. 2B illustrates a front view of the slide 200.

The slide 200 may have the same compatibility as the slide 100 of FIG. 1. For instance, the slide 200 may be a retrofit for a firearm manufactured with the slide 100 of FIG. 1, in some examples (the slide 200 of course may also be an original part of a firearm, in other examples).

The interior of the top and sides of the slide 200 define an arch 21. A width (w2) of an interior of the arch 21 may be less than the width (w1). The same reference number w1 is used to indicate that the width behind the arch 21 may be the same as the width between the interior sides of the slide 100 of FIG. 1A. The width (w2) may correspond to a width of the bore length segment 4 (FIG. 1A).

Behind the arch 21 is a barrel hood channel 20 with the width (w1) and a depth (d1) corresponding to a height of the barrel hood 5 (FIG. 1A). The barrel hood channel 20 may receive the barrel hood through a range of motion of the slide 200 relative to the barrel responsive to a firing of the firearm. When the barrel is locked into the slide 200, a gap between the bore length segment of the barrel and the interior top and sides of the slide 200 in the barrel hood channel 20 may be the same as the gap with the bore length segment 4 and interior of the sides of the slide 100 (FIG. 1). In contrast, in a slide assembly using the slide 200, the gap between the bore length segment and the protrusions that define the interior sides and underside of the arch 21 may be less. In some embodiments, an underside of the arch 21 may be arranged to slidingly engage the upper region of the bore length segment in part of the range of motion (although this is not required). In some embodiments, the width (w2) may be at least the width of the bore length segment.

Figure 3:
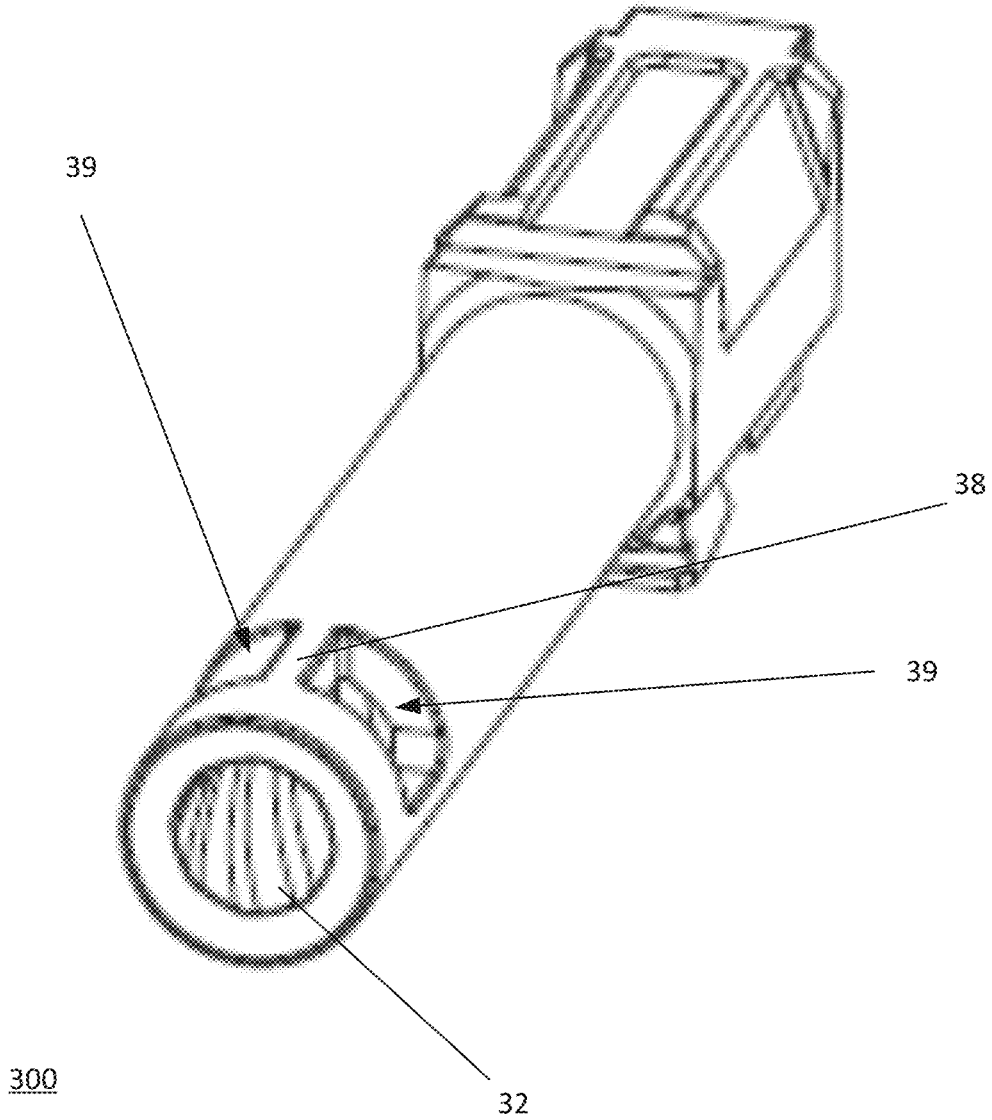
FIG. 3 illustrates a front view of a barrel operable with the slide of FIGS. 2A-B.

FIG. 3 illustrates a front view of a barrel 300 operable with the slide 200 of FIGS. 2A-B. An upper section of the barrel 300 (proximate to the muzzle 32) defines an egress 39 for gas propelled from the chamber of the firearm. In this example, a rib 38 is located between the openings. The egress 39 may be formed by removing material from a barrel similar to the barrel 105 (FIG. 1A).

Referring again to FIGS. 2A-B, the slide 200 may define an opening 23 in front of the arch 21 to expose the egress 39 (FIG. 3). In this embodiment, the opening 23 is a single contiguous opening; however, this is not required. Also, in this embodiment, the opening 23 is defined by protrusions on both the top and sides of the slide 200; however, this is not required. In other embodiments, the opening 23 may be defined by protrusions on the top and/or sides of the slide 200.

In this embodiment, protrusions 22 defined by the interior of the sides of the slide 200 may be located in front of the arch 21. The distance between surfaces of the protrusions 22 may be the same as the distance w2.

The slide 200 may include a sight mount opening 25 behind the arch 21. In this embodiment, the slide 200 also includes a window 27 located behind the arch 21 (the window 27 may facilitate cooling of the barrel 300; however, other embodiments may omit the window 27).

Referring again to FIG. 3, removing material from the egress 39 may be selective to form a rib 38 between separate bore openings of the egress 39. The exterior of the rib 38 is arranged to engage the underside of the arch 21 (FIG. 2A) following firing. This engagement prevents the underside of the arch 21 from catching on the egress 39. By selectively removing material from the egress 39 to leave the rib 38, the size of the egress 39 may be optimized to extend across substantially all of an upper half of a front section of the bore length segment of the barrel 300.

Figure 4A:
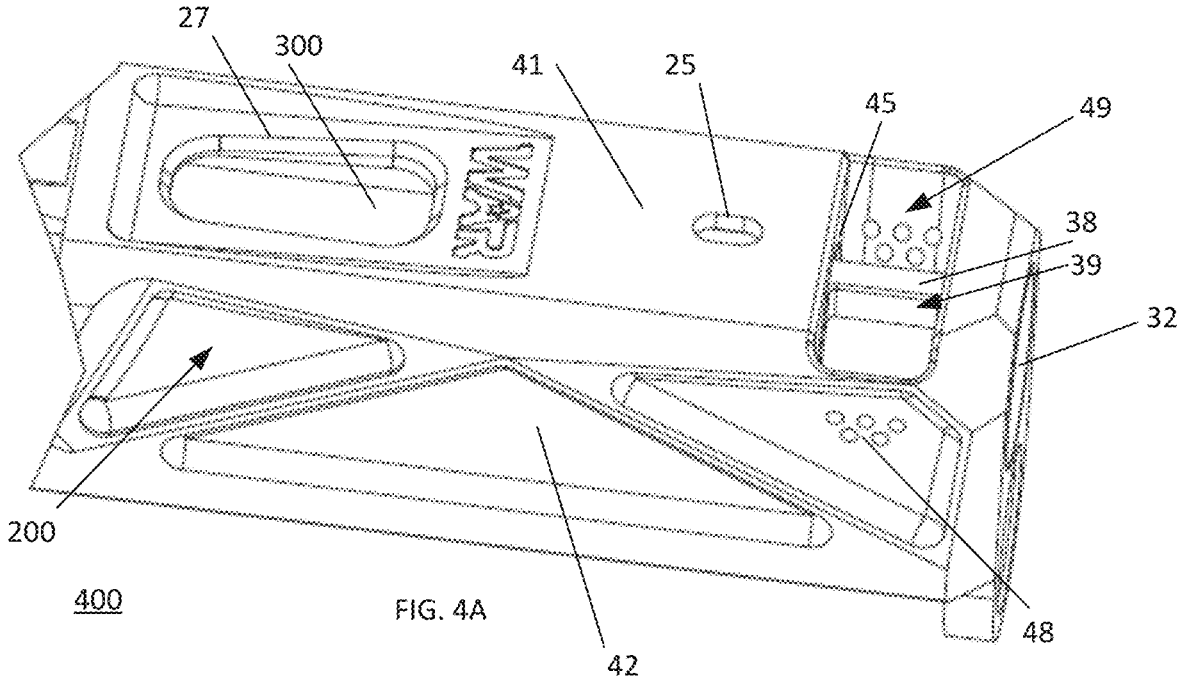
FIG. 4A illustrates a partial side view of firearm having slide assembly including the slide illustrated in FIGS. 2A-B and the barrel illustrated in FIG. 3.
Figure 4B:
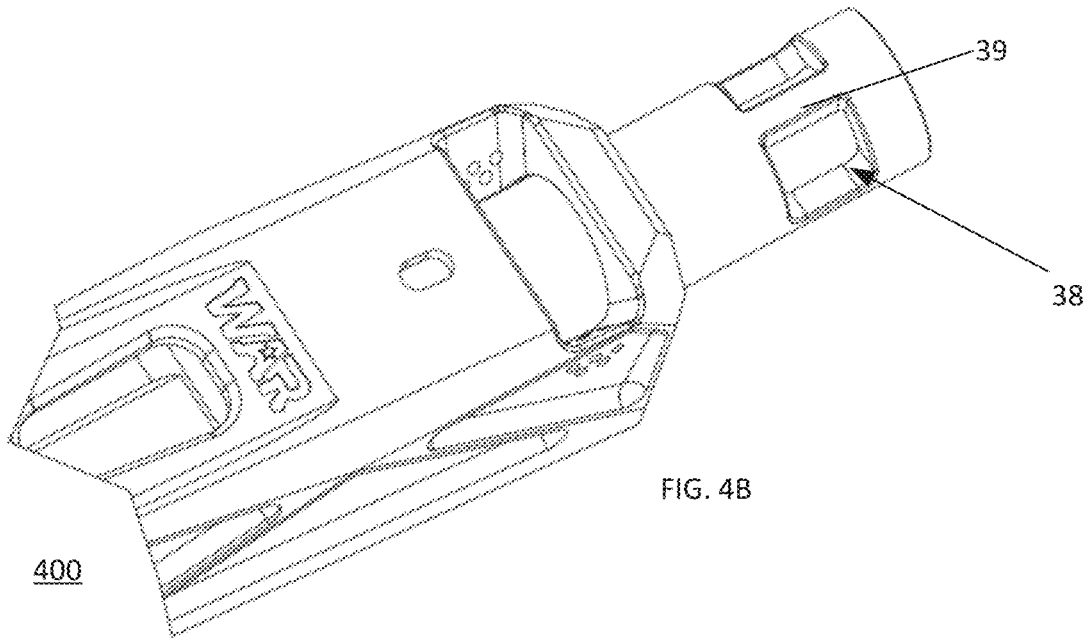
FIG. 4B illustrates a partial side view of firearm of FIG. 4A in which the slide is retracted.

FIG. 4A illustrates a partial side view of firearm having slide assembly 400 including the slide 200 illustrated in FIGS. 2A-B and the barrel 300 illustrated in FIG. 3. FIG. 4B illustrates a partial side view of firearm of FIG. 4A in which the slide 200 is retracted.

This embodiment includes a gas port 49 formed by the egress 39 of the barrel 300, a front surface 45 of the arch 21 (FIGS. 2A-B), the protrusions 22 (FIGS. 2A-B), an interior of a front of the slide 200, and the opening 23 (FIGS. 2A-B). In particular, sidewalls of the gas port 49 may include a surface of sidewalls of the egress 39, the front surface 45 of the arch 21, a surface of the protrusions 22, a surface of the interior of the front of the slide 200, and a surface of sidewalls of the opening 23. In other embodiments, a barrel gas port may be located a distance from one or more of the front surface 45 (the arch 21 may be located a distance behind the barrel gas port), a distance from surfaces of the interior of the sides of the slide (these surfaces may or may not include the protrusion 22), a distance from a surface of the interior of the front of the slide, and/or a distance from a surface of sidewalls of opening(s) in the slide.

In this embodiment, a group 48 of holes is located on the sides 42 of the slide (only one of the sides 42 is shown in this view). Each hole may include a first end on the exterior surface of the sides 42 and a second end on a sidewall of the gas port 49. The group 48 of holes may be omitted in other embodiments.

A transition edge between the top 41 and sides 42 of the slide 200 may be sloped (e.g., a beveled edge). A portion of a perimeter of the opening 23 (FIGS. 2A-B) in the slide 200 may be located on this sloped edge, as in the illustrated embodiment; however, this is not required.

Figure 5A:
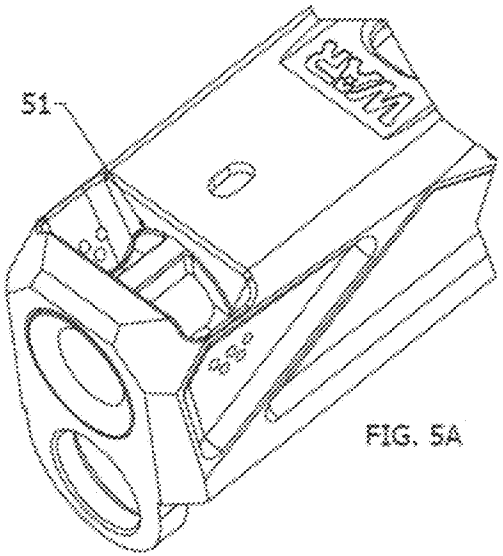
FIG. 5A illustrates a perspective view of a muzzle end of a slide assembly having a gas port formed from an egress in a barrel, a front surface of an arch on the underside of the slide, an opening in the slide, and an interior of a front end of the slide.

FIG. 5A illustrates a perspective view of a muzzle end of a slide assembly having a gas port formed from an egress in a barrel, a front surface of an arch on the interior of the slide, an opening in the slide, and an interior of a front end of the slide. In this embodiment, the back wall 51 of the gas port is a continuous wall defined by a front surface of an arch and a back wall of the barrel egress (the arch may be similar in any respect to the arch 21 of FIGS. 2A-B).

Figure 5C:
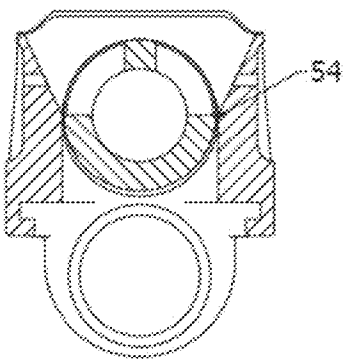
FIG. 5C illustrates a cross-sectional view of the slide of the slide assembly of FIG. 5A taken across a width of the slide assembly.
Figure 5B:
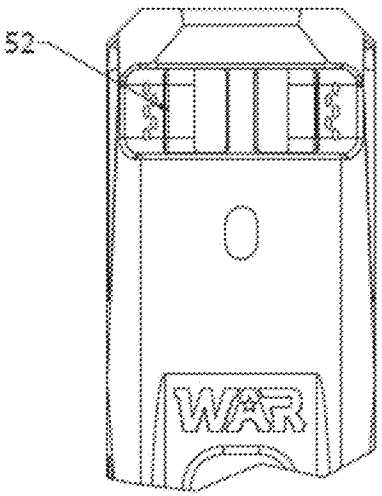
FIG. 5B illustrates a top view of the slide assembly of FIG. 5A.

FIG. 5B illustrates a top view of the slide assembly of FIG. 5A. The sides 52 of the gas port is a continuous wall defined by protrusions on an interior of the slide (the protrusions may be similar in any respect to protrusions 22 of FIGS. 2A-B) and extending to meet up with the bottom edge of the barrel egress of the barrel.

FIG. 5C illustrates a cross-sectional view of the slide assembly of FIG. 5A taken across a width of the slide assembly. In this view, the alignment 54 of the barrel egress to a slide opening geometry is shown.

Figure 5D:
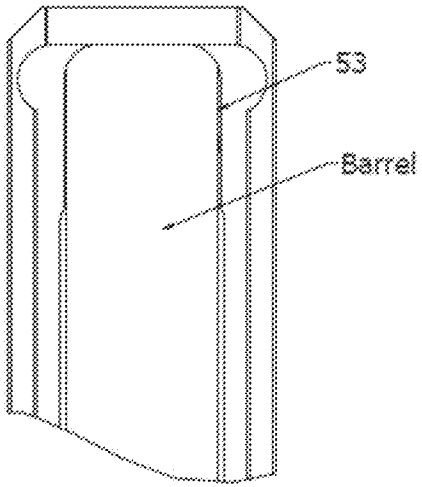
FIG. 5D illustrates a bottom view of the slide assembly.

FIG. 5D illustrates a bottom view of the slide assembly. The protrusions on the interior surface of the sides of the slide may sealingly engage 53 the barrel.

Figure 5E:
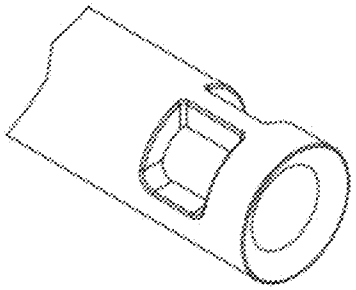
FIG. 5E illustrates a partial side view of the barrel of the slide assembly of FIG. 5A.

FIG. 5E illustrates the barrel of the slide assembly of FIG. 5A. This barrel may be similar in any respect to barrel 300 of FIG. 3. This barrel optionally includes scalloping, which may be visible through a window similar to window 27 (FIG. 2A).

Figure 6A:
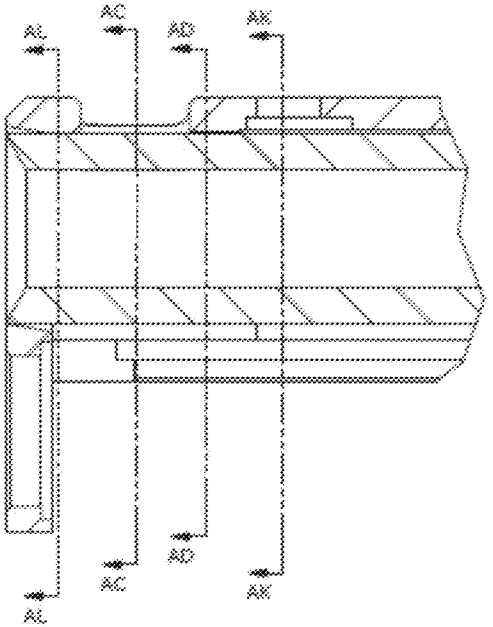
FIG. 6A illustrates a cross-sectional view of a muzzle end of the slide assembly of FIG. 5A taken across a length of the slide assembly.
Figure 6B:
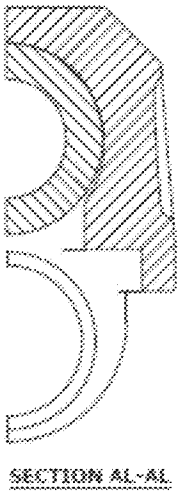
FIG. 6B illustrates a cross-sectional view taken along line AL of FIG. 5A.
Figure 6C:
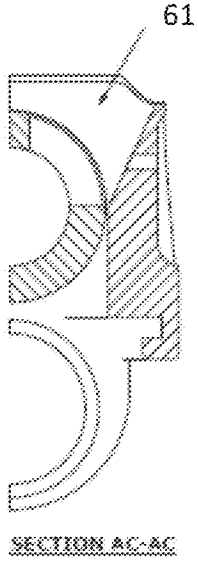
FIG. 6C illustrates a cross-sectional view taken along line AC of FIG. 5A.

FIG. 6A illustrates a cross-sectional view of a muzzle end of the slide assembly of FIG. 5A taken across a length of the slide assembly. FIG. 6B illustrates a cross-sectional view taken along line AL of FIG. 6A. FIG. 6C illustrates a cross-sectional view taken along line AC of FIG. 6A. A gas port 61 formed by an egress in a barrel and an opening in a slide is shown (this gas port may be similar in any respect to any gas port described herein).

Figure 6D:
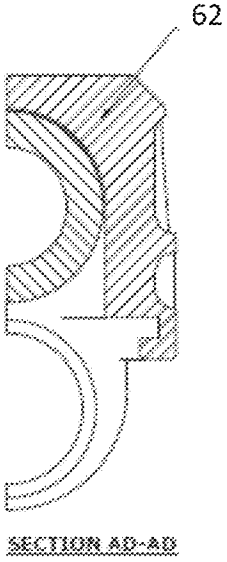
FIG. 6D illustrates a cross-sectional view taken along line AD of FIG. 5A.
Figure 6E:
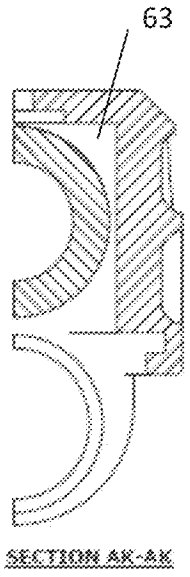
FIG. 6E illustrates a cross-sectional view taken along line AK of FIG. 5A.

FIG. 6D illustrates a cross-sectional view taken along line AD of FIG. 6A. Behind the gas port 61 (FIG. 6C), material 62 of protrusions on an interior of the top and sides of the slide extend toward the barrel. This material 62 may be material of an arch similar to arch 21 of FIG. 2A. FIG. 6E illustrates a cross-sectional view taken along line AK of FIG. 6A. A barrel hood channel 63 is shown in this view.

Figure 16A:
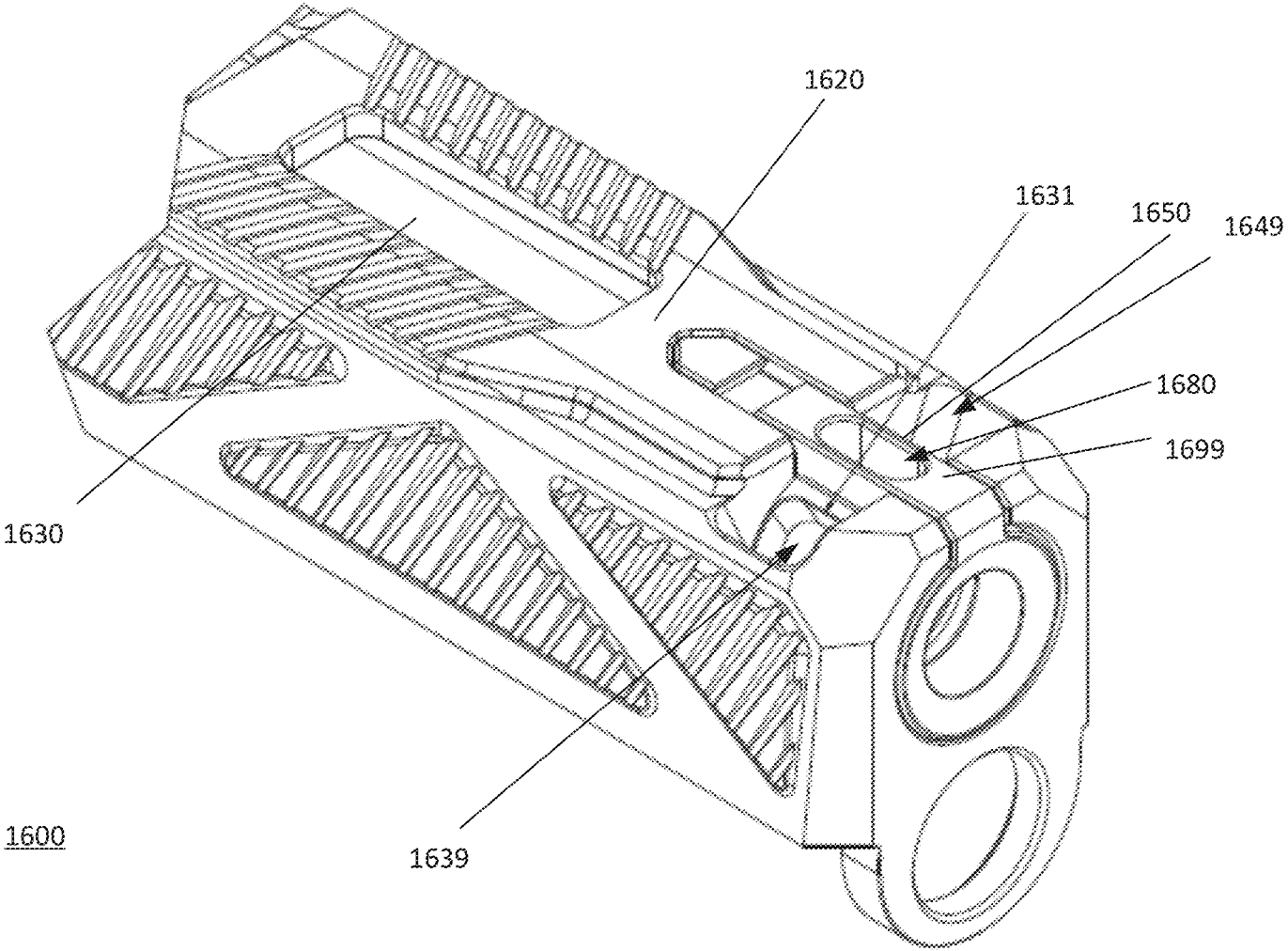
FIGS. 16A-B illustrate partial side views of another embodiment of a slide assembly to provide a firearm with gas compensation to reduce recoil in which the barrel includes a sight tracker.
Figure 16B:
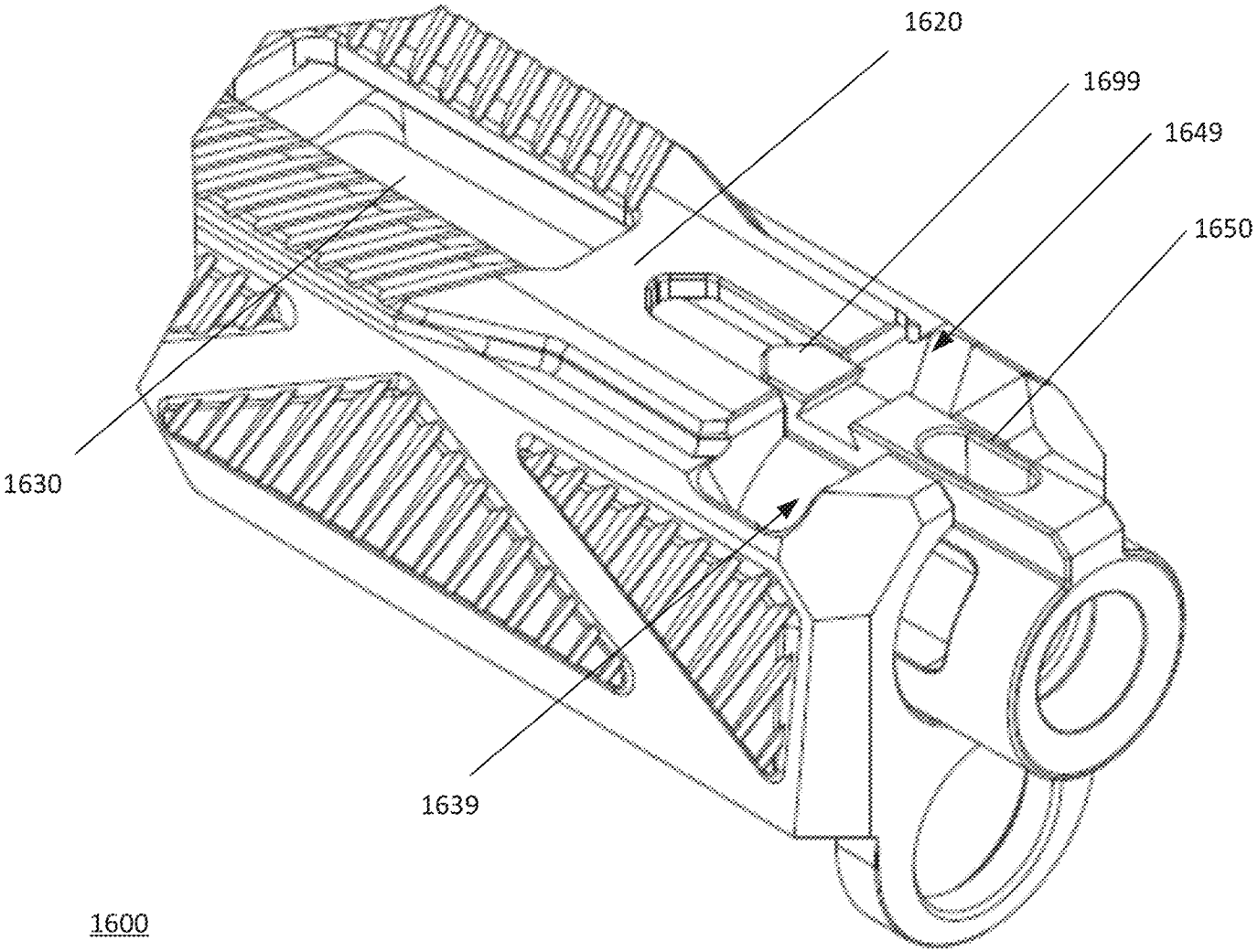

FIGS. 16A-B illustrate a partial side view of another embodiment of a slide assembly 1600 to provide a firearm with gas compensation to reduce recoil in which the barrel 1630 includes a sight tracker 1699. The barrel 1630 is locked with the slide 1620 in the partial side view of FIG. 16A. The partial side view of FIG. 16B shows a state following firing once the slide 1620 has moved relative to the barrel 1630.

Referring again to FIG. 16A, the slide 1620 may be similar to slide 200 (FIG. 2A) in any respect. The barrel 1630 may be similar to barrel 300 (FIG. 3) in any respect. The gas port 1649 may be similar to gas port 49 (FIG. 4A) in any respect. The sight tracker 1699 includes a rib section 1650. In this embodiment of the sight tracker 1699, the sight tracker 1699 defines an additional gas port 1680 (cut through a center of the rib section 1650 and exposing an egress at an uppermost part of the barrel).

As shown in FIG. 16B, a top surface of sight tracker 1699 may protrude from the slide 1620 at least following a firing of the firearm (when the front of the barrel 1630 may rise with respect to the slide 1620). Using the sight tracker 1699, and due to the recoil reduction provided by the gas port 1649, a user may continue tracking a target more easily from one round to the next than in the same firearm without the firearm assembly 1600.

Figure 16C:
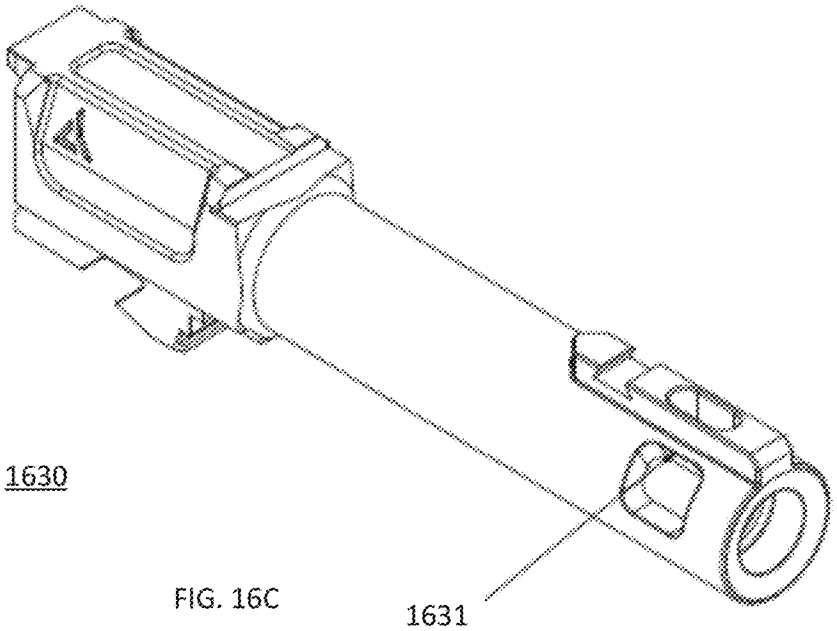
FIGS. 16C-D illustrate perspective and side views (respectively) of the barrel of the slide assembly of FIGS. 16A-B.
Figure 16D:
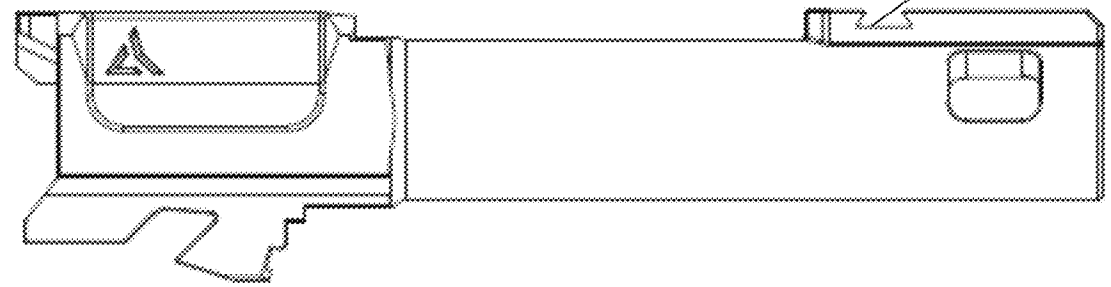

In this embodiment, an arc segment 1631 (FIG. 16A) of the barrel is located between an edge of the egress 1639 and the sight tracker 1699. FIGS. 16C-D illustrate perspective and side views (respectively) of the barrel 1630. The arc segment 1631 is shown in detail in FIG. 16C. In contrast to the sight opening 5 (FIG. 1A) which is in the slide 100, this front sight mount 1695 is part of the barrel. In this embodiment, the front sight mount 1695 is a dovetail groove, but other embodiments may utilize some other channel (or some other structure to mate with a bottom of a front sight). In other embodiments, a front sight and the barrel may be a unitary structure.

Barrel Interior

An egress on a barrel may be deburred to clear a path for the bullet. Also, to prevent stripping material from the bullet, some of the rifling inside the barrel near the muzzle may be removed (which may reduce stripping of the bullet as it passes the egress). Essentially, the muzzle end of the bore may be bored out by a tool inserted into the muzzle end of the barrel to remove rifling of the muzzle end of the bore to reduce or prevent bullet stripping. In one embodiment, the barrel is bored from the muzzle end of the barrel to behind the rear-most edge of the egress 39, e.g., about half a millimeter behind the rear-most edge, to prevent bullet striping. However, this is not required—in other embodiments rifling may be removed from the muzzle end of the barrel to a location corresponding with a front-most edge of the egress 39. However, other approaches are described below, and these approaches may eliminate bullet stripping without requiring removal of the rifling between the muzzle end of the barrel and the location corresponding with either edge of the egress 39.

Figure 7A:
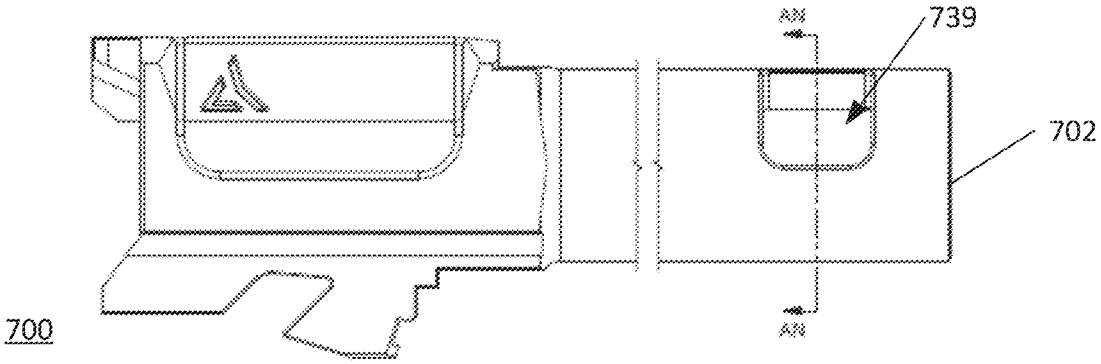
FIG. 7A illustrates a side view of a barrel in which rifling may be preserved between the muzzle end of the barrel and a location coinciding with a front-most edge of the egress.

FIG. 7A illustrates a side view of a barrel 700 in which rifling may be preserved between the muzzle end 702 of the barrel and a location coinciding with a front-most edge of the egress 739. The barrel 700 may be similar in any respect to the barrel described with reference to FIG. 3, or any other barrel described herein.

Figure 7C:
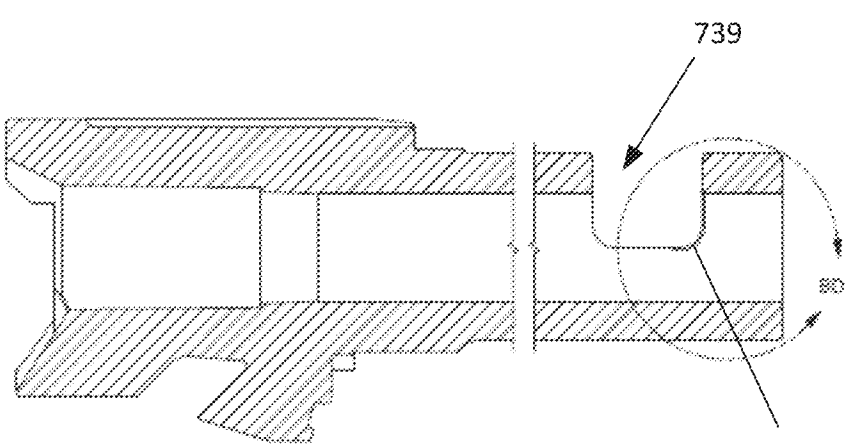
FIG. 7C illustrates a cross-sectional view taken along line BA of FIG. 7B.
Figure 7D:
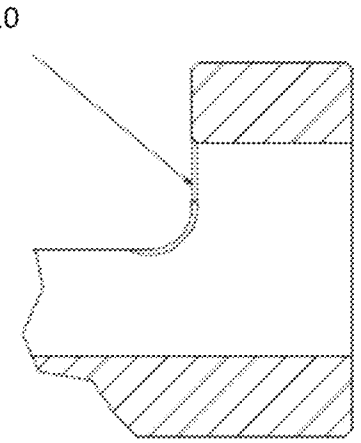
FIG. 7D illustrates a detailed view of the chamfer on a front-most bore edge of the egress.
Figure 7B:
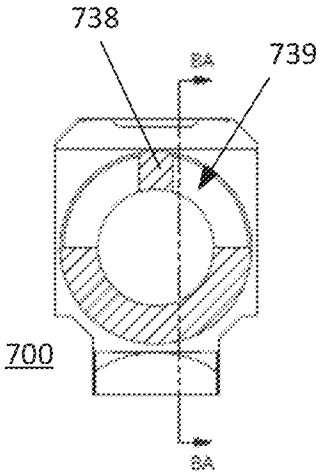
FIG. 7B illustrates a cross-sectional view taken across a width of the barrel of FIG. 7A.

FIG. 7B illustrates a cross-sectional view taken across a width of the barrel 700 of FIG. 7A. In this example, the egress 739 spans a distance from a middle of the side of the barrel to an edge of the rib 738 at the top of the barrel 700. The rifling on the inside of the rib 738 may assist in imparting rotation to the bullet.

FIG. 7C illustrates a cross-sectional view taken along line BA of FIG. 7B. In this view, the chamfer 710 on the bore-edge of the egress 739 is visible. FIG. 7D illustrates a detailed view of the chamfer 710 on a front-most bore-edge of the egress. This chamfer 710 may be provided on an entire front-most bore edge of the egress 739. Other edges may include chamfers, although chamfers are not required on the entirety of the other edges to prevent bullet stripping. The chamfer 710 may be formed by removing material from the egress 739, and then cutting the chamfer 710 on the front-most edge of the egress 739.

FIG. 8A illustrates a side view of another barrel in which rifling may be preserved between the muzzle end of the barrel and a location coinciding with a rear-most or front-most edge of the egress. FIG. 8B illustrates a cross-sectional view taken across a width of the barrel of FIG. 8A. FIG. 8C illustrates a cross-sectional view taken along line BC of FIG. 8B. In this view, the circumferential groove 810 can be seen. The circumferential groove 810 may have sloped sidewalls (e.g., a V-shaped groove) in which the circumferential groove 810 is centered on the front-most edge of the egress 839 (in other examples, the circumferential groove 810 may be centered on the rear-most edge of the egress 839). In some embodiments, circumferential grooves may be centered on the front-most edge of the egress 839 and the rear-most edge of the egress 839, respectively.

Figure 9A:
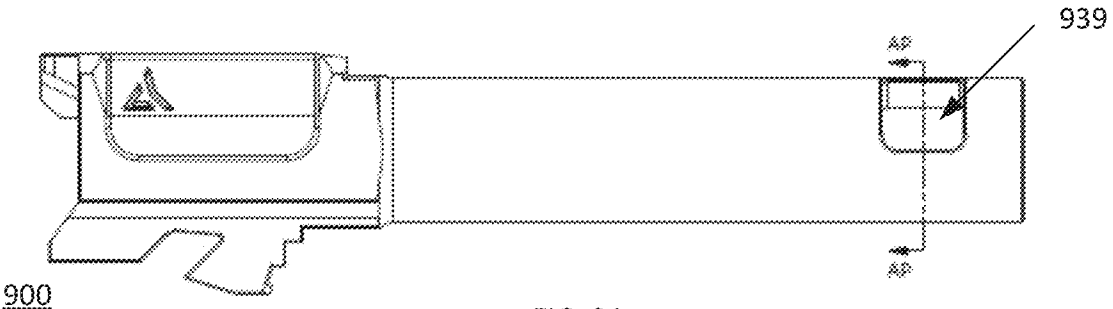
FIG. 9A illustrates a side view of yet another barrel in which rifling may be preserved between the muzzle end of the barrel and a location coinciding with a front-most edge of the egress.
Figure 9C:
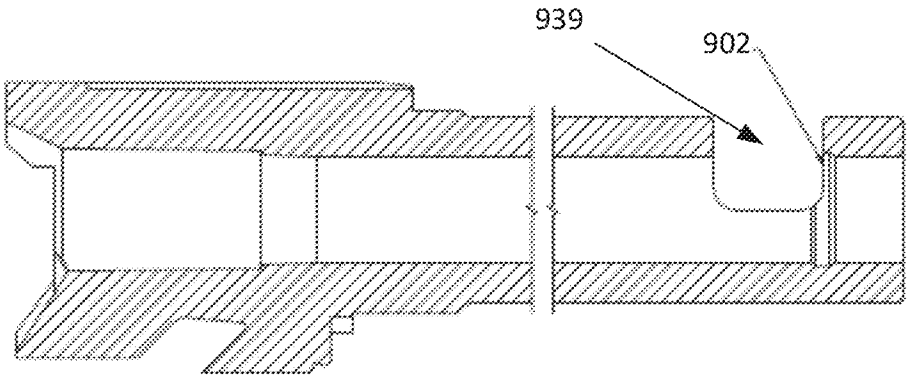
FIG. 9C illustrates a cross-sectional view taken along line AY of FIG. 9B.
Figure 9B:
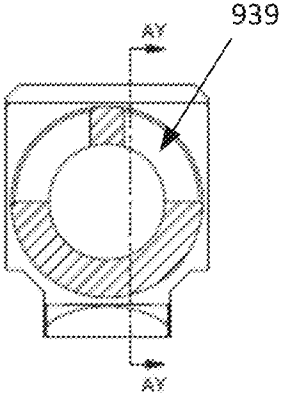
FIG. 9B illustrates a cross-sectional view taken across a width of the barrel of FIG. 9A.

FIG. 9A illustrates a side view of yet another barrel in which rifling may be preserved between the muzzle end of the barrel and a location coinciding with a rear-most or front-most edge of the egress. FIG. 9B illustrates a cross-sectional view taken across a width of the barrel of FIG. 9A. FIG. 9C illustrates a cross-sectional view taken along line AY of FIG. 9B. In this view, the circumferential groove 910 can be seen. The circumferential groove 910 may have sloped sidewalls (e.g., sidewalls similar to circumferential groove 810 of FIG. 8C) and additionally may have a bottom width between bottoms of the sidewalls.

In one example, the bottom width may be a flat bottom, although this is not required. The circumferential groove 910 need not necessarily be centered on the front-most or rear-most bore-edge of the egress 939. This may improve manufacturing tolerances as compared to the chamfer 710 or the V-shaped circumferential groove. The front-most or rear-most edge of the egress may coincide with any portion of the bottom width.

Alignment System to Control Movement of a Barrel Relative to a Slide

Figure 10A:
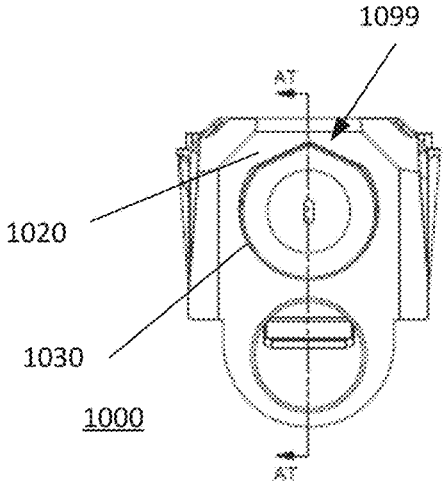
FIG. 10A illustrates a cross-sectional view taken across a width of a slide assembly with an alignment system to restrict movement of the muzzle end of the barrel within a plane perpendicular to a bore axis of the barrel and prevent rotational movement of the barrel relative to the slide.

FIG. 10A illustrates a cross-sectional view taken across a width of a slide assembly 1000 with an alignment system 1099 to restrict movement of the muzzle end of the barrel 1030 within a plane perpendicular to a bore axis of the barrel 1030 and prevent rotational movement of the barrel 1030 relative to the slide 1020. The bore axis is the center of a bore extending from a start of the bore to the muzzle end of the bore (in this view, the bore axis is at a center of the bore of the barrel 1030 going into the page, and the plane coincides with the page).

The alignment system 1099 includes a groove or protrusion located on the bore length segment of the barrel 1030. This groove or protrusion mates with a protrusion or groove defined by an interior surface of the slide. In this embodiment, the bore length segment of the barrel 1030 is non-cylindrical, and the alignment system 1099 includes a protrusion on a top of the barrel 1030 (e.g., the pointed top of the non-cylindrical bore length segment). In this embodiment, the protrusion mates with a groove defined by an underside of a top of the slide 1020. The alignment system 1099 reduces lateral movement of the muzzle end of the barrel 1030 within the plane (e.g., prevents movement of the barrel to the left or right).

Figure 10B:
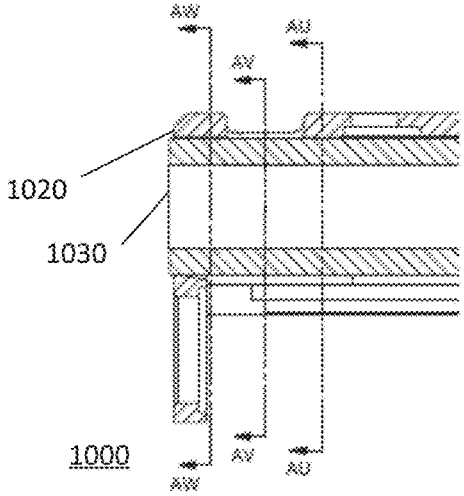
FIG. 10B illustrates a cross-sectional view taken across a width of the slide assembly of FIG. 10A.
Figure 10C:
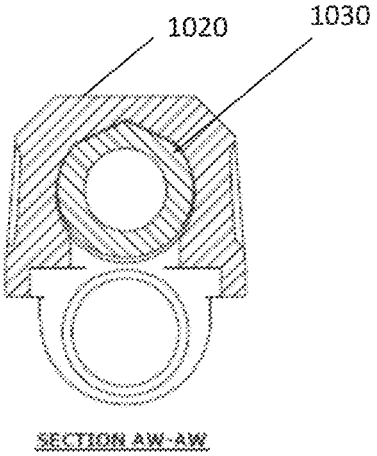
FIG. 10C illustrates a cross-sectional view taken along line AW of FIG. 10B.
Figure 10D:
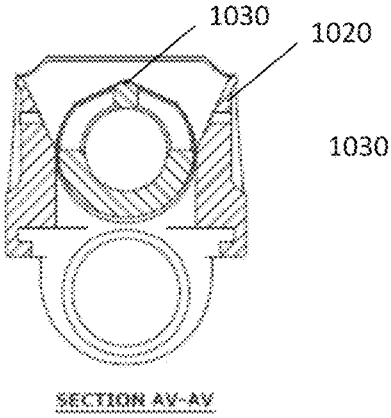
FIG. 10D illustrates a cross-sectional view taken along line AV of FIG. 10B.
Figure 10E:
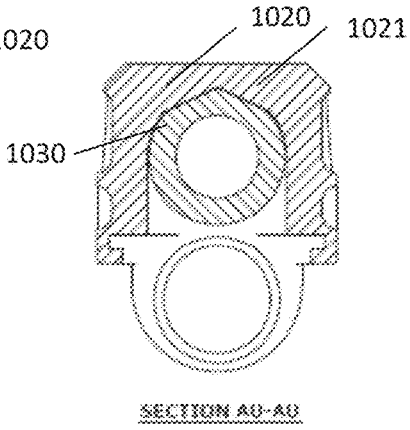
FIG. 10E illustrates a cross-sectional view taken along line AU of FIG. 10B.

FIG. 10B illustrates a cross-sectional view taken across a width of the slide assembly of FIG. 10A. FIG. 10C illustrates a cross-sectional view taken along line AW of FIG. 10B. FIG. 10D illustrates a cross-sectional view taken along line AV of FIG. 10B. FIG. 10E illustrates a cross-sectional view taken along line AU of FIG. 10B. FIGS. 10C-E illustrate that the slide assembly 1000 provides gas compensation to reduce recoil. In particular, an arch 1021 is shown in FIG. 10E, and this arch may be similar in any respect to arch 21 (FIG. 2A).

The arch 1021 includes a triangular shaped underside, in contrast to the rounded underside of the arch 21 (which does not include the alignment system 1099). Other examples including of slide assemblies to provide gas compensation to reduce recoil and with an alignment system may have differently shaped arches (for instance, it may be possible and practical to have a protrusion from an underside of the arch to mate with a groove formed on an upper section of a non-cylindrical barrel).

Also, some embodiments of a slide assembly that do not provide gas compensation to reduce recoil may utilize an alignment system similar to alignment system 1099. Such an embodiment may not include an arch similar to arch 21 (FIG. 2A) or arch 1021. However, an underside of the slide in such an embodiment may include the protrusion or groove on an underside of a front of the slide (e.g., a non-cylindrical opening in the front of the slide to receive a non-cylindrical bore length segment of a barrel). Accordingly, various embodiments of a slide assembly may include gas compensation and/or an alignment system.

Slide Assembly with Optic Mounting Platform

Pistols may be retrofitted with a red dot sight using an MOS (modular optic system) using a mount bracket located behind the ejection port. FIG. 1B illustrates a partial top view of a slide with an MOS (modular optic system) cover plate removed. The slide 150 may otherwise be similar to the slide 100 (FIG. 1A). FIG. 1C illustrates a bottom view of an MOS adapter plate 151 (the MOS adapter plate is an intermediary interface to couple to an optic adapter mounting interface—other optic adapter mounting interfaces exist). FIG. 1D illustrates a slide assembly 152 in which the MOS adapter plate 151 of FIG. 1C is installed on the slide of FIG. 1B.

FIG. 1E illustrates installation of a sealing plate 153 on the slide assembly 152 of FIG. 1D. The sealing plate 153 may be made out of thin sheet metal. The sealing plate 153 may have a width that is the same as a width of a bottom of an RMR optic 154 (FIG. 1F illustrates a bottom view of an RMR optic 154), both of which may be wider than the MOS adapter plate 151 (FIG. 1C). The sealing plate 153 forms a seal with a face groove seal 156 to prevent moisture from reaching the battery 155. FIG. 1G illustrates the RMR optic 154 of FIG. 1F and the sealing plate 153 of FIG. 1E installed on the slide assembly of FIG. 1D.

Figure 11A:
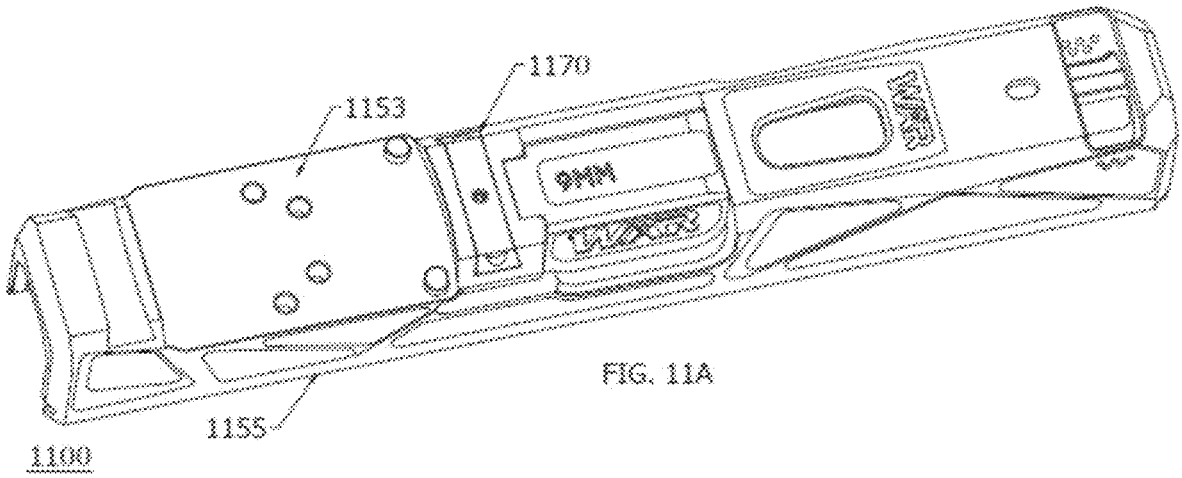
FIG. 11A illustrates a partial top view of a slide assembly including an optic mounting platform integrally formed on the top of the slide and a grip for charging the slide integrally formed from sides below the optic mounting platform.
Figure 11B:
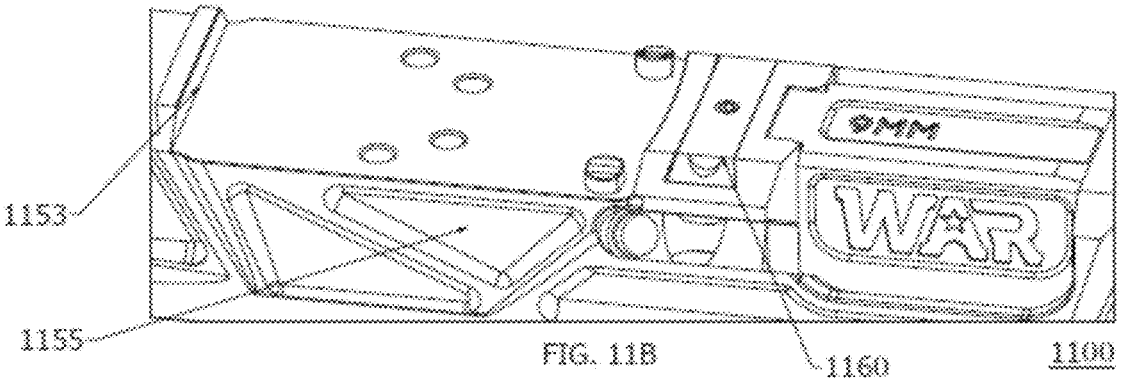
FIG. 11B illustrates a partial side view of the slide assembly of FIG. 11A.
Figure 11C:
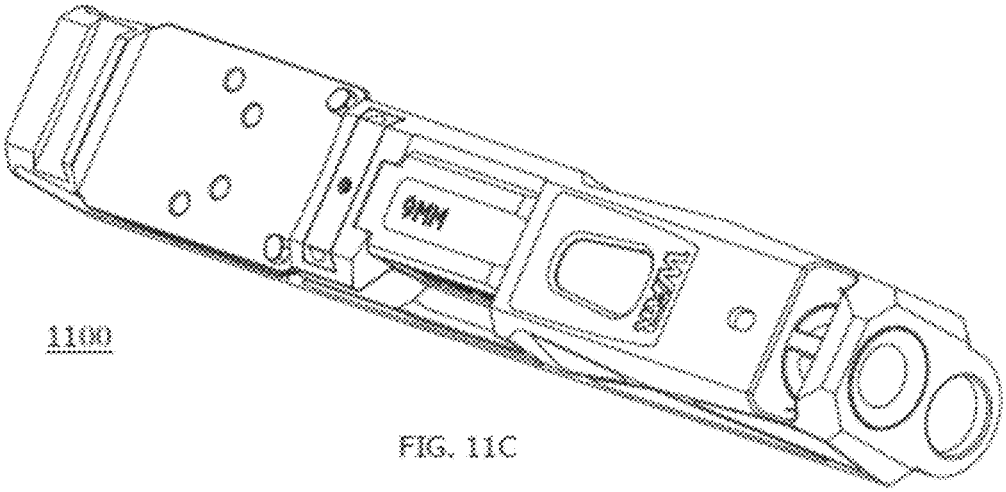
FIG. 11C illustrates the slide of FIGS. 11A-B being charged using the grip that is integrally formed from the sides below the optic mounting platform.

FIG. 11A illustrates top and side views of a slide 1100 including an optic mounting platform 1153 integrally formed on the top of the slide 1100 and a grip for charging the slide integrally formed from sides 1155 below the optic mounting platform 1153. FIG. 11B illustrates a partial side view of the slide 1100 of FIG. 11A. FIG. 11C illustrates the slide 1100 of FIGS. 11A-B being charged using the grip that is integrally formed from the sides 1155 below the optic mounting platform 1153.

Figure 13:
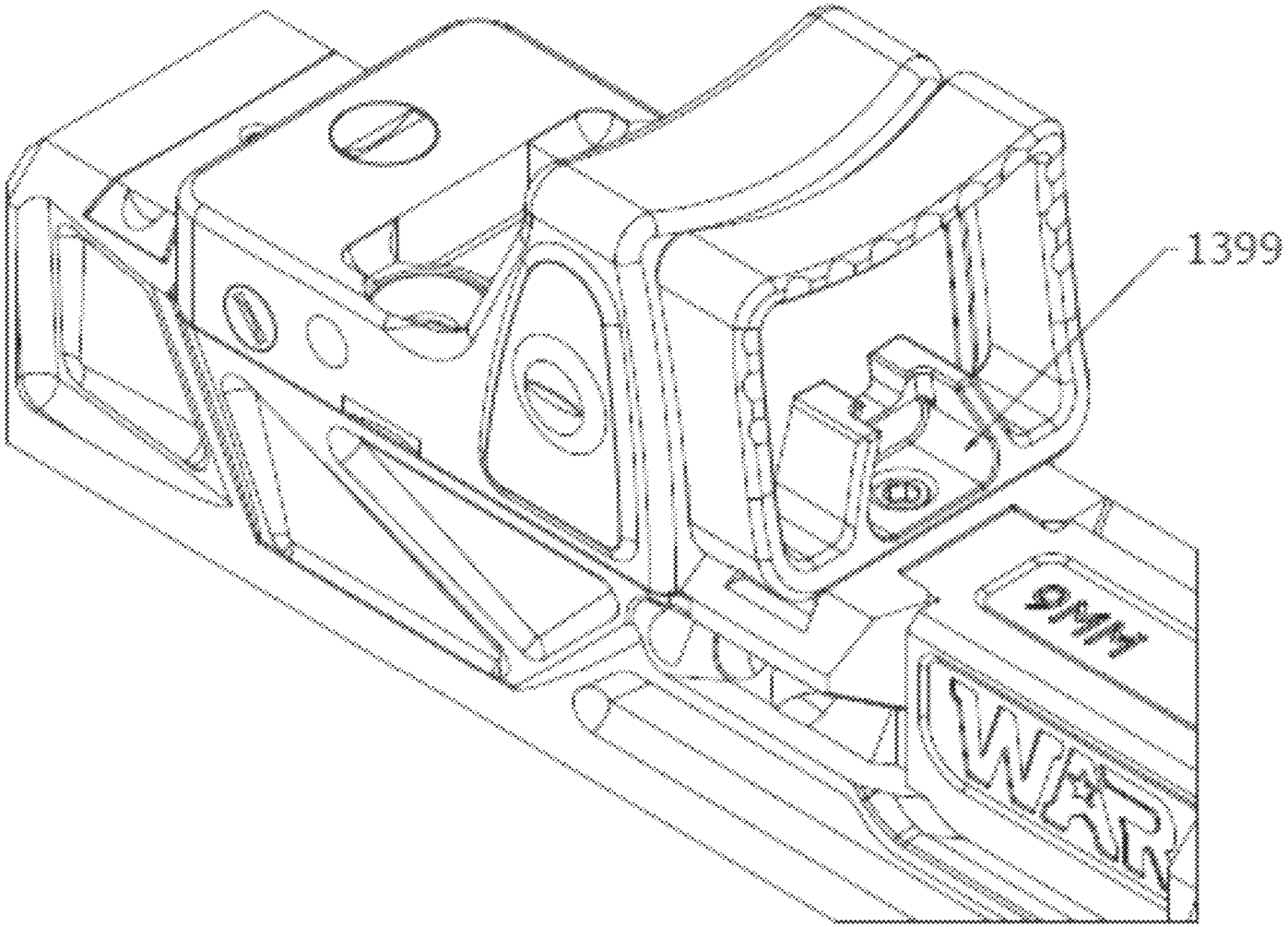
FIG. 13 illustrates a partial side view of an optic guard with an integrated rear sight.

Referring to FIG. 11A, in this embodiment, the width of the optic mounting platform 1153 corresponds to the width of the RMR optic 154 (FIG. 1F). FIG. 13 illustrates a partial side view of a slide assembly in which the RMR optic 154 illustrated in FIG. 1F is mounted directly on the slide 1100, and in which the sides of the RMR optic 154 align with sides of the optic mounting platform 1153. Other embodiments may be arranged for use with some other optic, and the sides of the optic mounting platform 1153 align with the sides of the optic.

Referring again to FIG. 11A, the RMR optic 154 may mount directly on the optic mounting platform 1153. The optic mounting platform 1153 includes a smooth surface to form a seal with the face groove seal 156 (FIG. 11C) of the RMR optic 154 in the case of direct mounting. In some embodiments, a distance between a surface of the optic mounting platform 1153 and the top of the RMR optic 154 may be less than a distance between a top of the slide 150 (FIG. 1B) and the RMR optic 154, reducing the height of the firearm assembly.

In this embodiment, the optic mounting platform 1153 is a recess in a top of the slide 1100. In particular, material is removed from the top of the slide 1100 to form the surface of the optic mounting platform. In this embodiment, the surface of the optic mounting platform 1153 is lower than a top of the slide 1100 in front and/or behind the optic mounting platform 1153. As such, a distance between the surface of the optic mounting platform and the top of the RMR optic 154 may be less than a thickness of a stack including the MOS adapter plate 151 (FIG. 1C) and/or the sealing plate 153 (FIG. 1E). In other embodiments, the optic mounting platform 1153 may be formed using other techniques besides recessing a top of the slide. Whether or not recessing is used, in various embodiments the surface of the top of the optic mounting platform 1153 may be arranged to be no greater than surfaces of a top of the slide in front and/or behind the optic mounting platform 1153 (e.g., lower than or coplanar with the surfaces of the top of the slide in front and/or behind the optic mounting platform 1153).

The sides of the slide 150 (FIG. 1B) include scalloping to grip the vertical sidewalls of the slide 150 to charge the slide 150. However, when the slide gets wet and/or if the user does not grip the slide optimally (say, due to an injury), the user's grip may slip before completely charging the slide.

Referring to FIG. 11A, the sides 1155 slope inward from an edge of the optic mounting platform 1153 to a lower location on the sides 1155. This provides an increasing width of the slide 1100 towards the optic mounting platform 1153). This increasing width gives the user leverage when gripping the slide 1100 to compensate for non-optimal conditions (e.g., wet equipment, or an injured hand).

In this embodiment, the inward slope is a continuous linear slope. In other embodiments, the sides 1155 may have a non-linear slope and/or may have varying slopes (for instance two or more slopes may be used to provide an angular surface). In various embodiments, the sides 1155 may have indentions (such as the scalloping of the slide 150 in FIG. 1B or some other indentation such as the triangular depression shown in FIG. 13) or bumps, as desired, to optimize the leverage associated with this grip point.

Figure 11D:
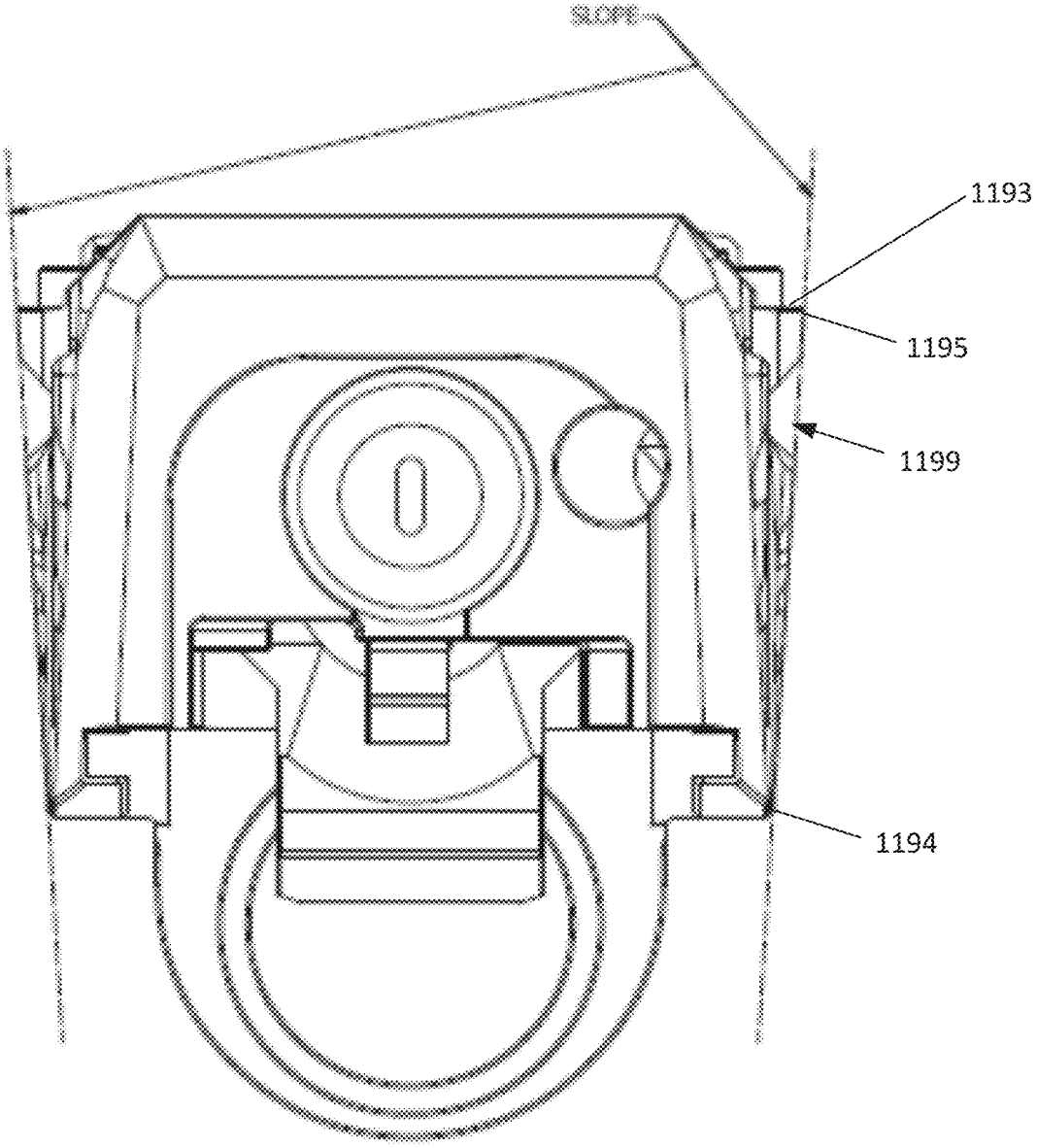
FIG. 11D illustrates a back view of a slide assembly in an embodiment in which the exterior sides of the slide are inward sloping from an upper location below the optic mounting platform to a lower location below the upper location.

FIG. 11D illustrates a back view of a slide assembly in an embodiment in which the exterior sides of the slide are inward sloping from an upper location 1195 below the optic mounting platform 1193 to a lower location below the upper location 1194. Optic mounting platform 1193 may be similar in any respect to optic mounting platform 1153 (FIG. 11A).

In this embodiment, a relief cavity 1199 is created by removing some material from a portion of the inward sloping exterior side. Other examples may not include the relief cavity 1199. Another embodiment may use a continuous non-linear slope. In yet other embodiments, the exterior sides may include varying slopes (linear slopes, non-linear slopes, or combinations thereof).

Figure 11E:
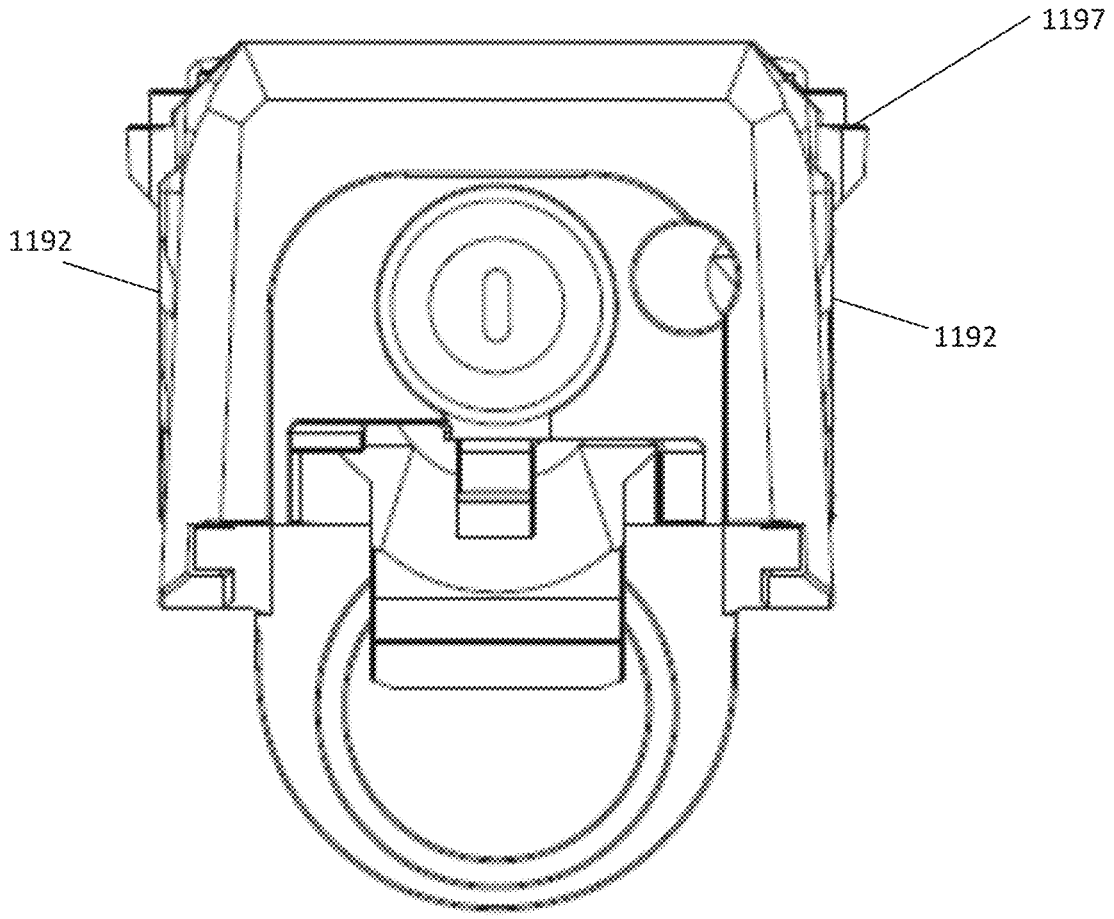
FIG. 11E illustrates a back view of a slide assembly in another embodiment including an optical mounting platform overhanging completely vertical exterior surfaces of sides of the slide.

FIG. 11E illustrates a back view of a slide assembly in another embodiment including an optical mounting platform 1197 overhanging fully vertical exterior surfaces 1192 of sides of the slide. The optical mounting platform 1197 may be similar to optical mounting platform 1193 (FIG. 11D) in any respect. In this embodiment, an upper portion of the exterior surface of the sides of the slide has two different inward slopes above the fully vertical exterior surface 1192. In other embodiments, there may be a single continuous slope above fully vertical exterior surfaces 1192 (and this single continuous slope may be linear or non-linear). In other embodiments, there may be no inward sloping (e.g., the sidewall section above fully vertical exterior surfaces 1192 may include only one or more fully horizontal sections and one or more fully vertical sections, e.g., one or more "steps").

Optic Guard

Referring again to FIG. 11A, this embodiment of the slide 1100 includes an optic guard mount 1170 in front of the optic mounting platform 1153. In this embodiment, the optic guard platform 1153 is integrally formed with the slide 1100 (e.g., integrally formed with the top and/or sides 1155 of the slide 1100). In this embodiment, the optic guard mount 1170 is a channel (e.g., a dovetail groove). A plug 1160 is shown installed in the dovetail groove in FIG. 11B. In other embodiments, an optic guard mount similar to optic guard mount 1170 may be provided in a firearm assembly that may or may not include the optic mounting platform 1153.

Figure 12:
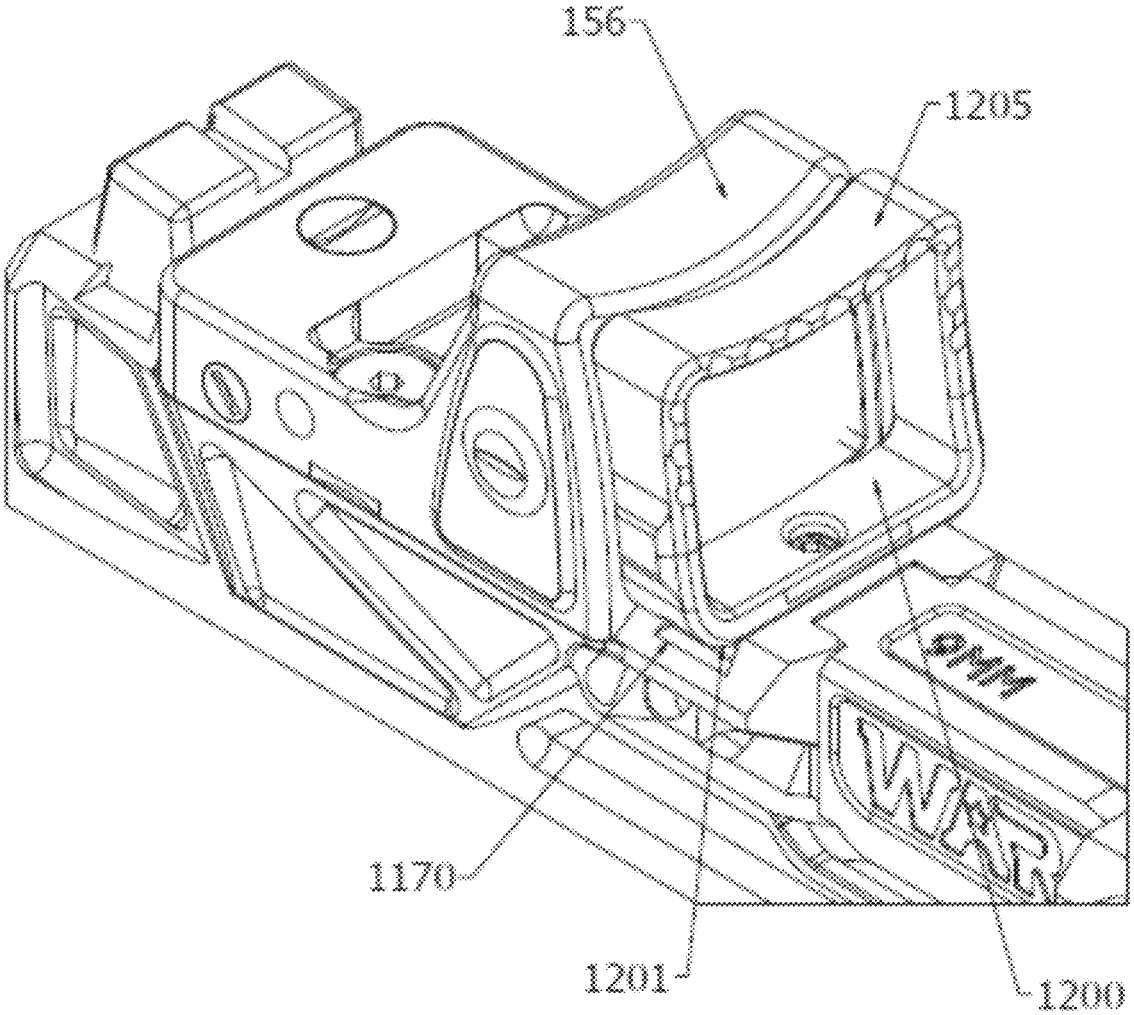
FIG. 12 illustrates a partial side view of a slide assembly in which the RMR optic illustrated in FIG. 1F is mounted directly on the slide illustrated in FIGS. 11A-C.

Referring to FIG. 12, an optic guard 1200 is shown installed in the optic guard mount 1170. The optic guard 1200 includes an integrated bracket 1201 with a first side to mate with the optic guard mount 1170. In this example, a frame 1205 is integrally formed with the bracket 1201, but in other examples the bracket 1201 may have a second opposite side to receive the frame 1205 and the frame 1205 may be attached (e.g., welded, removably attached, or the like) to the second side of the bracket 1201. In this embodiment, the frame 1205 protects a lens of the RMR optic 154, and a body (such as a housing) of the RMR optic 154 (e.g., the body on the optic mounting platform 1153). The frame 1205 may protect the top and sides of the body of the RMR optic 154.

In this embodiment, the bracket 1201 couples to a firearm assembly independently of the body of the RMR optic 154. In the present embodiment, the bracket 1201 couples directly to a firearm. In another embodiment, the bracket 1201 (or any other optic guard bracket described herein) may couple to the firearm assembly by piggyback-mounting to an optic that is mounted on the firearm. For example, the firearm assembly may include a long range optic mounted on the firearm and a short range optic mounted on the long range optic, the bracket 1201 may couple to an optic guard mount defined by a component of the long range optic.

In this embodiment, the optic guard 1200 is arranged to couple to the firearm assembly without contacting the optic and without contacting the body thereof (e.g., in this embodiment —without contacting any part of the RMR optic 154). A gap between a back of the frame 1205 and the body of the RMR optic 154 is shown. The gap also prevents impact to the optic guard 1200 from transferring energy to the RMR optic 154—reducing risk of damage to the optic (and also maintaining zero of the sight alignment).

The RMR optic 154 may be sighted in at a time of installation of the optic guard 1200. The arrangement of the optic guard mount 1170 may provide for installation without any contact between the optic guard 1200 and, in this example, any part of the RMR optic 154. For instance, the dovetail groove embodiment of the optic guard mount 1170 allows the optic guard 1200 to be side-installed to maintain zero of the slight alignment of the firearm assembly (no contact with RMR optic 154 during installation).

In the illustrated embodiment, the frame 1205 is fully-enclosed—it includes a top frame segment, a bottom frame segment, and side frame segments (e.g., four sided). In other examples, a frame of on optics guard may have a fewer or greater number of sides (such as a ring shape) and/or be fully and/or substantially enclosed to protect a top and sides of a body of an optic.

A front of at least one frame segment of the frame segments may include indentations/bumps forming another grip location for charging the slide (the indentations/bumps may also be provided on other frame members, such as on a top part of the front of the side frame segments). One embodiment of the frame 1205 is similar to the frame of the optic guard bracket shown in FIG. 15 (in which indentations are provided on the frame members of the optic guard bracket illustrated in FIG. 15). Charging using this grip location may be performed using the palm of the hand, as illustrated in FIG. 14D. Due to the gap and the depth of the frame 1205, charging using this grip location may not smudge the optic (and as already mentioned may maintain zero).

FIG. 13 illustrates a partial side view of an optic guard with an integrated rear sight 1399. This optic guard may be similar in any respect to optic guard 1200 (FIG. 12). In this embodiment, the integrated rear sight 1399 is located on a bottom member of the frame of optic guard 1200. In another embodiment, the integrated rear sight 1399 may be provided on some other part of the optic guard 1200. In some embodiments, the integrated rear sight 1399 may be releasably coupled to the optics guard 1200. The integrated rear sight 1399, and the charging grip points, are usable regardless of whether the firearm is currently provisioned with an optic or not.

Figure 14A:
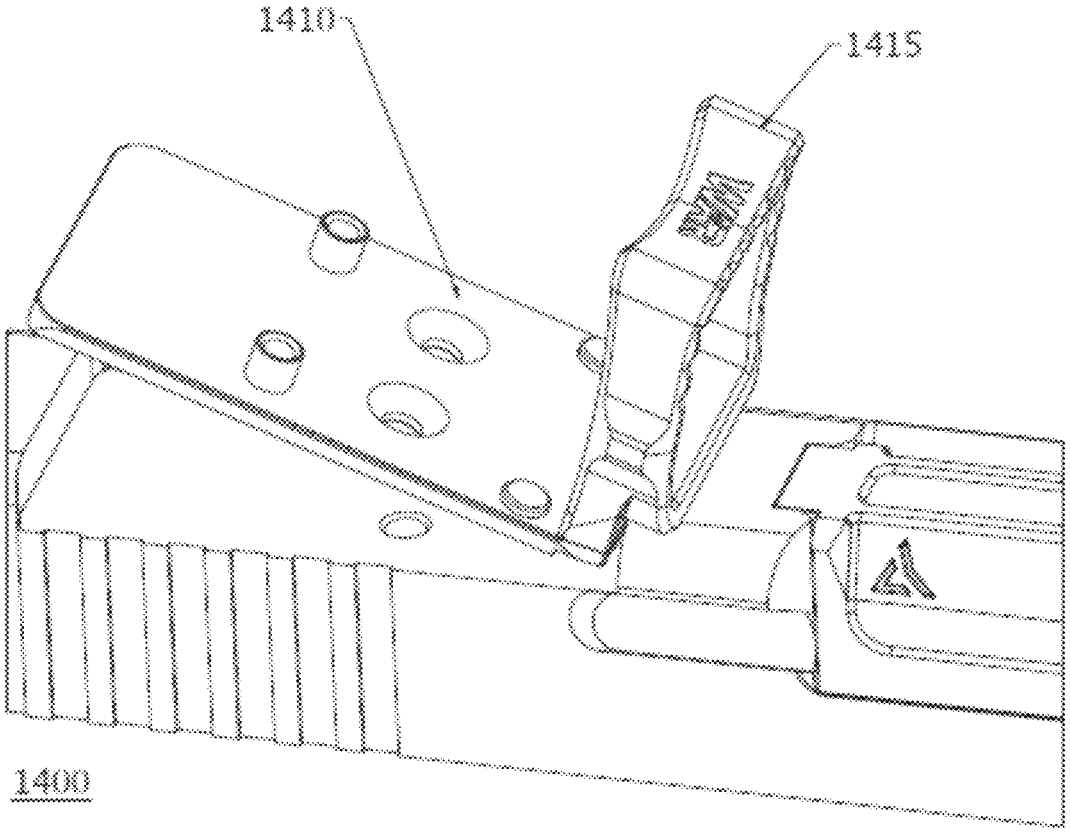
FIG. 14A illustrates a side view of an optic guard usable with the slide and the optic shown in FIG. 1F.
Figure 15:
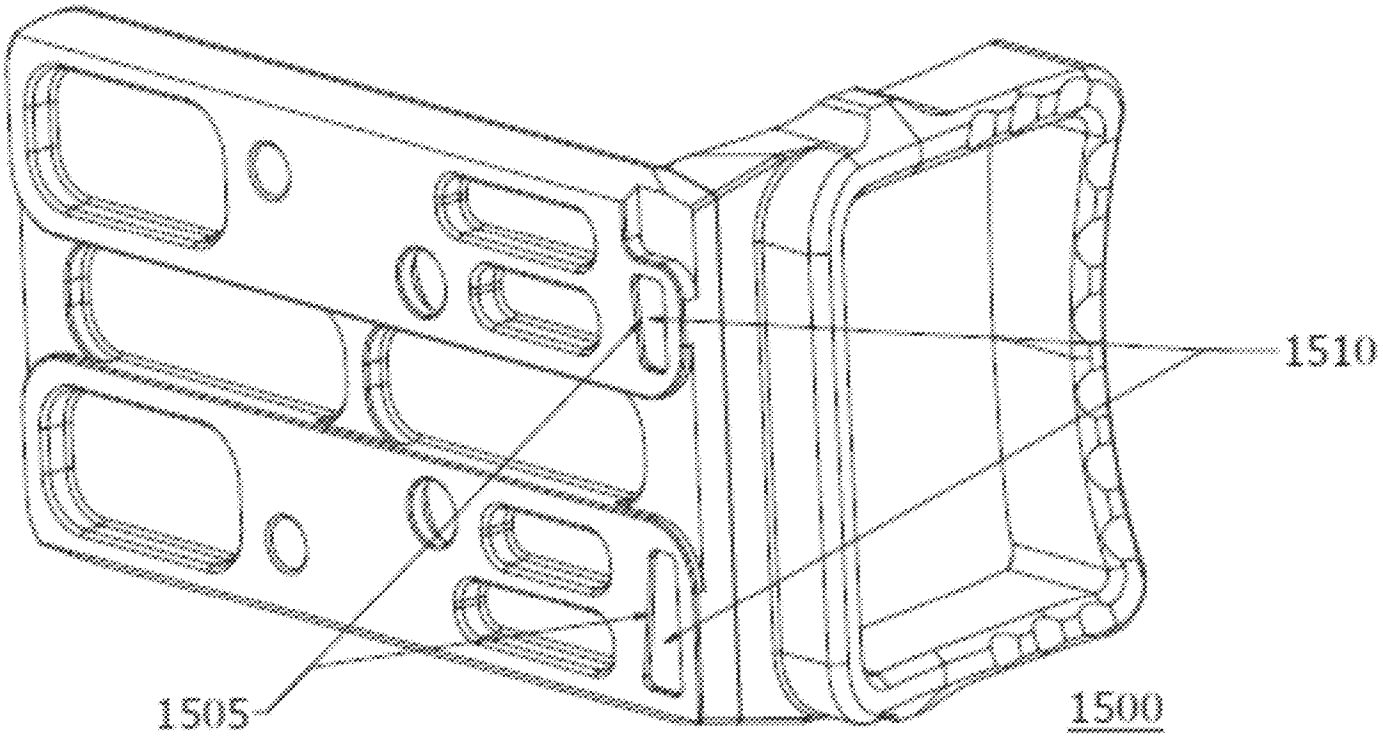
FIG. 15 illustrates an optic guard including a frame welded to a bracket.

FIG. 14A illustrates a side view of an optic guard 1400 usable with the slide 100 and the RMR optic 154 shown in FIG. 1F. This optic guard 1400 includes a frame 1415 (which may be similar in any respect to the frame 1205 of FIG. 12). The frame 1415 is fixably attached to a front of a bracket 1410. Fixable attachment may be welding one or more protrusions on the front of the bracket 1410 or the frame 1415 into mating openings formed on the other of the front of the bracket 1410 and the frame 1415 (e.g., non-releasably attached). FIG. 15 illustrates another embodiment of an optic guard 1500 usable on a legacy slide in which the optic guard 1500 has a fully-enclosed frame fixably attached to a bracket in which the front-most openings 1505 on the bottom of the front of the bracket expose protrusions 1510 extending from the bottom of the frame.

Referring again to FIG. 14A, in this embodiment the bracket 1410 is a plate. However, in other embodiments, a bracket need not be a plate (this is shown in FIG. 15, in which the bracket has a front section that is thicker than a rear section of the bracket).

Figure 14B:
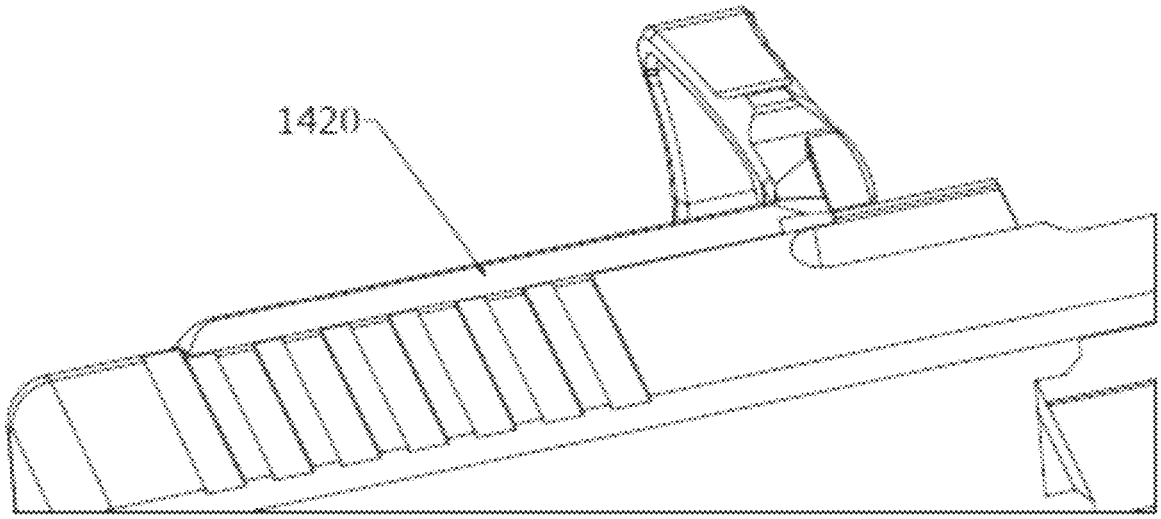
FIG. 14B illustrates a partial side view of a firearm including the optic guard of FIG. 14A installed thereon.

Referring again to FIG. 14A, a surface of the top side of the bracket 1410 may be similar in any respect to the surface of the mounting platform 1153 (FIG. 11A). The bottom side of the bracket 1410 may be smaller than the top side, and may similar to the bottom of the MOS adapter plate 151 (FIG. 1C). FIG. 14B illustrates that the sides 1420 of the bracket 1410 may be sloped, although this is not required.

Figure 14C:
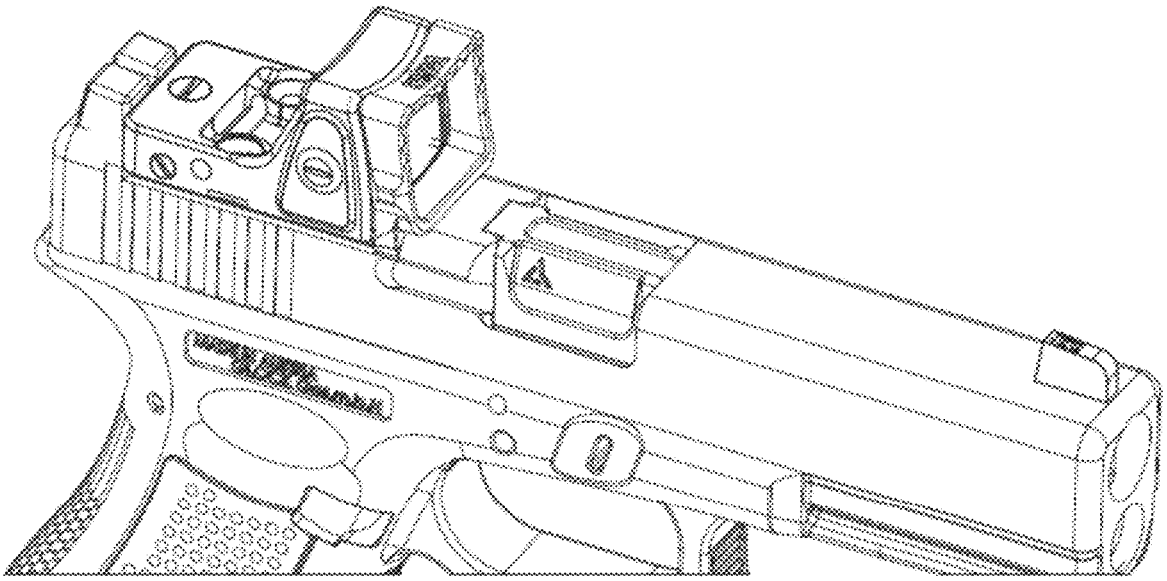
FIG. 14C illustrates a partial side view of a firearm including the optic guard of FIG. 14A with the RMR optic illustrated in FIG. 1F installed thereon.
Figure 14D:
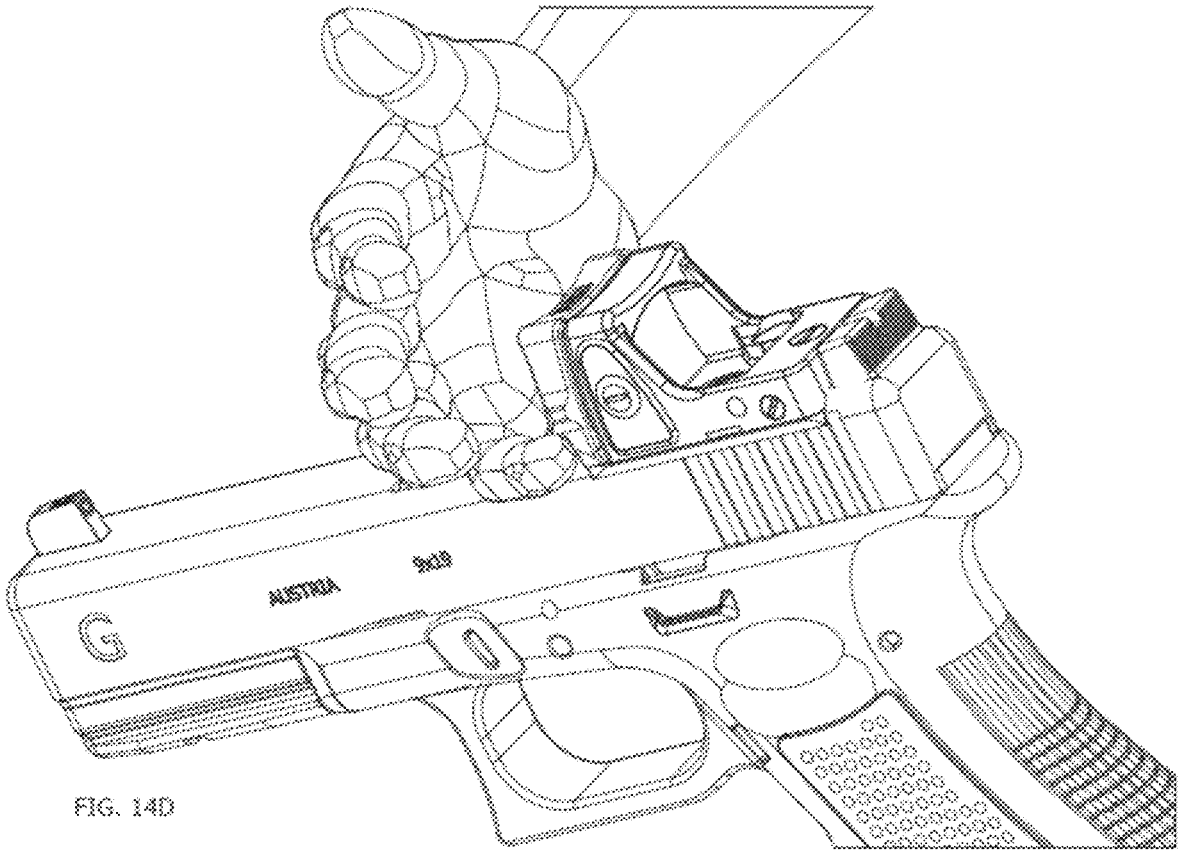
FIG. 14D illustrates charging a slide using a grip location provided on an optic guard.

FIG. 14C illustrates a partial side view of a firearm including the optic guard 1400 (FIG. 14A) with the RMR optic 154 (FIG. 1F) installed thereon. The gap between the back of the frame of the optic guard 1400 and the front of the body of the RMR optic 154 may be the same as the gap described with respect to FIG. 12.

FIG. 14D illustrates charging a slide using a grip location provided on an optic guard. Charging may be accomplished without bumping the RMR optic 154 and without smudging the optic thereof. This charging grip point does not require the use of fingers/thumb (the scalloped grip on the side of the slide 100 of FIG. 1A is gripped using a finger and thumb). This charging grip point may be gripped using the palm instead, allowing the slide to be optimally charged (e.g., charged without smudging the optic and/or without bumping the RMR optic 154)—even in the case of an injury to the finger or thumb.

Referring again to FIG. 15, this optic guard 1500 with integrated bracket may be utilized with a different legacy slide than the legacy slide 100 of FIG. 1A. The underside of the bracket is arranged for attaching to a top exterior surface of the legacy slide. The top surface of the bracket (not shown) may be similar in any respect to the top surface of the mounting platform 1153 (FIG. 11A).

Having described and illustrated various examples herein, it should be apparent that other examples may be modified in arrangement and detail, e.g.:

Any slide assembly described herein may be arranged to include any optic mounting platform described herein and/or arranged to include any optic guard mount described herein, according to various embodiments.

Any slide assembly described herein may be arranged to include any alignment system described herein, according to various embodiments. Any slide assembly described herein may be arranged to retrofit a firearm having a slide assembly or may be part of original equipment of a firearm, according to various embodiments.

The optic guards and the optic guard brackets described herein may be arranged to interoperate with any slide assembly described herein, or some other slide assembly currently known or later developed, according to various embodiments.

Compensator System with Mounted Gas Port Device

Known compensators may thread onto an end of a barrel. These compensators may be arranged to receive gas exiting a muzzle of a barrel, such as from the muzzle 2 of the barrel 105 of FIG. 1A. These compensators provide gas recoil by redirecting a portion of the received gas from the muzzle 2 in a particular direction.

Figure 17A:
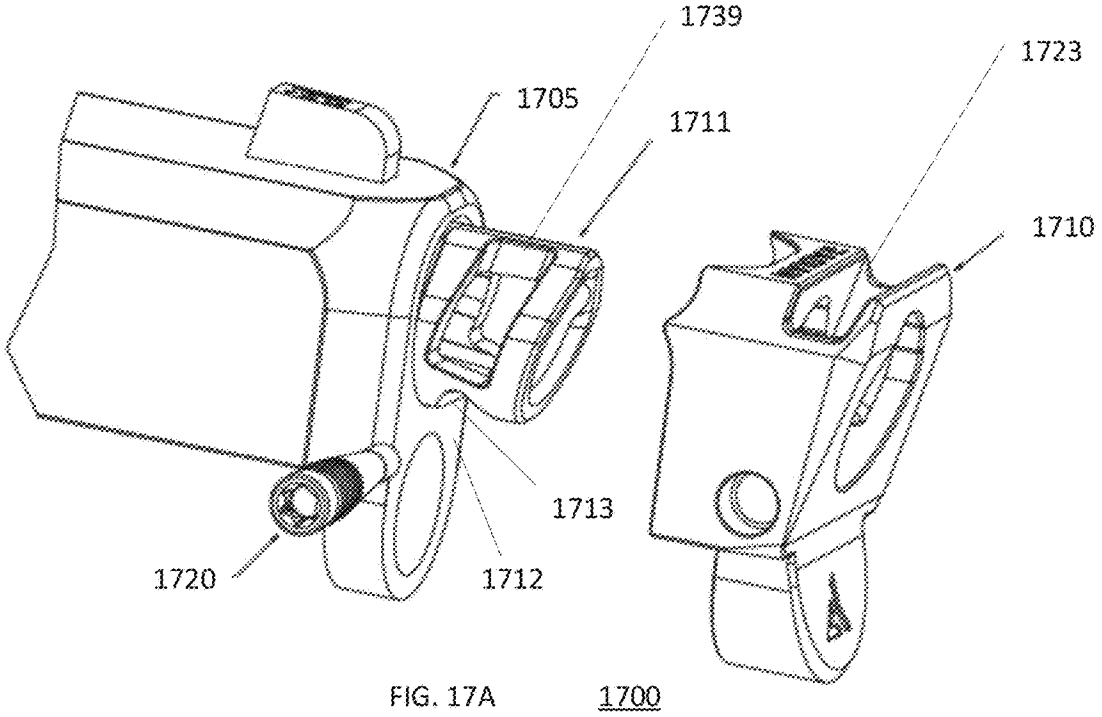
FIGS. 17A and 17B show an exploded view and an isometric view, respectively, of a compensator system.
Figure 17B:
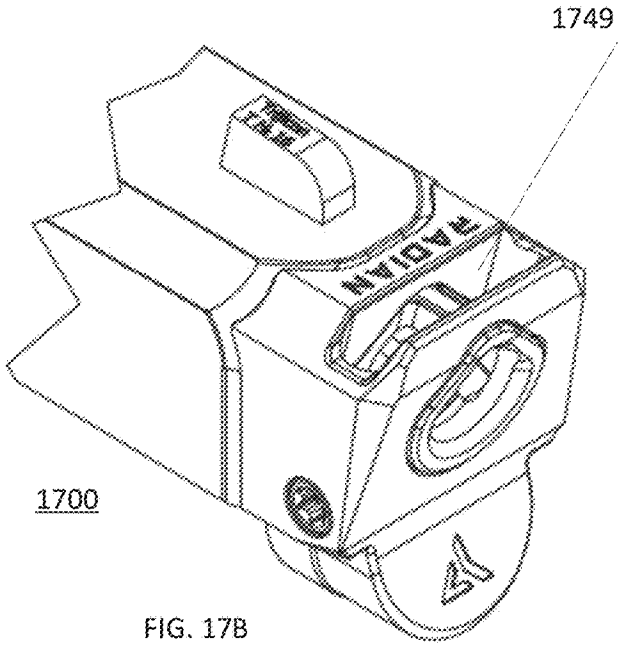

FIGS. 17A and 17B show an exploded view and an isometric view, respectively, of a compensator system 1700. In the compensator system 1700, the barrel 1711 may include an egress 1739 that may be similar to barrel egress 39 (FIG. 3) or any other barrel egress described herein. The compensator system 1700 may include a gas port device 1710 with an opening 1723 to expose the egress 1739 when the gas port device 1710 is mounted on a part of the barrel 1711 that protrudes from the slide 1705. The opening 1723 and the egress 1739 may form a gas port 1749 similar in any respect to the gas port 49 (FIG. 4A).

In contrast to compensators that receive all the gas from the muzzle of the barrel, the gas port device 1710 may receive the gas from the egress 1739 of the barrel 1711. The total length of the compensator system 1700 may be shorter than the total length of a barrel and a compensator in which the compensator threads onto the barrel and/or receives all the gas from a muzzle of a barrel.

The slide 1705 may be similar to the slide 100 in any respect. In various embodiments, the slide 1705 may have a front wall 1712 similar to the front wall illustrated in FIG. 1 (the front wall corresponding to the front interior wall 12 of slide 100). The egress 1739 may be located on a part of the barrel 1711 that protrudes from a bore 1713 in the front wall 1712, e.g., interior walls of the gas port 1749 may be different/separate than the front wall 1712 with the bore 1713.

The gas port device 1710 may be mounted to the barrel 1711 using any fasteners or other attachment device now known or later developed. In this example, the gas port device 1710 is mounted to the barrel 1711 using a taper pin 1720, which will be described in more detail later with respect to the description of FIG. 17F.

During the firing cycle, the barrel 1711 may lock up with the slide 1705 in a similar way that barrel 105 (FIG. 1) locks up with slide 100 (FIG. 1). Specifically, the bore 1713 defined by the front wall 1712 may have standard dimensions as a bore on "stock" slide. In the case of a glock-compatible firearm (which allows the muzzle end of the barrel to move upwards with respect to the slide during the firing cycle), the bore 1713 may be an eccentric bore. Due to this, unlike some other compensator assemblies that may not operate with standard-dimensioned slide, the compensator system 1700 is operable with slide 100 or any other slide with a front wall 1712 similar to the front wall of slide 100.

In some embodiments, compensator system 1700 may provide some recoil reduction even when gas port device 1710 is not mounted to the barrel 1711. Specifically, even when the firearm is fired without the gas port device 1710 attached, the egress 1739 may provide some base amount of recoil reduction (due to the gas venting from the egress 1739 to direct the gas in a direction that reduces recoil).

Figure 17F:
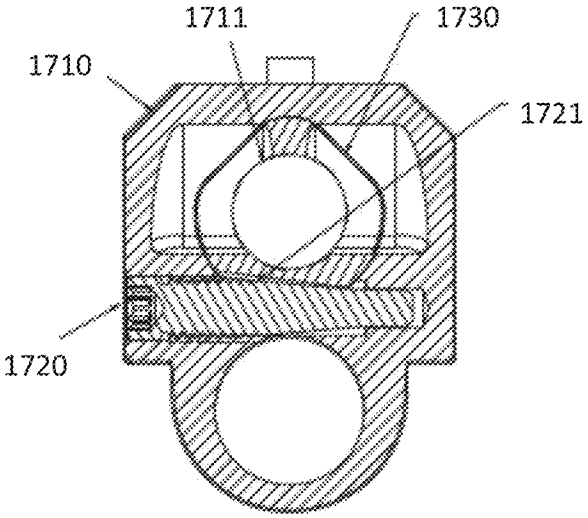
FIG. 17F illustrates a section view of the compensator system taken along section line C of FIG. 17D.
Figure 17G:
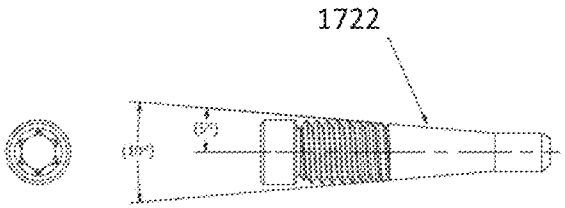
FIG. 17G illustrates the taper pin of FIG. 17F in more detail.
Figure 17E:
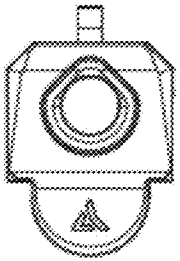
FIGS. 17C, 17D, and 17E illustrate a top view, a side view, and a front view, respectively, of the compensator system of FIGS. 17A-B.
Figure 17C:
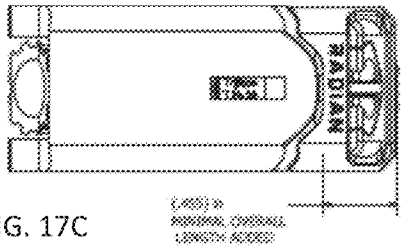
Figure 17D:
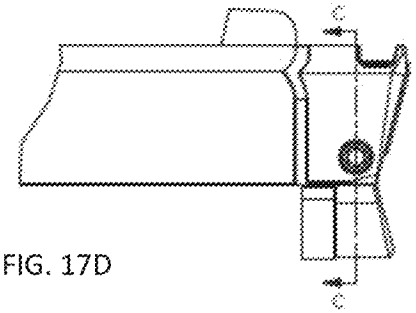

FIGS. 17C, 17D, and 17E illustrate a top view, a side view, and a front view, respectively, of the compensator system 1700. FIG. 17F illustrates a section view of the compensator system 1700 taken along section line C. The taper pin 1720 may interface with a taper interface 1721 provided on a bottom of the barrel 1711 (FIG. 17A). FIG. 17G illustrates the taper pin 1720 in more detail. In this example, it includes a taper lock interface 1722 along part of its length (another part of the length includes threads as illustrated).

Figure 18A:
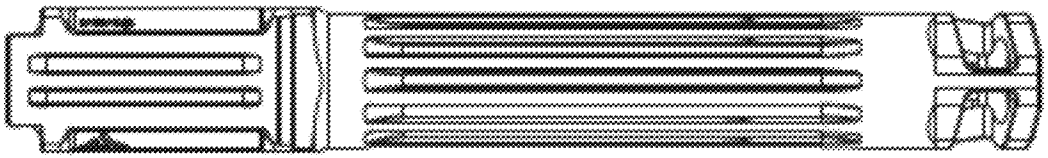
FIGS. 18A and 18B illustrate a top view and a side view of the barrel of FIG. 17A.
Figure 18B:
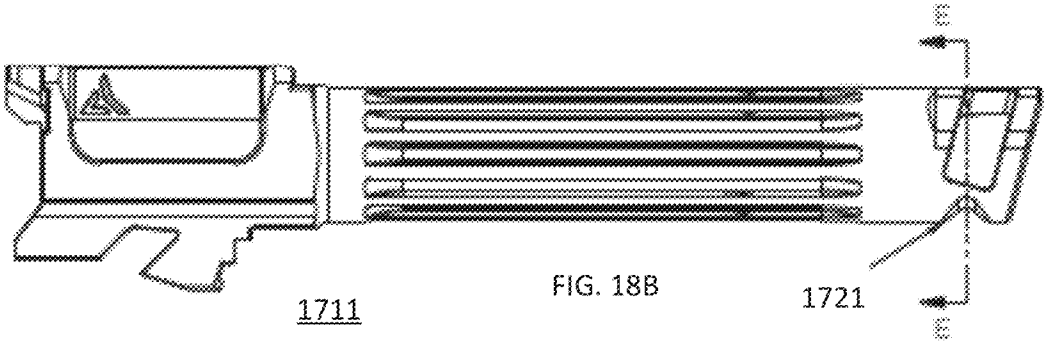
Figure 18C:
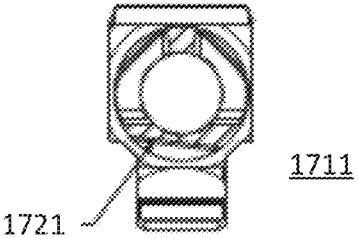
FIG. 18C illustrates a section view of the barrel of FIGS. 18A-B, taken along section line E.

The taper interface 1721 is shown in more detail in FIGS. 18A-C. FIGS. 18A and 18B illustrate a top view and a side view, respectively, of the barrel 1711. FIG. 18C illustrates a section view of the barrel 1711 (taken along section line E). In this example, the taper interface 1721 is a tapered "V" slot 1721. In other examples, a different slot may be provided, such as a rounded slot.

Figure 19:
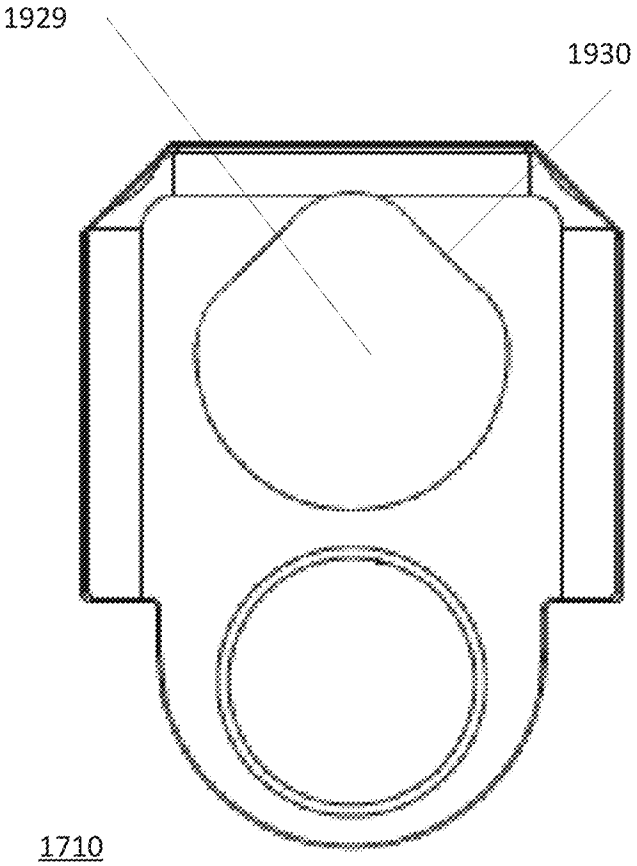
FIG. 19 illustrates a rear view of the gas port device of FIG. 17A.

Referring again to FIG. 17F, the part of the barrel 1711 on which the gas port device 1710 (FIG. 17A) is mounted may include indexing flats 1730 to mate with a corresponding indexing flats of the gas port device 1710. FIG. 19 illustrates a rear view of the gas port device 1710, which shows an opening 1929 in the gas port device 1710. The opening 1929 defines indexing flats 1930 to mate with the indexing flats 1730 (FIG. 17F). Referring again to FIG. 17F, when the taper pin 1720 is tightened (e.g., using a wrench tool in this example), the taper lock interface 1722 (FIG. 17G) contacts the corresponding taper interface 1721 of the bottom of the barrel 1711. In this example, the taper pin 1720 includes threading to interface with an internal thread in the gas port device 1710; however, this is not required. In other examples, a taper pin may not include threads—it could be driven into the hole in the gas port device 1710 to lockup with the taper lock interface 1721 provided in the bottom of the barrel 1711.

The location of the indexing flats of the barrel (and the indexing flats of the barrel) may be on any position around the barrel, such as either side the barrel, the top of the barrel, the bottom of the barrel, or any other orientation between those. In other examples, some other indexing face may be used that is different than the illustrated indexing flats (a curved profile, etc.) In this example, the timing system includes plural indexing faces, but in other examples it may possible and practical to use a single indexing face on the barrel 1711 and on the gas port device 1710.

Referring again to FIG. 17G, in this example the taper pin 1720 includes four sections: a threaded section, a tapered section, and a straight section proximate to each end. As the taper pin starts to engage the taper interface 1721 (FIG. 17F) the straight sections may prevent the taper pin 1720 from being urged away from the barrel 1711 (FIG. 17F). Specifically, the gas port device 1710 may be arranged with a hole of a corresponding diameter that the small diameter straight section fits into and a counter bore with a corresponding diameter that the large diameter straight section fits into (this can be seen in FIG. 17F). The taper pin 1720 may be held into place on both sides of the taper lock interface 1722 by these straight sections to keep either end of the taper pin 1720 from moving away from the barrel.

Figure 24B:
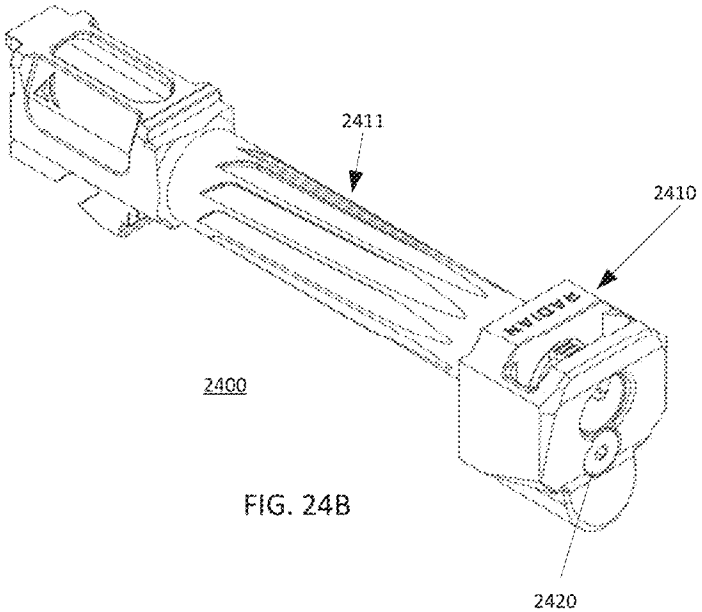
FIGS. 24A-D show an exploded view, an isometric view, a front view, and a cross-sectional side view of another compensator system with a threaded barrel.
Figure 24A:
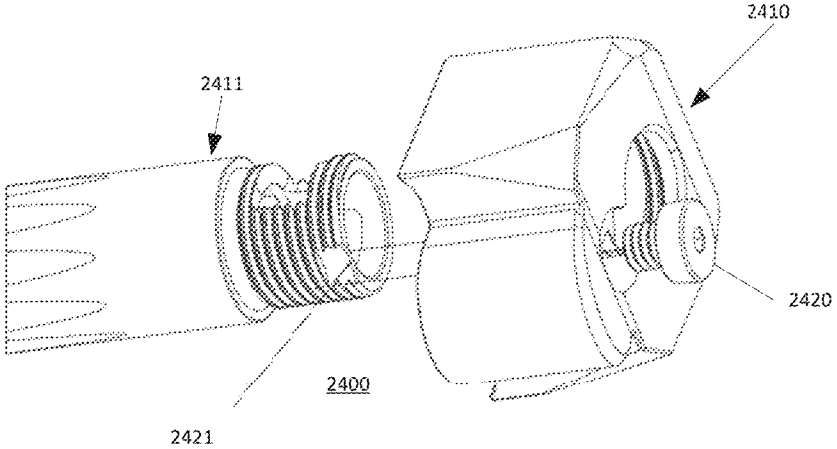

In other embodiments, the taper pin may not require the straight sections proximate to each end. FIG. 24A-C illustrate an example without these straight sections proximate to each end of the taper pin 2420. A taper pin may include a single continuous taper with a first region having a taper lock interface to contact a taper interface of a barrel and a second region to contact the barrel-mountable accessory. In other embodiments, a taper pin may have two distinct sections—a tapered first section to contact a taper interface of a barrel and a second non-tapered (or differently tapered) section to contact the barrel-mountable accessory (this is illustrated in the embodiment of FIGS. 24A-D—in this example a tapered section is between the a threaded section and the driving end of the taper pin 2420).

Figure 20B:
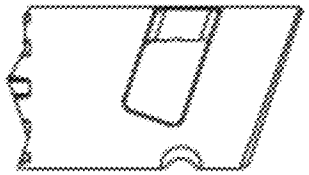
FIG. 20B is a detail K of FIG. 20A.
Figure 20A:
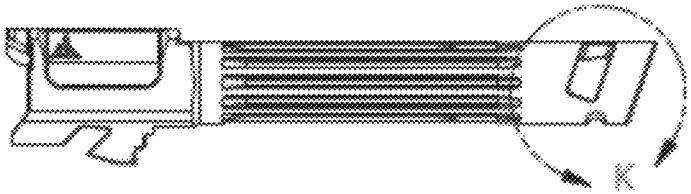
FIG. 20A illustrates a barrel that may be similar in any respect to the barrel of FIG. 17A.

FIG. 20A illustrates a barrel 2011 that may be similar in any respect to barrel 1711 (FIGS. 18A-B). FIG. 20B is a detail K showing an interface with a round taper profile (instead of a tapered "V" slot). An interface on a bottom of the barrel may have a V profile, a round profile, or any other profile, according to various embodiments. The location of the interface of the barrel (and the taper lock interface) may be on any position around the barrel, such as either side the barrel, the top of the barrel, the bottom of the barrel, or any other orientation between those.

Figure 21B:
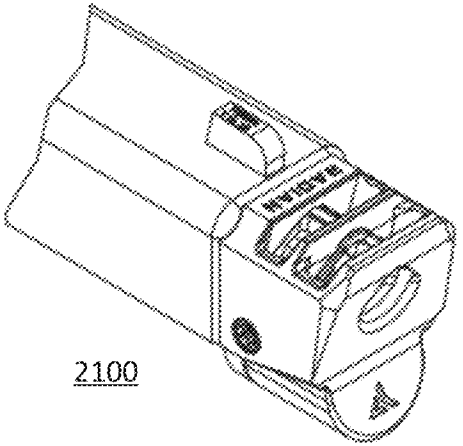
FIGS. 21A, 21B, 21C, and 21D show an exploded view, an isometric view, a top view, and a side view, respectively, of another compensator system.
Figure 21A:
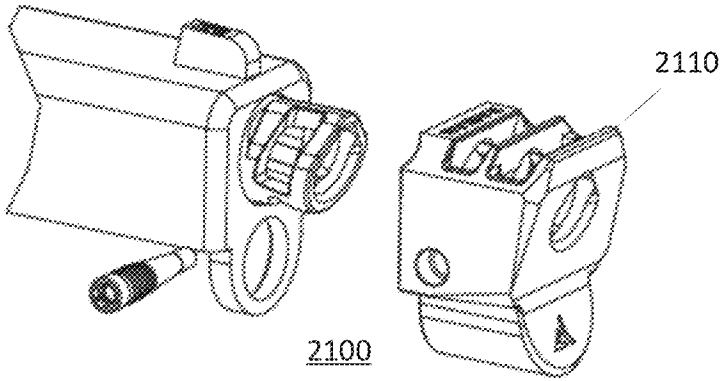
Figure 21C:
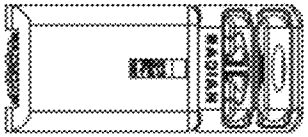
Figure 21E:
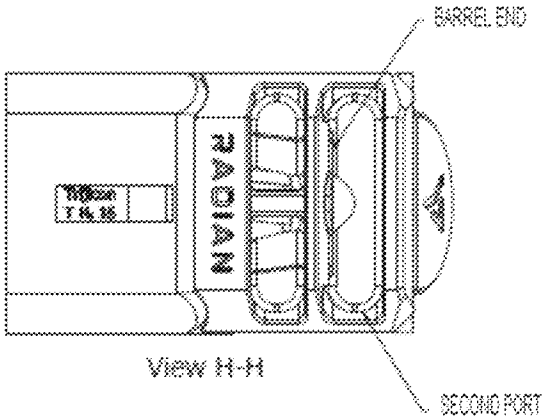
FIG. 21E shows a view taken from line H of FIG. 21D.

FIGS. 21A, 21B, 21C, and 21D show an exploded view, an isometric view, a top view, and a side view, respectively, of another compensator system 2100 utilizing a dual-ported gas port device 2110. All other components of the compensator system 2100 may be the same as the compensator system 1700 (FIG. 17A). FIG. 21E shows a view taken from the perspective of the arrows of line H of FIG. 21D.

Figure 21F:
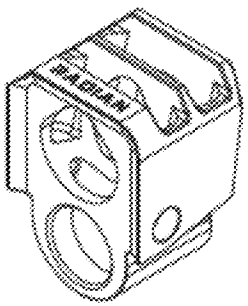
FIG. 21F shows an isometric view of the slide-facing side of the gas port device of FIG. 21A.
Figure 21D:
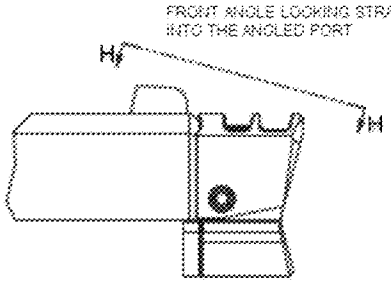

Gas port device 2110 may receive gas from a barrel egress similar to gas port device 1710 (FIG. 17A), but also may receive additional gas from the muzzle of the barrel. Accordingly, gas port device 2110 may provide additional recoil reduction. A user may interchangeably mount gas port devices 1710 and 2110 on a same barrel (or run with no gas port device attached for base recoil reduction), depending on a desired amount of recoil reduction. FIG. 21F shows an isometric view of the slide-facing side of gas port device 2110.

Figure 22B:
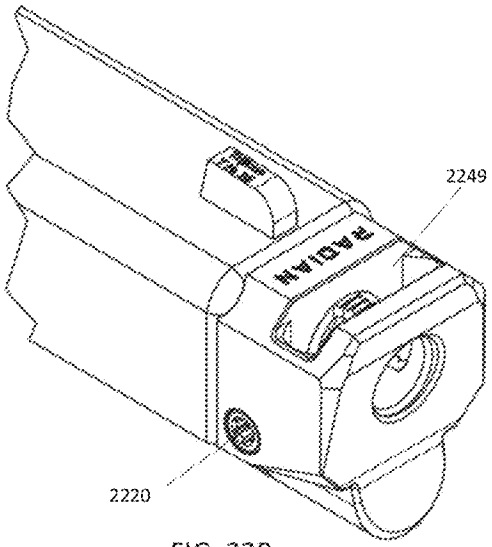
Figure 22E:
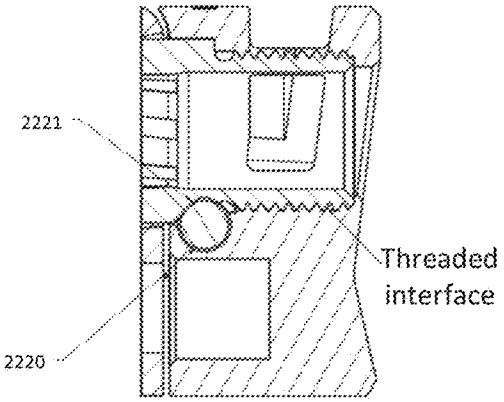

Although the various above-described embodiments of a compensator system with mounted gas port device feature a non-threaded barrel, it should be appreciated that any of the features included in those compensator systems may be utilized in a compensator system with a threaded barrel. FIGS. 22A-24E illustrate examples in which threaded barrels are used. FIGS. 22A, 22B, 22C, 22D, and 22E show an exploded view, an isometric view, a top view, and a front view, and a cross-sectional side view, respectively, of another compensator system 2200 with a threaded barrel 2211. FIG. 23 shows a side view of a threaded barrel-mounted accessory 2305 installed on the threaded barrel 2211 of the compensator system 2200 of FIGS. 22A-E. FIGS. 24A-D show an exploded view, an isometric view, a front view, and a cross-sectional side view of another compensator system 2400 with a threaded barrel 2411.

Figure 22A:
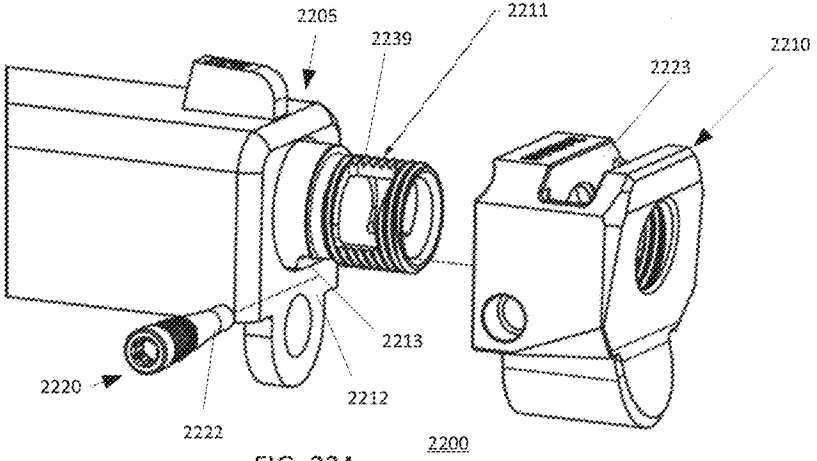
Figure 22D:
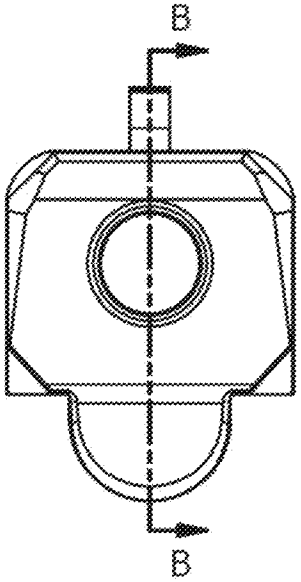
Figure 22C:
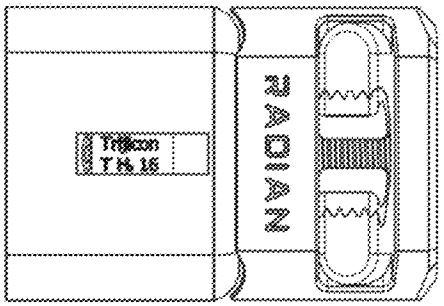
Figure 23:
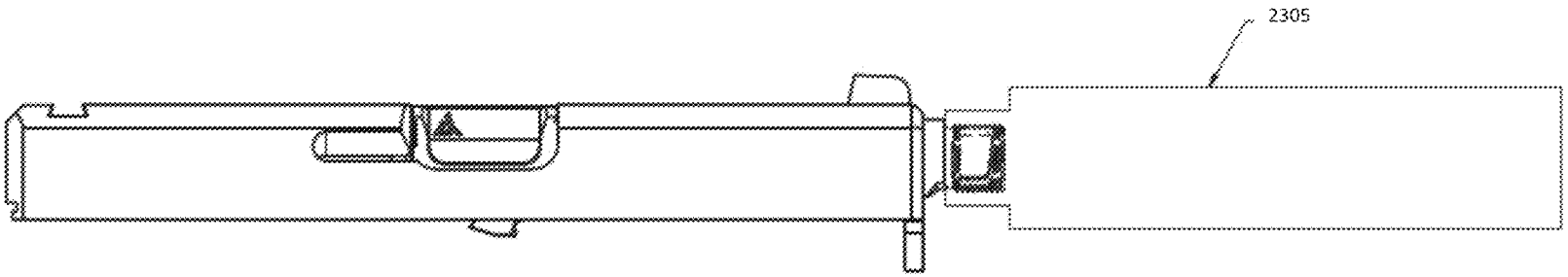
FIG. 23 shows a side view of a threaded barrel-mounted accessory installed on the threaded barrel of the compensator system of FIGS. 22A-E.

Referring to FIG. 22A, in the compensator system 2200, the barrel 2211 may include an egress 2239 that may be similar to barrel egress 39 (FIG. 3) or any other barrel egress described herein. The compensator system 2200 may include a gas port device 2210 with an opening 2223 to expose the egress 2239 when the gas port device 2210 is mounted on a part of the barrel 2211 that protrudes from the slide 2205. The opening 2223 and the egress 2239 may form a gas port 2249 similar in any respect to the gas port 49 (FIG. 4A).

In contrast to compensators that receive all the gas from the muzzle of the barrel, the gas port device 2210 may receive the gas from the egress 2239 of the barrel 2211. The total length of the compensator system 2200 may be shorter than the total length of a barrel and a compensator in which the compensator threads onto the barrel to receive all the gas from the muzzle of a barrel.

The slide 2205 may be similar to the slide 100 in any respect. In various embodiments, the slide 2205 may have a front wall 2212 similar to the front wall illustrated in FIG. 1 (the front wall corresponding to the front interior wall 12 of slide 100). The egress 2239 may be located on a part of the barrel 2211 that protrudes from a bore 2213 in the front wall 2212, e.g., interior walls of the gas port 2249 (FIG. 22B) may be different/separate than the front wall 2212 with the bore 2213.

In this embodiment, the part of the barrel 2211 that protrudes from the bore 2213 in the front wall 2212 is threaded. The gas port device 2210 (which has corresponding threading to mate with the threading on the part of the barrel 2211) may be mounted to the barrel 2211 using this threading and the taper pin 2220, which may be similar in any respect to the taper pin 1720 described with respect to FIG. 17F.

Referring now to FIG. 22E, when the taper pin 2220 is tightened (e.g., using a wrench tool in this example), the taper locker interface 2222 (FIG. 22A) contacts the corresponding taper interface 2221 of the bottom of the barrel 2211. In this example, the taper pin 2220 includes threading to interface with an internal thread of the gas port device 2210; however, this is not required. In other examples, a taper pin may not include threads—it could be driven into the hole in the gas port device 2210 to lockup with the taper lock interface 2221 in the bottom of the barrel 2211.

Referring now to FIG. 23, a different barrel-mounted accessory may be mounted to the barrel 2211 (in place of the gas port device 2210 and the taper pin 2220). In this example, a known suppressor 2305 is shown. The threading on the barrel 2211 (FIG. 22A) may be arranged to mate with threading on the known suppressor 2305. The taper lock interface 2221 (FIG. 22E) may not contact the threading on the known suppressor 2305. In this way, the barrel 2211 (FIG. 22A) with the taper lock interface 2221 can be used with any known barrel-mounted accessories that are not arranged with taper lock interface features.

Referring again to FIG. 22E, it should be appreciated that the location of the taper interface 2221 on the barrel 2211 (FIG. 22A) may be variously located at any position on the barrel 2211. In some examples, the taper interface 2221 may be located on the side of the barrel 2211, instead on the bottom of the barrel 2211, for instance.

Additionally, although the taper pin 2220 (FIG. 22A) is side-mounted (e.g., arranged perpendicular to the barrel 2211) in this embodiment, other mountings of a taper pin are possible and practical. FIGS. 24A-D illustrated embodiment of a compensator system 2400 that may be similar in any respect to compensator system 2200 (or any other compensator system described herein) with a differently-oriented taper pin 2420 (e.g., not side-mounted and not perpendicular to the barrel 2411—this taper pin 2420 is mounted parallel to the barrel 2411 from the front end of the barrel 2411). Besides the different taper interface 2421, the barrel 2411 may otherwise be similar to the barrel 2211 (FIG. 22A) in any respect.

The taper interface 2421 in this example is a notch sloping downwardly looking from the front of the barrel (in contrast to the taper interface 2221 that is side sloping looking from the front of the barrel). The use of the notch on the taper interface 2421 (or any other taper interface described herein) is not required. In other examples, the taper interface 2421 may have a groove shape (such as a V-groove in which the V-shape can be seen looking from the front of the barrel 2211).

The gas port device 2410 may have an opening on a front end to receive the taper pin 2420 (rather than an opening on a side), but otherwise may be similar to the gas port device 2210 (FIG. 22A). FIG. 24C shows a front view in which the head of the taper pin 2420 is shown below the muzzle end of the barrel 2411.

Figure 24D:
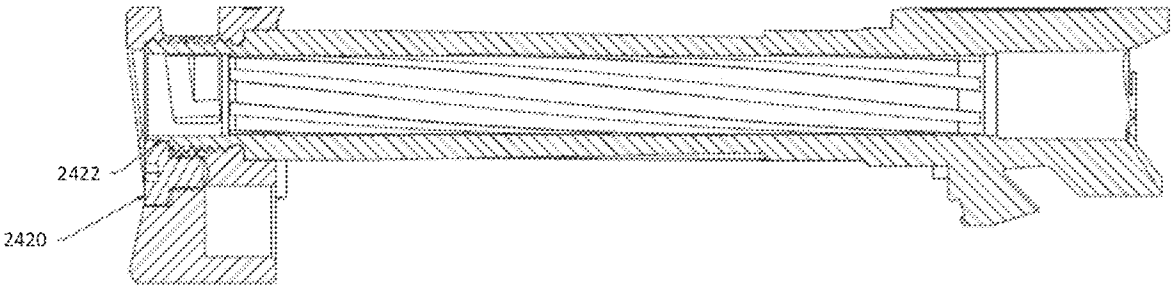
Figure 24C:
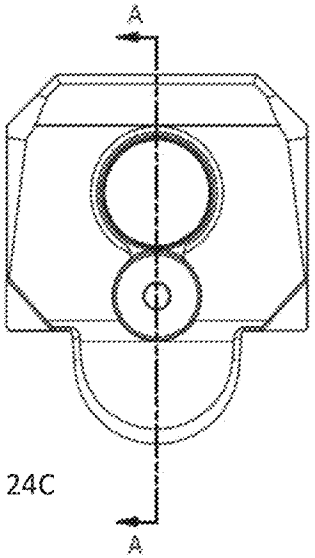

The taper locker interface 2422 of the taper pin 2420 is shown in FIG. 24D. The taper lock interface 2422 contacts the corresponding taper interface 2421 (FIG. 24A) of the bottom of the barrel 2211 (FIG. 24A). FIG. 24D shows that, in this embodiment, the taper lock interface 2422 is behind the threading of the taper pin 2420 (as compared to in front of the threading of the taper pin 2220 of FIG. 22A). The taper pin 2420 is also differently shaped than the taper pin 2220 of FIG. 22A, as illustrated in FIG. 24D.

In any compensator system described herein, the gas port device may include a sight tracker similar to the sight tracker 1699 (FIG. 16A-B). In any compensator system described herein, any barrel interior features described herein may be utilized in the barrel (including the barrel interior features described in reference to FIGS. 7A-9C).

Some embodiments include a retrofit assembly for a firearm, the retrofit assembly to provide the firearm with gas compensation to reduce recoil, the retrofit assembly comprising: a barrel having a muzzle end, a breech end, and a length having a first segment that includes the muzzle end of the barrel and a second segment that includes the breech end of the barrel, wherein an upper region of the first segment of the length of the barrel includes an egress for gas propelled from a chamber of a bore of the barrel; a slide around the second segment of the length of the barrel, wherein the slide has a front wall defining a bore, and wherein the first segment of the length of the barrel protrudes from the bore of the front wall of the slide; and a gas port device mounted to the first segment of the length of the barrel, wherein the gas port device defines an opening to expose the egress of the first segment of the length of the barrel. The firearm may be a Glock compatible firearm, or some other firearm. The bore in the front wall of the slide may be an eccentric bore (in the case of a Glock compatible firearm), or some other circular shape depending on the firearm.

Barrel-Mounted Accessory Taper Lock Interface

Various features of the taper lock interface described with respect to FIG. 17F can be applied to any compensator (or other barrel-mounted accessory), including compensators that receive gas only from a muzzle of a barrel. Known compensators may require a threaded barrel. One problem with a threaded barrel is that a compensator may become loose due to vibrations of repeated firing cycles. One embodiment of a compensator with a taper locker interface includes a compensator mountable to a part of a barrel that protrudes from the front wall of the slide. This barrel may not include the egress 1739 (FIG. 17A) and/or may not be ported. The compensator may be arranged to redirect gas exiting from a muzzle of a barrel.

In this embodiment, the compensator may include a taper lock interface similar to taper interface 1721 of FIG. 17F. The compensator may include a taper pin similar to any taper pin described herein.

In some embodiments, the compensator may also include an opening similar to opening 1929 (FIG. 19), which may define indexing flats (similar to indexing flats 1930) to mate with indexing flats on the protruding part of the barrel; however, this is not required. In other embodiments, the compensator may be arranged to mount onto, say, a round barrel (wherein the barrel does not include indexing flats).

In any embodiment of a compensator with any of the taper lock interface features described with respect to FIG. 17F (e.g., the taper pin and optionally the indexing flats), the taper lock interface may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after re-mounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using a taper lock interface as described herein can be mounted identically in a repeatable fashion, the bore of the compensator can be closer in size to the bore of the barrel. Therefore, the use of the taper lock interface allows further optimization of gas flow for improved recoil reduction compared to compensators that thread onto threaded barrels.

A compensator with a taper lock interface may have a lower region that is shorter than an upper region of the compensator—to mate with a barrel having a sloped muzzle end similar to the sloped muzzle end of the barrel 1711 of FIG. 17A. This is due to the small profile of the taper lock interface on the bottom of the barrel. This may minimize the impact of the compensator increasing the length of the firearm (this wedge profile may allow the firearm to be holstered more easily than firearms with compensators that have a lower region that is the same length as the upper region of the compensator).

In the embodiments described above, the barrel-mounted accessory is a compensator. However, the taper lock interface may be used for any barrel-mounted accessories, including accessories to adapt a barrel to a silencer/suppressor (such as a recoil booster—also known as a Nielsen device) or any other barrel-mounted accessory.

Although the various above-described embodiments of barrel-mounted accessories with taper lock interfaces feature non-threaded barrels, it should be appreciated that any of the features included in those embodiments may be utilized in a firearm assembly or firearm with a threaded barrel. FIGS. 22A-24D illustrate embodiments in which the barrel-mounted accessory is a gas port device, but any of the features described with respect to FIGS. 22A-24D may be used in a threaded barrel without the egress and/or with any barrel-mounted accessories.

In various embodiments described herein, the tapered section of the pin has a conical surface. However, in other embodiments the tapered section of the pin may have non-conical surfaces such as multiple faces (e.g., flat faces or curved faces with vertexes between the faces). The taper interface on the barrel may have one or more corresponding flat or curved faces.

Barrel-Mounted Accessory with Timing System

Various features of the timing system described with reference to FIGS. 17F and 19, e.g., the indexing flats 1730 and 1930, may be used in a compensator (or some other barrel-mounted accessory) with any attachment interface that is now known or later developed (e.g. not limited to the taper lock interface). For instance, the bottom of the compensator (e.g., an apex of the bottom of the compensator) may have a threaded hole to receive a threaded screw. When the screw is tightened, the indexing flats are pressed together. Other mechanisms for pressing the indexing flats together may be used in other examples.

The indexing flats may precisely time the compensator on the barrel when the compensator is mounted on the barrel. This allows the compensator to be identically mounted to the barrel in a repeatable fashion. If the compensator includes a sight tracker, the sight tracker will maintain zero through removal/reattachment of the compensator on the barrel (a user may not need to re-sight the sight tracker after re-mounting the compensator).

Also, in known compensators, such as threaded compensators that receive gas from the muzzle of the barrel, the bore of the compensator has to be relatively large (compared to the bore of the barrel) so that a bullet cannot hit the compensator when that bullet exits the muzzle. However, this relatively large compensator bore limits the amount of recoil reduction the compensator can provide (because a lower volume of gas can be directed because of the relatively large compensator bore). In contrast, since a compensator using indexing flats as described herein can be mounted identically in a repeatable fashion, the bore of the compensator can be closer in size to the bore of the barrel. Therefore, the use of the indexing flats allows further optimization of gas flow for improved recoil reduction compared to compensators that thread onto threaded barrels.

In the embodiments described above, the barrel-mounted accessory is a compensator with the barrel egress. However, it should be appreciated that the timing system may be used for any barrel-mounted accessories, including compensators without the barrel egress, accessories to adapt a barrel to a silencer/suppressor (such as a recoil booster), or any other barrel-mounted accessory.

In the embodiments described above, the barrel-mounted accessory is a compensator with the barrel egress. However, it should be appreciated that the taper lock interface may be used for any barrel-mounted accessories, including compensators without the barrel egress, accessories to adapt a barrel to a silencer/suppressor (such as a recoil booster), or any other barrel-mounted accessory.

In one embodiment in which the taper lock interface is used with a compensator without a barrel egress, the muzzle end of the barrel may have the same features as barrel 2211 (FIG. 22A)—excluding the egress 2239. This barrel may be compatible with a known threaded compensator that may receive gas from the muzzle end of the barrel, as well as with barrel-mounted accessories having a taper lock interface.

In one embodiment, a barrel-mounted "adapter"—to allow a non-threaded barrel to operate with threaded accessories—is provided. The non-threaded barrel may have the same features as barrel 1711 (FIG. 17A)—excluding the egress 1739. The adapter may have a back and side similar to the back and side of gas port device 1710 (or some other taper lock interface features described herein). The front of the adapter may have a threaded barrel-shaped projection similar to the muzzle end of barrel 2211 (FIG. 22A)—excluding the taper lock interface 1721. Therefore, the adapter with the taper lock interface on its back side may adapt the non-threaded barrel to receive a known threaded barrel-mountable accessory (such as a known threaded suppressor) on the adapter's front side.

In the embodiments illustrated here, the taper lock interface is used for a barrel-mounted accessory on a pistol. However, the taper lock interface may be used for barrel-mounting an accessory (such as a suppressor) to any firearm, including rifles or other long guns.

Adapter Assembly for Firearm Optic

The design of the MOS adapter plate 151 (FIG. 1C) requires very tight tolerances during installation. Users may use any available screw, but these may be too long, and may cause the MOS adapter plate 151 to pull away from the slide 150 (FIG. 1B) once they are tightened down (leaving a gap and/or bending the MOS adapter plate 151). Even when the user acquires the correct screws, there are still issues with alignment and/or catching a chamfered screw tip and/or threading to complete the installation.

Figure 25A:
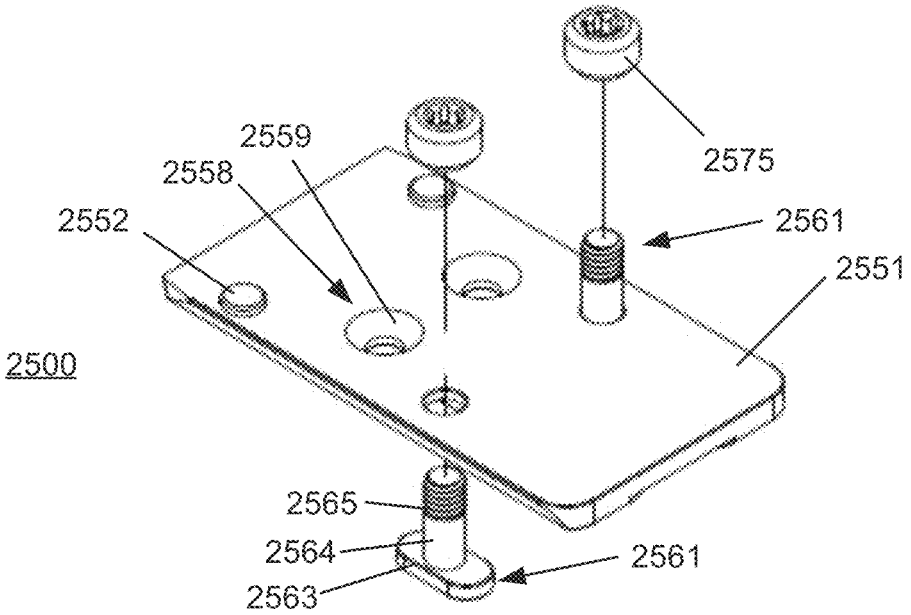
FIG. 25A shows an isometric view showing a top of an adapter assembly for a firearm optic, according to various embodiments.
Figure 25B:
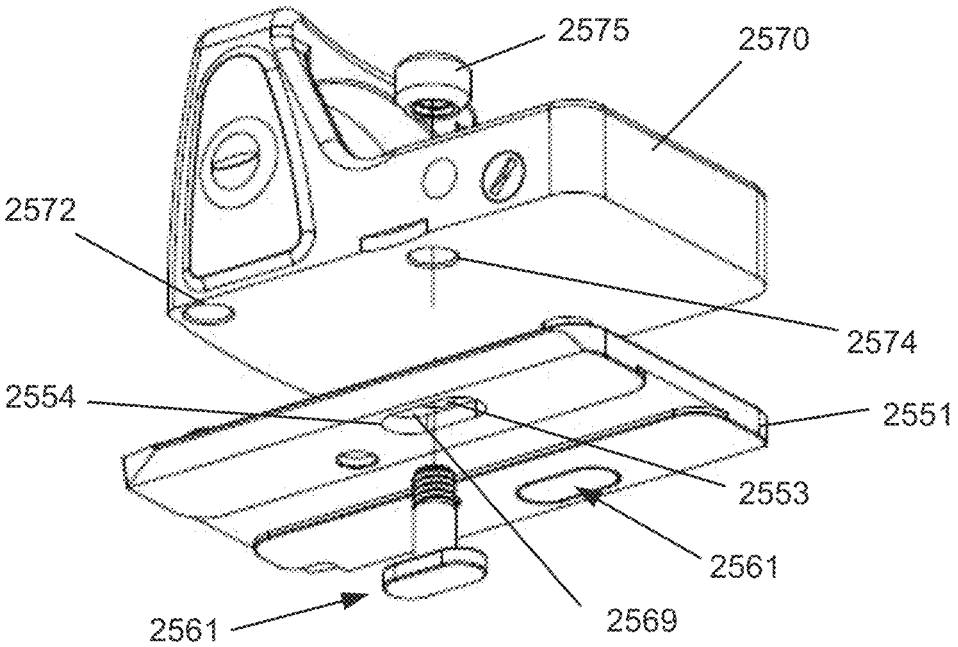
FIG. 25B illustrates an isometric view showing a bottom of the adapter assembly of FIG. 25A.
Figure 25C:
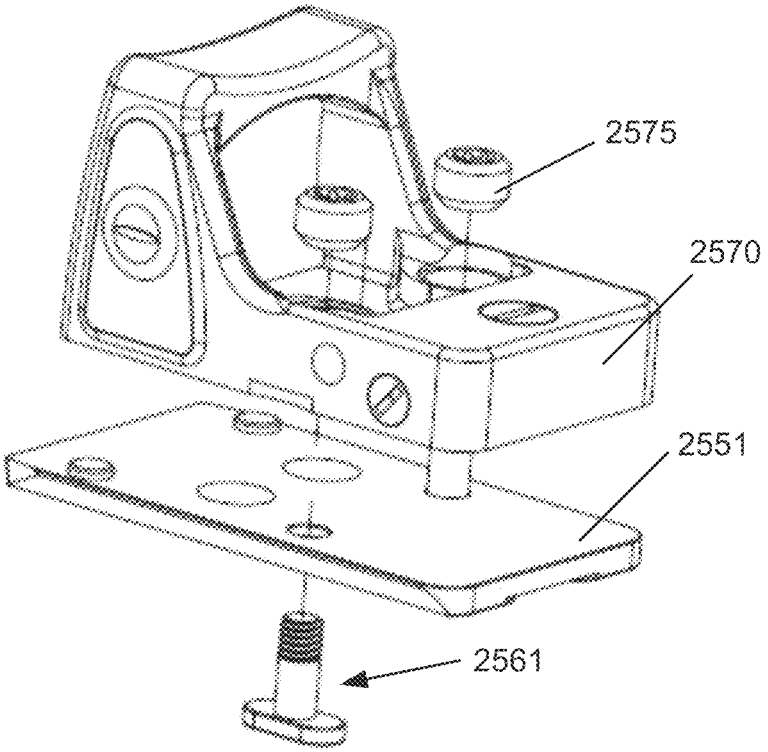
FIG. 25C illustrates an isometric view illustrating how the adapter assembly of FIG. 25A is used with a firearm optic.

FIG. 25A shows an isometric view showing a top of an adapter assembly 2500 for a firearm optic, according to various embodiments. FIG. 25B illustrates an isometric view showing a bottom of the adapter assembly 2500 of FIG. 25A. FIG. 25C illustrates an isometric view illustrating how the adapter assembly 2500 of FIG. 25A is used with the firearm optic 2570.

The illustrated fasteners 2561 (e.g., a bottom-up bolts) include a sheer-resistant section 2564 between the head 2563 and the threading 2565. In this embodiment, the sheer-resistant section 2564 has a diameter that is different than a diameter of the threading 2565 (e.g., greater than a minor diameter of the threading 2565).

In this embodiment, the sheer-resistant section 2564 a single part (monolithic, not interconnected parts) that is solid and extending from at least the top surface of the bracket 2551 to a top of the firearm optic 2570. Although this column may be cylindrically shaped as shown (with a circular cross section and corresponding sidewall), in other embodiments a solid column may have faceted sidewalls (and have a hexagonal cross section, a square section, or some other cross section).

The sheer-resistant section 2564 may also be threadless. This may prevent sheer forces generated by operational forces (e.g., firing, or gripping the firearm optic 2570 to charge the firearm), or other forces such as an impact to the firearm optic or a guard thereof, from damaging and/or wearing the adapter assembly 2500. This may also simplify release and re-attachment of the firearm optic 2570 or the adapter assembly 2500 from the firearm without premature wearing of the adapter assembly 2500.

In this embodiment, the fasteners 2561 are bottom-up bolts and the sheer-resistant section 2564 is a shank of the bottom-up bolts. A bolt, of course, is a fastener with threads and a nut, in which the fastener does not hold itself into a material and relies on the nut to provide holding tension. In contrast, a screw, of course, holds into the material by being tightened into its hole. The use of a screw to couple an adapter assembly to a firearm may require tight tolerances to sufficiently tighten the screws into their holes without damaging the adapter assembly (e.g., bending the adapter) or without leaving any gap between a bottom of a firearm optic and a top surface of the adapter.

A bottom of the bracket 2551 includes pockets 2554 arranged to mate with the heads 2563 of the fasteners 2561. FIG. 25B illustrates a continuous surface formed from the flat of the head 2563 and the bottom surface of the bracket 2551, due to the mating fit. The pockets 2554 may be keyed to fix a rotational position of the fasteners 2561 when the heads 2563 are in the pockets 2554. In other embodiments, some other part of the fastener 2561 may be keyed to prevent rotation of the fastener 2561 (for example, a faceted shank could be used, in one embodiment).

A through opening 2553 extends from a bottom 2569 of the pocket 2554 to the top side of the bracket 2551. In this embodiment, the through opening 2253 receives part of shank 2564, but in other examples the through opening 2253 may receive a different part of the fastener 2561 (this will be discussed later in greater detail with respect to the fastener 2961 of FIG. 29C).

The top side of the bracket 2551 includes fastener openings 2558 to receive a fastener (not shown) that secures the bracket 2551 to a firearm assembly (not shown, e.g. slide 150, FIG. 1B). These fasteners (not shown) may be any fastener, now known (such as a screw) or later developed. The fastener openings 2558 include counter openings 2559 (e.g., counter sinks or counter bores) for the fasteners that secure the bracket 2551 to the firearm assembly.

Unlike the adapter plate 151 (FIG. 1C) in which all the fastener heads are on a same side of the adapter plate 151, the heads 2563 of fasteners 2561 are located on a different side of the bracket 2551 as the heads of the fasteners (not shown) for attaching the bracket 2551 to the firearm assembly (e.g., any slide described herein). Nevertheless, this design may still be backward compatible with known slides (e.g., slide 150, FIG. 1B), and known firearm optics (e.g., RMR optic 154, FIG. 1F). Installation may be by first fastening the bracket 2551 to the slide (in which the heads of fasteners 2561 are sandwiched between the slide and the bottom of the bracket 2551, in the pocket 2569). Once the bracket 2551 is fastened to the slide with these bolts 2561 upright, the firearm optic 2570 may be mounted on the fasteners 2561 and tightened down using nuts 2575 (e.g., the tapered torx nuts illustrated in FIG. 25A-C).

The bracket 2551 may also include registration pins 2552 to mate with registration holes 2572 on the bottom of the firearm optic 2570. In this embodiment, the registration pins 2552 are integrally formed on the bracket 2551, but in other examples registration pins may be separate parts that are fixably attached to the top side of the bracket 2551.

Figure 26A:
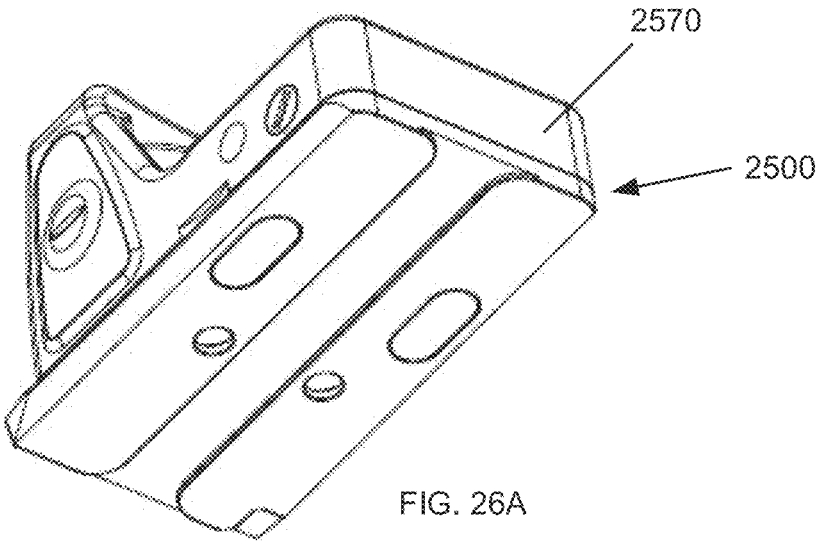
FIG. 26A illustrates an isometric view showing a bottom of the adapter assembly of FIG. 25A with the firearm optic installed thereon.
Figure 26B:
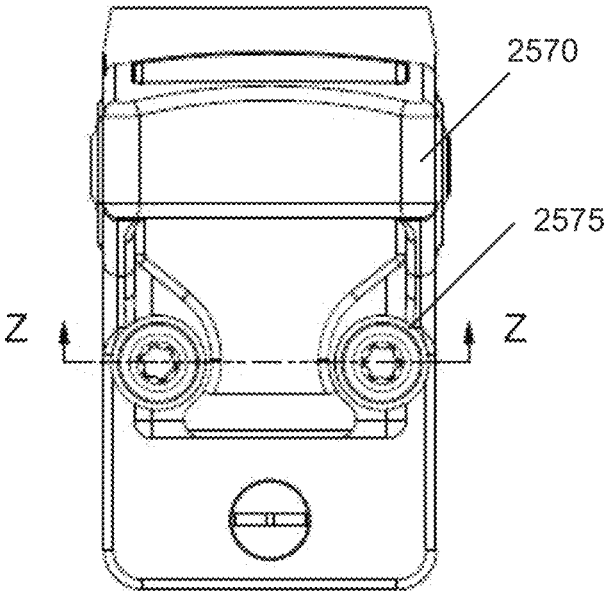
FIG. 26B illustrates a top view of the adapter assembly of FIG. 25A with the firearm optic installed thereon.
Figure 26C:
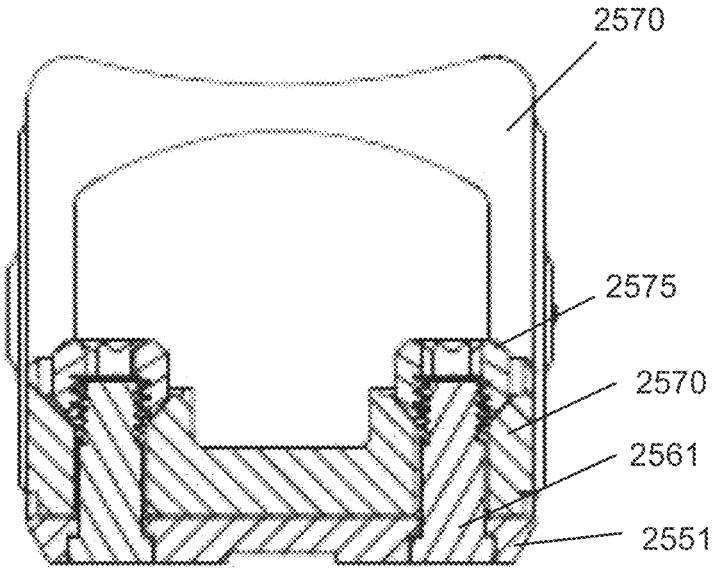
FIG. 26C illustrates a rear view of the adapter assembly of FIG. 25A with the firearm optic installed thereon along section line Z of FIG. 26B.

FIG. 26A illustrates an isometric view showing a bottom of the adapter assembly 2500 of FIG. 25A with the firearm optic 2570 installed thereon. FIG. 26B illustrates a top view of the adapter assembly 2500 with the firearm optic 2570 installed thereon. FIG. 26C illustrates a rear view of the adapter assembly 2500 with the firearm optic 2570 installed thereon along section line Z of FIG. 26B.

Figure 27A:
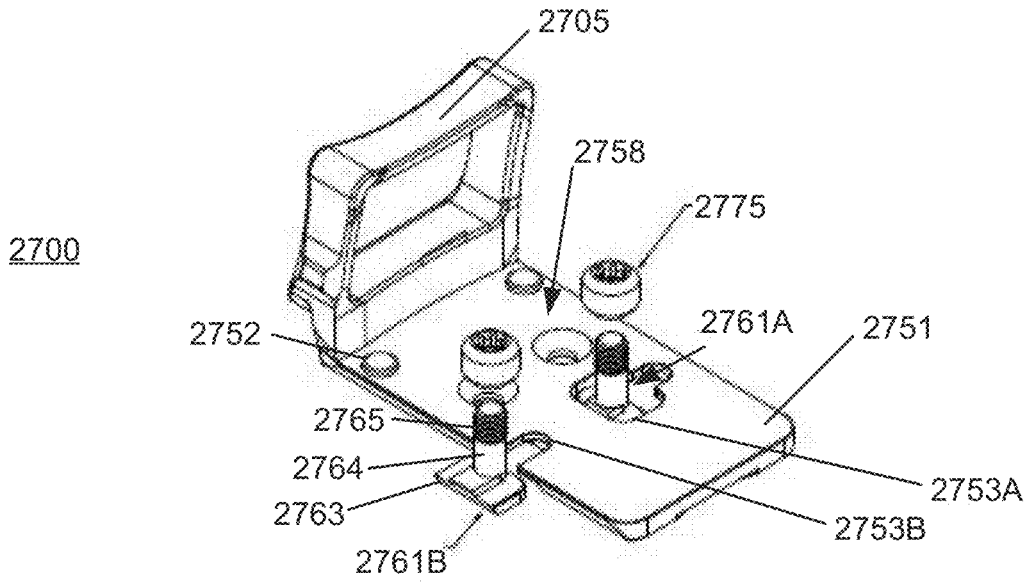
FIG. 27A shows an isometric view showing a top of an adapter assembly with an integrated optic guard for a firearm optic, according to various embodiments.
Figure 27B:
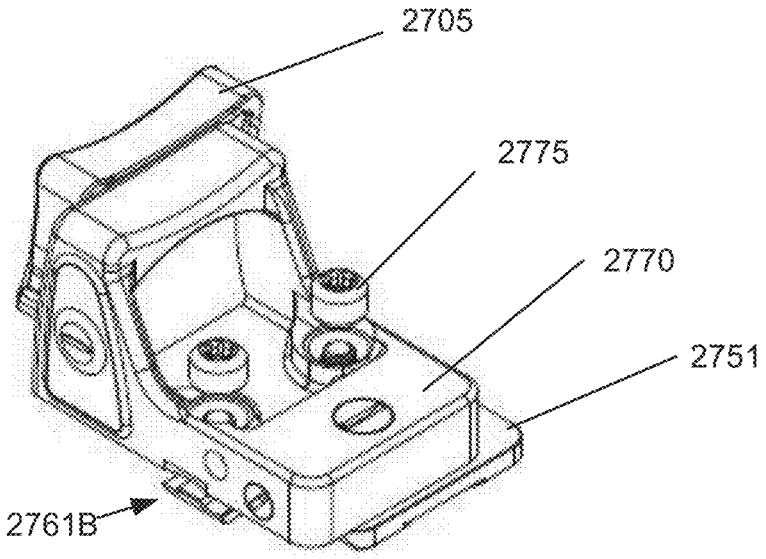
FIGS. 27B-C illustrate an isometric view top and bottom views, respectively, illustrating a slide-on installation of a firearm optic on the adapter assembly of FIG. 27A.
Figure 27C:
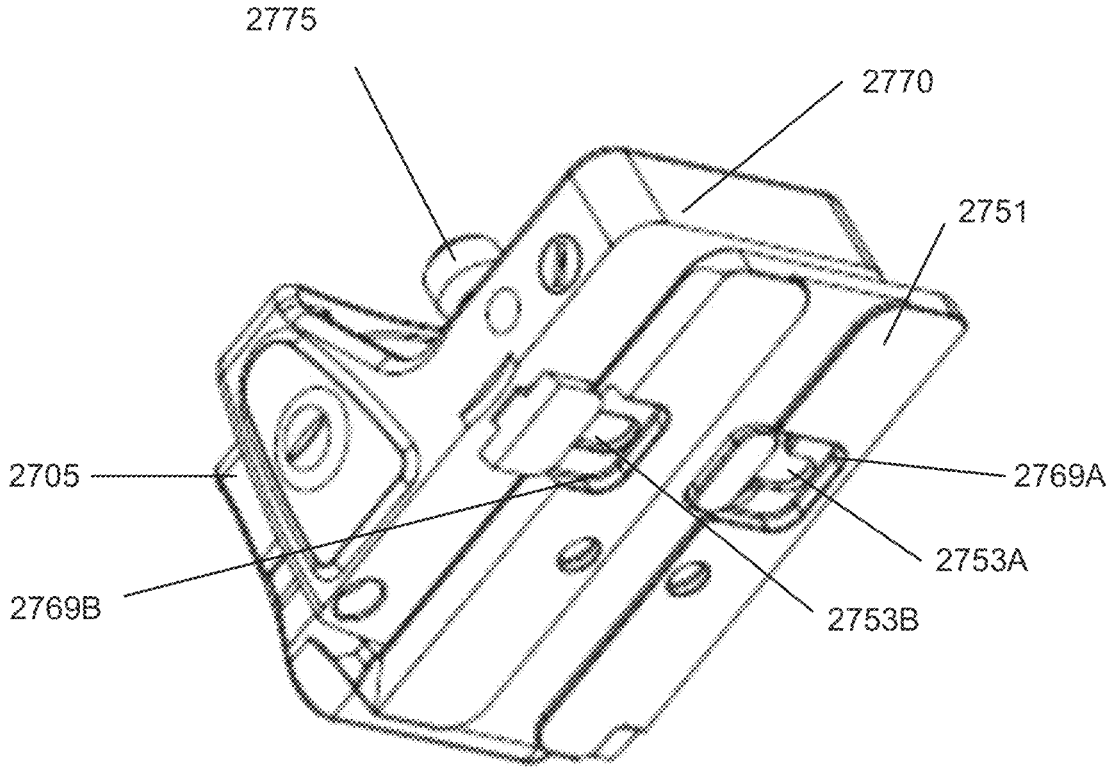

FIG. 27A shows an isometric view showing a top of an adapter assembly 2700 with an integrated optic guard 2705 for a firearm optic, according to various embodiments. FIGS. 27B-C illustrate an isometric view top and bottom views, respectively, illustrating a slide-on installation of the firearm optic 2770 on the adapter assembly 2700 of FIG. 27A. In this example, the firearm optic 2770 is side-installed to accommodate the integrated optic guard 2705 of the bracket 2751. Similar to the other bracket 2551 (FIG. 25A), first the bracket 2751 is installed on the slide. The fasteners 2761 are movable along an axis relative to the bracket 2751 (before the nuts 2775 are tightened), as shown, which allows the firearm optic 2770 to loosely attach in the offset position shown in FIGS. 27B-C.

Figure 28A:
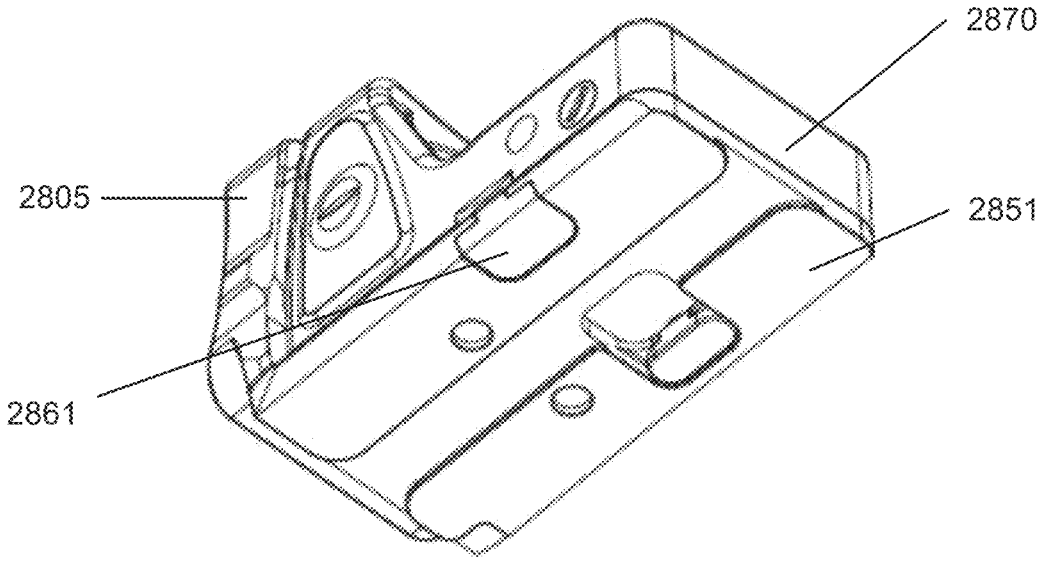
FIG. 28A illustrates an isometric view showing a bottom of the adapter assembly of FIG. 27A with the firearm optic installed thereon.
Figure 28B:
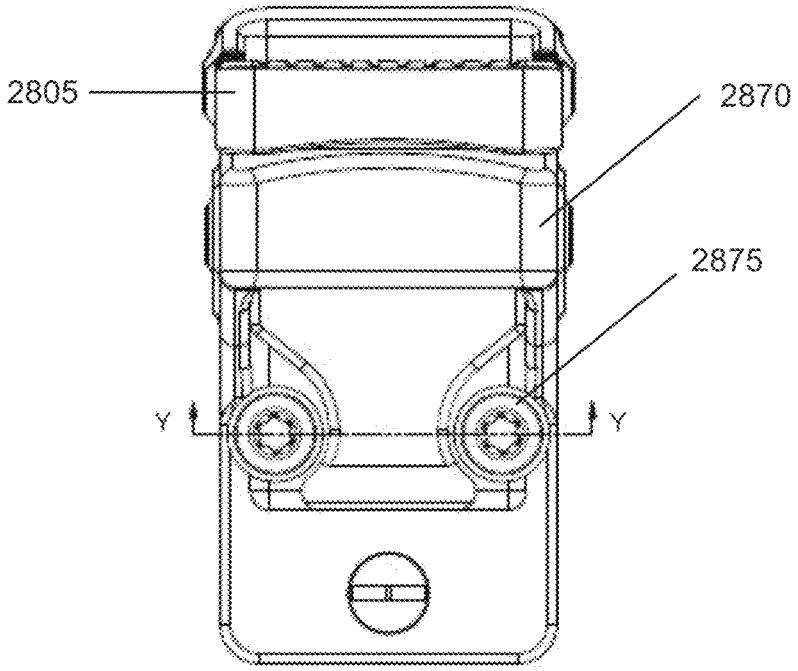
FIG. 28B illustrates a top view of the adapter assembly of FIG. 27A with the firearm optic installed thereon.
Figure 28C:
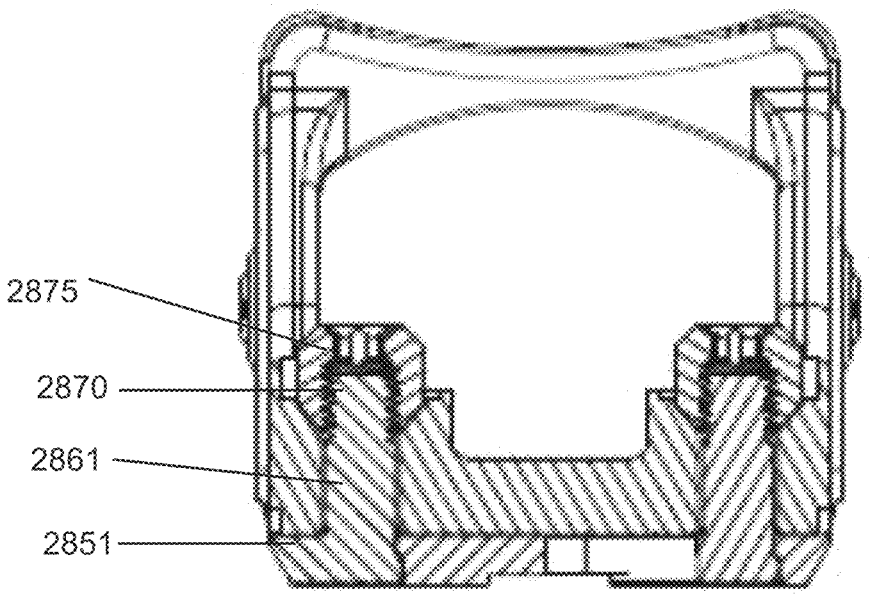
FIG. 28C illustrates a rear view of the adapter assembly of FIG. 27A with the firearm optic installed thereon along section line Y of FIG. 26B.

The firearm optic 2770 is then slide on from the side from the position shown in FIGS. 27B-C to the position shown in FIGS. 28A-C. FIG. 28A illustrates an isometric view showing a bottom of the adapter assembly 2700 of FIG. 27A with the firearm optic 2770 installed thereon. FIG. 28B illustrates a top view of the adapter assembly 2700 with the firearm optic 2770 installed thereon. FIG. 28C illustrates a rear view of the adapter assembly 2700 with the firearm optic 2770 installed thereon along section line Y of FIG. 26B. In this position, the nuts 2775 are fully tightened down.

Referring again to FIG. 27A, differently shaped through openings 2753A and 2753B are shown. These through openings 2753A and 2753B are different than through opening 2753 (FIG. 25A), and are arranged to allow movement of the fasteners 2761A and 2761B along an axis perpendicular to a center axis of the fasteners 2761A and 2761B (e.g., side to side movement) relative to the bracket 2751, as shown. Also, while through opening 2753A is fully enclosed by the bracket 2751, through opening 2753B is not.

Referring now to FIG. 27C, differently shaped pockets 2769A and 2769B are shown. These pockets 2769A and 2769B are different than through pockets 2553 (FIG. 25A), and are arranged to allow movement of the fasteners 2761A and 2761B along an axis perpendicular to a center axis of the fasteners 2761A and 2761B (e.g., side to side movement) relative to the bracket 2751, as shown, to allow side installation.

Referring to FIGS. 27A and 27B, one edge of the head 2763 of fastener 2761B may be sloped to form a continuous edge with a corresponding edge of the bracket 2751. This continuous edge may keep debris from entering between the bracket 2751 and the firearm assembly it is installed thereon. FIG. 28A illustrates the continuous edge.

The other fastener 2761A may be the same shape and/or dimensions as the fastener 2571 (FIG. 25A). Having the same size and dimensions of this part may simplify a supply chain for a bracket 2751 with the optic guard 2705 and the bracket 2551 (FIG. 25A).

Side-installation as shown and described may be desirable for using a stiff monolithic optic guard and adapter plate combination (in which the optic guard is part of a same unitary piece of metal as the adapter plate) and the firearm optic 2770. Unlike some optic guards that may have a multi-piece construction and/or include polymer, the illustrated stiff monolithic optic guard and adapter plate combination may be formed from a single piece of metal. In other examples, if a firearm optic has a vertical front, a corresponding vertical optic guard may not need side installation. Also, if an optic guard is detachable (for installation after installing the firearm optic), then side installation may not be needed.

This side installed bracket 2751 may be used with a stock slide or any other slide that is interchangeable with the stock slide. This side installed bracket 2751 may be used with any optics, now known (e.g., is backwards compatible) or later developed.

Figure 29A:
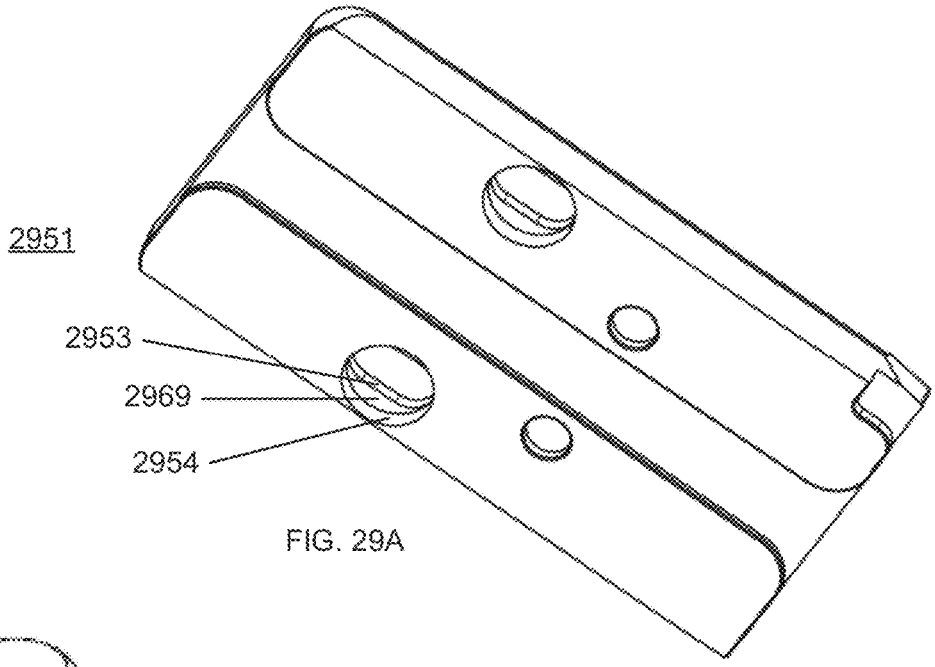
FIG. 29A shows a bottom of another bracket for a firearm optic, according to various embodiments.
Figure 29C:
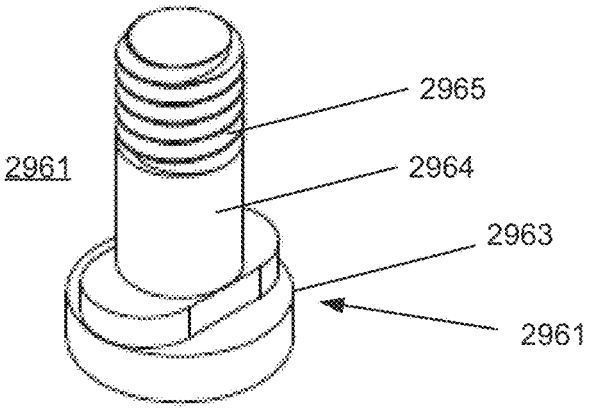
FIG. 29C shows an isometric view of a fastener receivable by the bottom of the bracket of FIG. 29A.
Figure 29B:
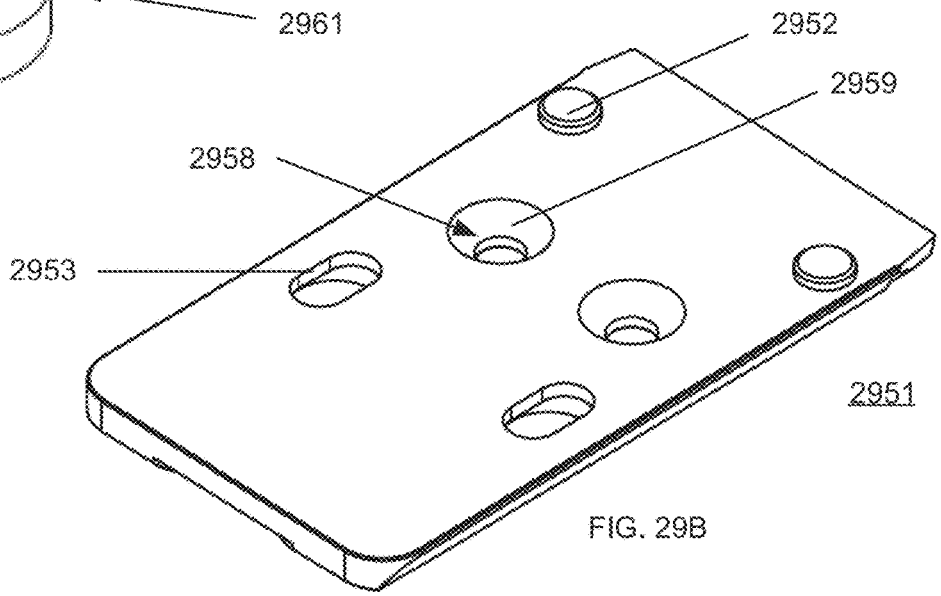
FIG. 29B shows a top view of the bracket of FIG. 29A.
Figure 29D:
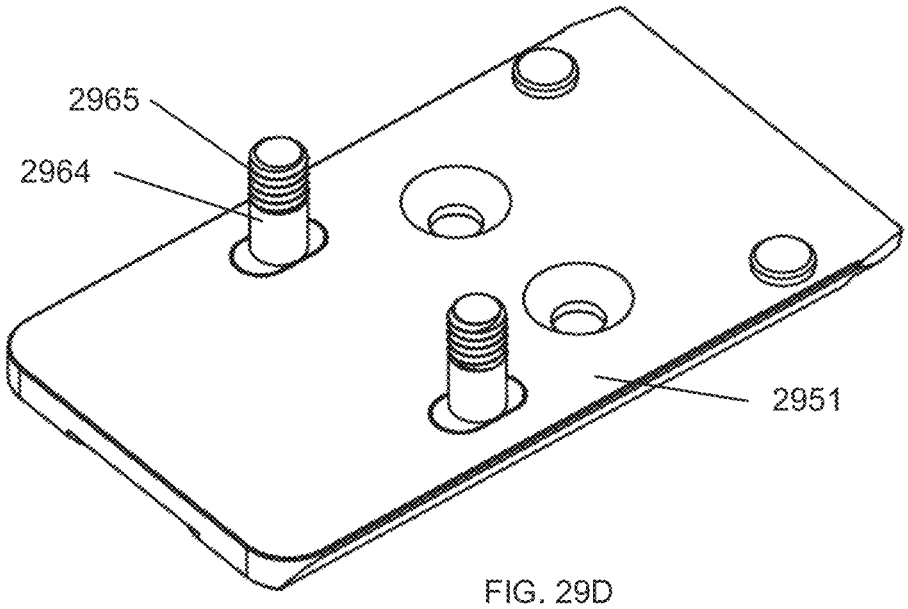
FIG. 29D shows a bottom view of the bracket of FIGS. 29A-B having the fasteners (FIG. 29C) inserted therein, according to various embodiments.
Figure 29E:
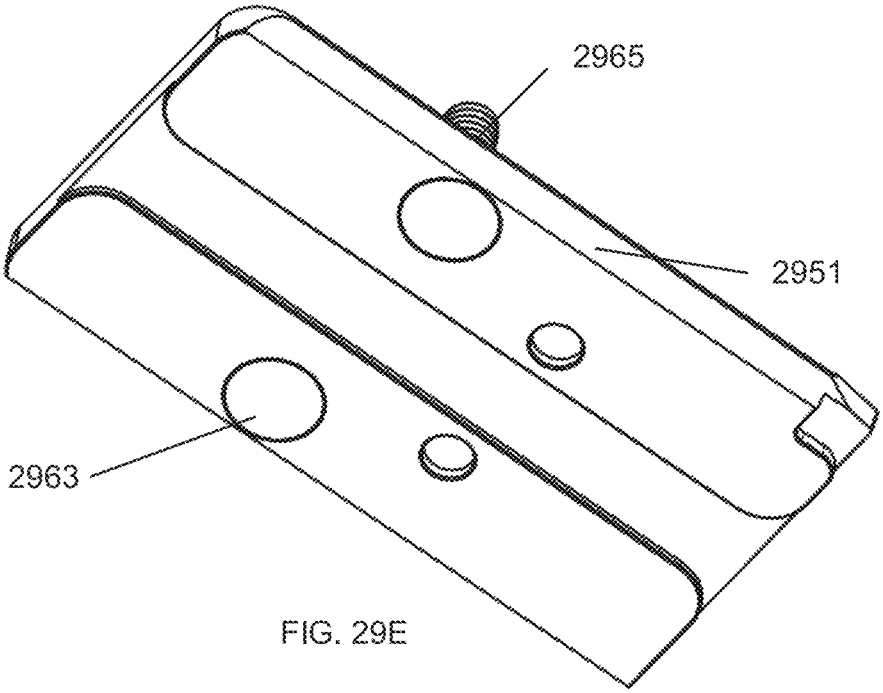
FIG. 29E shows a top view of the bracket arranged as shown in FIG. 29D.

FIG. 29A shows a bottom of another bracket 2951 for a firearm optic, according to various embodiments. FIG. 29B shows a top view of the bracket 2951 of FIG. 29A. FIG. 29C shows an isometric view of a fastener 2961 receivable by the bottom of the bracket 2951 of FIG. 29A. FIG. 29D shows a bottom view of the bracket 2951 of FIGS. 29A-B having the fasteners 2961 inserted therein, according to various embodiments. FIG. 29E shows a top view of the bracket 2951 of FIG. 29D.

The fastener 2961 (FIG. 29C) includes threading 2965, a shank 2964, and a head 2963. The threading 2965 may be similar in all respects to threading 2565 of FIG. 25A. The head 2963 includes a section arranged to mate with the pockets 2954 and an intermediate timing boss arranged to mate with the through openings 2953. The intermediate timing boss prevents rotation of the fastener 2961 when the intermediate timing boss is in the through opening 2953.

Referring again to FIG. 29A, the through opening 2953 located in a bottom 2969 of the pocket 2954 has an obround shaped cross section to key to the intermediate timing boss. In other examples, any keying configuration, now known or later developed, may be used for the through opening 2953. Whereas the through opening 2553 (FIG. 25A) receives the shank 2564, the through opening 2553 receives the intermediate timing boss—this is shown in more detail in FIG. 29D. The pockets 2964 are cylindrically shaped, to mate with a cylindrically shaped part of the head 2963 of the fastener 2961.

Referring now to FIG. 29B, the top side of the bracket 2951 includes fastener openings 2958 and counter openings 2959 that may be similar in any respect to the fastener openings 2558 (FIG. 25A) and counter openings 2559 (FIG. 25A). The registration pins 2952 may be similar in any respect to registration pins 2552 (FIG. 25A).

This design may be backward compatible with known slides (e.g., slide 150, FIG. 1B), and known firearm optics (e.g., RMR optic 154, FIG. 1F). Installation may be by first fastening the bracket 2951 to the slide (in which the heads 2963 of the fasteners 2961 are sandwiched between the slide and the bottom of the bracket 2910, in the pockets 2954. Once the bracket 2951 is fastened to the slide with these fasteners 2961 upright, the optic may be mounted on the upright fasteners 2961 and tightened down using any nuts described herein.

In another embodiment of an adapter assembly with an optic guard similar to the optic guard illustrated in FIGS. 27A-C (e.g., a bracket with a frame), the pockets may be similar to in shape to pockets 2954, but enlarged. The through openings may be similar to through openings 2953, but rotated 90 degrees. A fastener may be similar to fastener 2961 (FIG. 29C), but may have an obround top section of the head to allow side-to-side movement of this part of the head in the enlarged pocket. The enlarged pockets and rotated through openings 2953 may be arranged to allow side installation of a firearm optic behind the frame.

Any of the adapter assembly features described herein may be used in combination with any optic guard and/or slide described herein, such as those illustrated in FIG. 12. Any of the adapter assembly features may be used with any optics (such as firearm optics illustrated herein or other firearm optics, such as a known long range optic packaged in a scope tube body for, say, a rifle), now known (e.g., is backwards compatible) or later developed. In various embodiments, the bracket 2551 may be used with a stock slide or any other slide that is interchangeable with the stock slide.

Figure 30A:
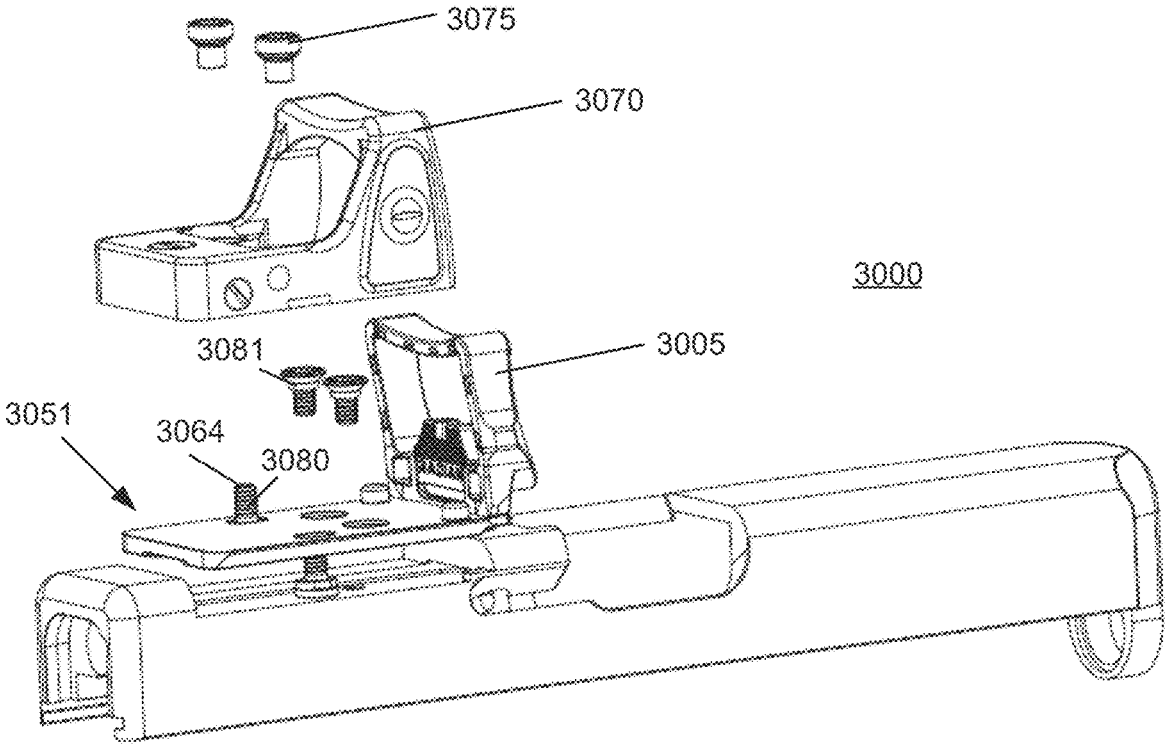
FIG. 30A shows an isometric view of a slide assembly for a firearm, according to various embodiments.

FIG. 30A shows an isometric view of a slide assembly 3000 for a firearm, according to various embodiments. The slide assembly 3000 includes an adapter assembly including the bracket 3051 and the firearm optic 3070 (which may be similar to any firearm optic described herein). In this embodiment, an optic guard 3005 may cover the front of the body of firearm optic 3070 as illustrated; however, the optic guard 3005 is an optional feature.

In this embodiment, the firearm optic 3070 is attached to the bracket 3051 using low-profile bolt fastening. The advantages of using bolt fastening for a firearm optic to a bracket are previously described herein—in low-profile bolt fastening embodiment a top of the nuts are out of view when a user looks down the optic (this is illustrated in FIG. 30F).

Referring again to FIG. 30A, the low-profile bolt fastening uses a bolt 3064, which may have a length that is shorter than a length of the bolt 2561 (FIG. 25A). This bolt 3064 may have a head similar to any bolt head described herein (e.g., corresponding pockets and through openings, not shown, on a bottom of the bracket 3051 may be similar to pockets and through openings previously described herein). The shank 3080 of the bolt 3064 may be entirely threaded, or may include a non-threaded section (which may be shorter than the non-threaded section of the bolt 2461 of FIG. 25BA). The sleeve nuts 3075 (which may be alternatively referred to as skirt nuts, barrel nuts, sex bolt nuts), or the like) couple to the bolts 3064.

Figure 30B:
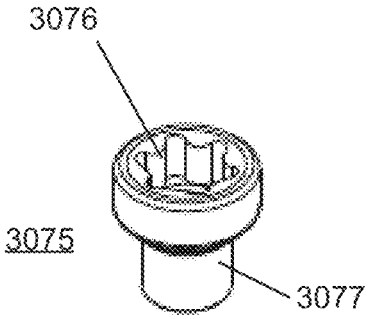
FIG. 30B shows an isometric view of the sleeve nut of the slide assembly of FIG. 30A.
Figure 30C:
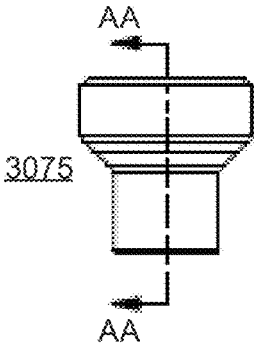
FIG. 30C shows a side view of the sleeve nut of FIG. 30A.
Figure 30D:
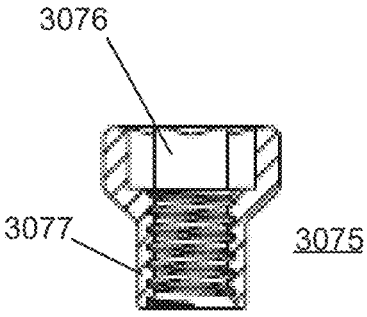
FIG. 30D shows a section view of the sleeve nut of FIGS. 30A-B taken along section line AA.

Referring now to FIGS. 30B-D, the sleeve nut 3075 may have an internal driving mechanism 3076 (in contrast to some other nuts that have an external driving mechanism such as a solid hexagonal head). The sleeve nut 3075 includes a sleeve 3077 with a threaded interior to mate with the threading on the shank of the bolt 3064. A length of the sleeve 3077 may be arranged so that a bottom part of the sleeve 3077 is located in, or above, the through opening of the bracket 3051 when the sleeve nut 3074 is fully tightened. In the latter case, a width of the through opening may correspond to the width of the shank of the bolt 3064, as illustrated. Any sleeve length that provides the necessary threading lock-up to provide strong retention of a firearm optic on a bracket may be used in various embodiments.

Referring again to FIG. 30A, the bracket 3051 may be fastened to an optic mount of a firearm (e.g., fastened to a slide in this example) using fasteners 3080, which may be screws retained by threaded openings in the optic mount (e.g., in the slide). In this embodiment, seals 3081, which may be made of rubber, plastic, or the like (or combinations thereof) are provided around the fasteners 3080.

The arrangement of the seals 3081 is different than other sealing arrangements that add thickness between a firearm optic 3070 and an adapter assembly. Specifically, in addition to a face groove seal supplied with some firearm optics (the battery seal is shown as face groove seal 156 in FIG. 1F), firearm optic manufactures may specify an additional seal layer between the firearm optic body and an optic mount (e.g., a slide), such as sealing plate 151 (FIG. 1C) and/or some other additional sealing layer that is intermediate between a bottom of the optic and an optic mount. This additional seal layer raises a position of the optic relative to the firearm. For this and other reasons, users may choose to install firearm optics on optic mounts without this additional seal layer. Seals 3081 may be used in this configured to prevent moisture from entering the firearm optic body through the corresponding through openings, without raising the optic relative to the firearm as with firearm installations using the additional seal layer.

Figure 30E:
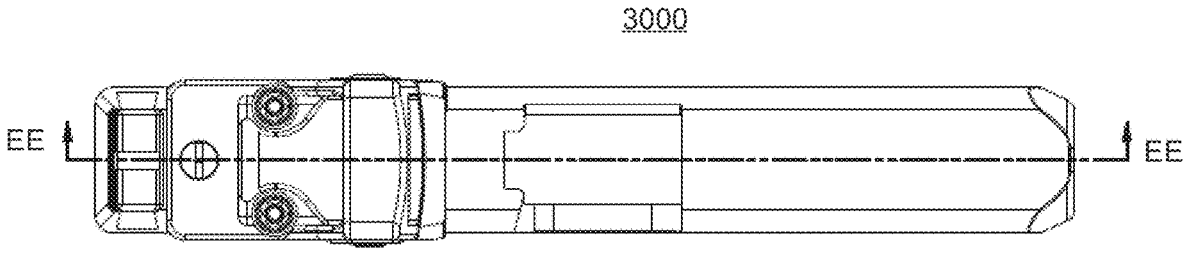
FIG. 30E illustrates a top view of the slide assembly of FIG. 30A.
Figure 30F:
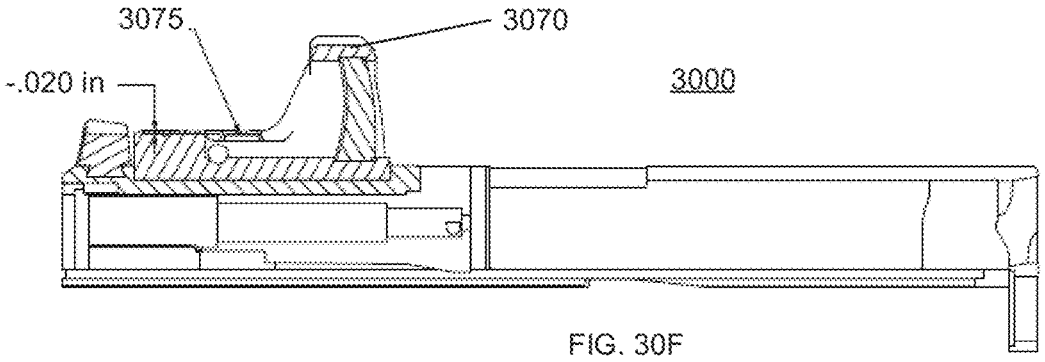
FIG. 30F illustrates a section view of the slide assembly of FIG. 30E taken along section line EE.

FIG. 30E illustrates a top view of the slide assembly 3000 of FIG. 30A. FIG. 30F illustrates a section view of the slide assembly 3000 of FIG. 30E taken along section line EE. This view shows that a top end of the sleeve nut 3075 is not above a plane defined by a top of a back end of the body of the firearm optic 3070 (in this embodiment, the top end is 0.02 inches below the plane). Accordingly, the sleeve nut 3075 is not in the user's field of view when the user looks through the firearm optic 3070.

Figure 31A:
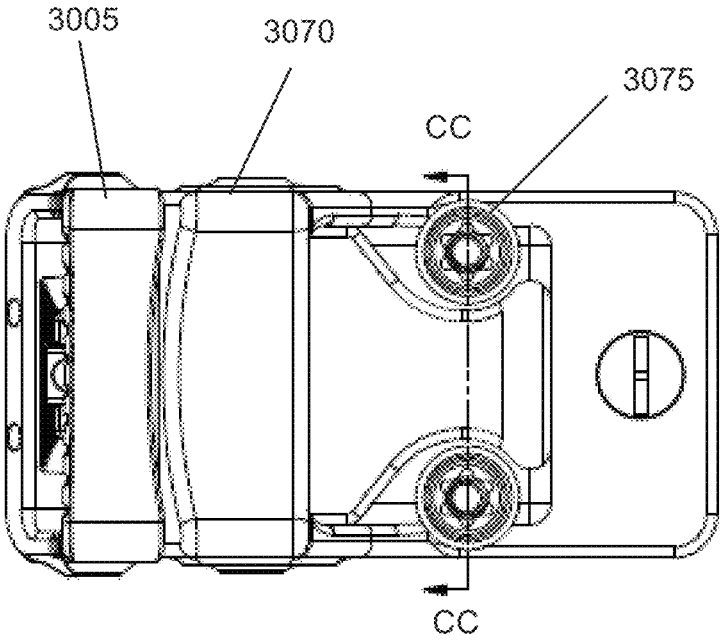
FIG. 31A shows a top view of the adapter assembly of FIG. 30A.
Figure 31B:
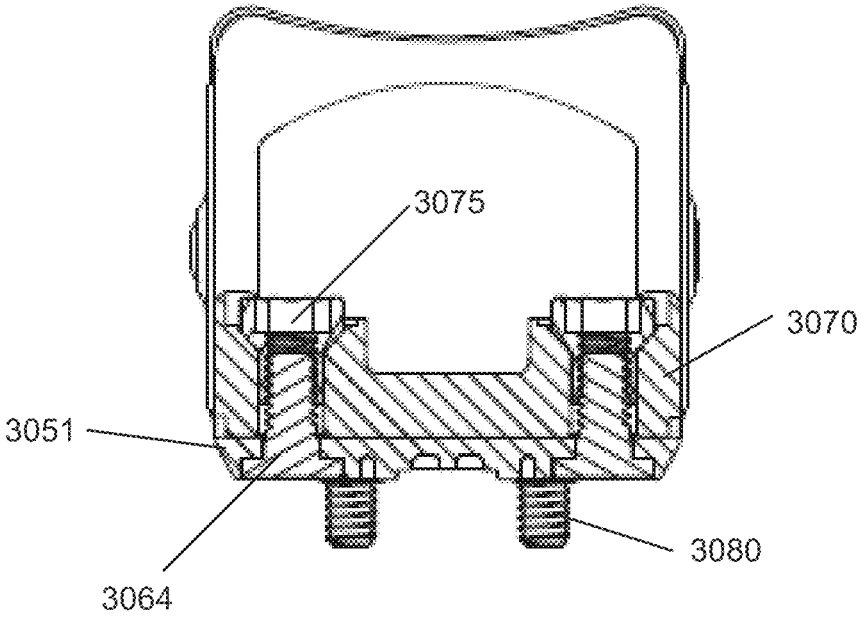
FIG. 31B shows a section view of the adapter assembly of FIG. 31A taken along section line CC.

FIG. 31A shows a top view of the adapter assembly of FIG. 30A. FIG. 31B shows a section view of the adapter assembly of FIG. 31A taken along section line BB. The threading lockup between the bolts 3064 and the sleeve nuts 3075 can be seen in this view.

Figure 32A:
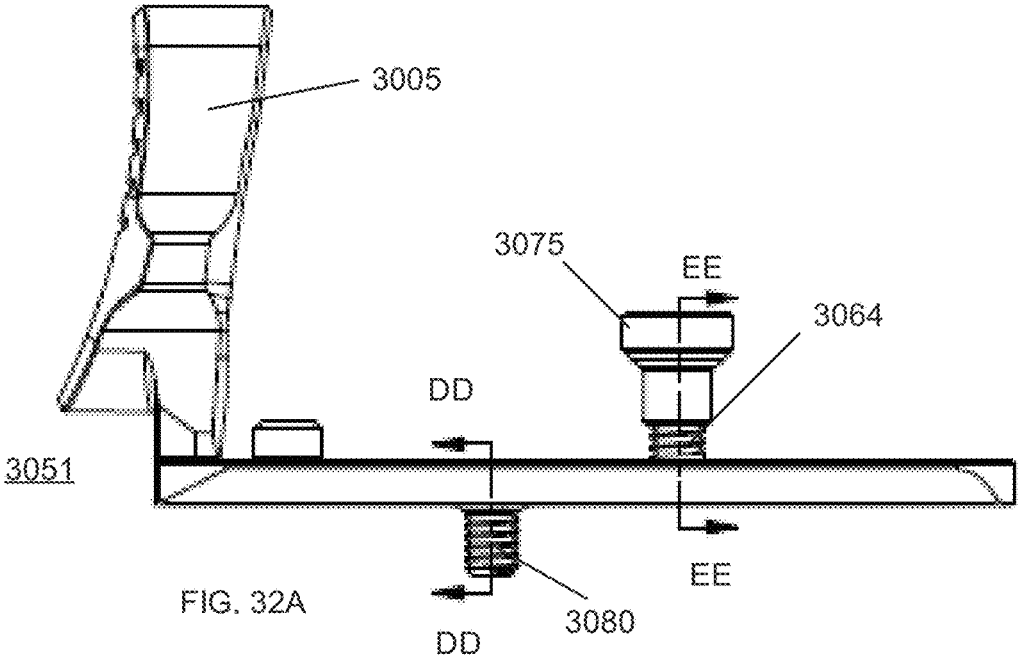
FIG. 32A shows a side view of the bracket of FIG. 30A.
Figure 32B:
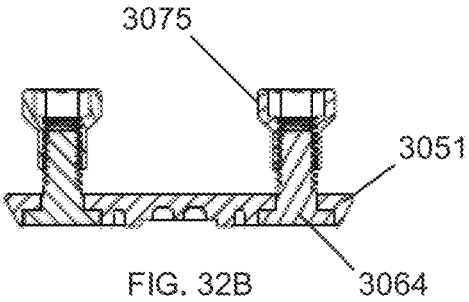
FIG. 32B shows a section view of the bracket of FIG. 32A taken along section line DD of FIG. 32A.
Figure 32C:
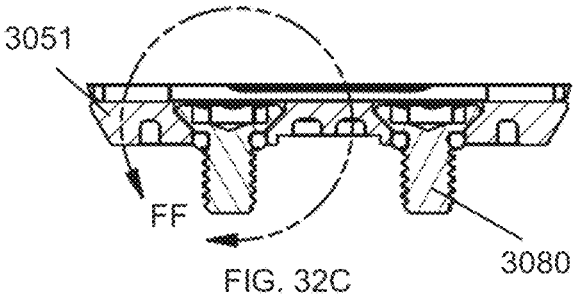
FIG. 32C shows a section view of the bracket of FIG. 32A taken along section line EE of FIG. 32A.
Figure 32D:
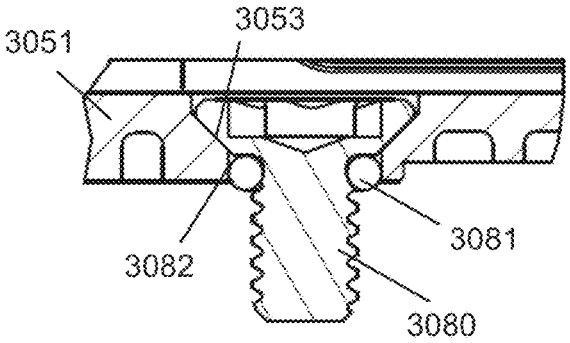
FIG. 32D is a detailed view FF of FIG. 32C.

FIG. 32A shows a side view of the bracket 3051 of FIG. 30A. FIG. 32B shows a section view of the bracket 3051 of FIG. 32A taken along section line CC of FIG. 32A. FIG. 32C shows a front view of the bracket 3051 of FIG. 32A taken along section line DD of FIG. 32A. FIG. 32D is a detailed view EE of FIG. 32C.

Referring to FIG. 32D, the bracket 3051 defines a through opening 3053 and an opening 3082. The opening 3082 is arranged to receive the seals 3081. The seal 3081 may form a seal with a part of the bracket 3051 and with part of a length of the fastener 3080 (e.g., with the underside of the head of the fastener 3080 and a non-threaded section of the length of the fastener). The seal 3081 may also form a seal with a part of the optic mount (e.g., with the slide or other firearm component). Therefore, moisture does not enter the space within the firearm optic's seal (e.g., the face groove seal 156 of FIG. 1F). It is noted that the additional openings on the bottom side of the bracket 3051 (to either side of the openings 3082) are weight-reducing openings, which optionally may be used in various embodiments.

In this example, the seals 3081 are torus-shaped. In other examples seals may have any shape that forms a seal with the optic mount, the bracket 3051, and/or the part of the length of the fastener (e.g., a non-threaded part of the length) and/or underside of the head of the fastener.

In this embodiment, the through openings for the bolt shanks re outside the firearm optic's gasket 156, as illustrated in FIG. 1F; therefore, seals may not be needed for the bolts 3064. In other embodiments, it may be possible and practical to use additional seals (not shown) with the bolts 3064, similar to the use with the fasteners 3075.

The seals 3081 may be used in combination with any optic mount, including adapter assemblies and direct optic mounting (where a firearm optic is mounted to an optic mount of a firearm without an intervening adapter assembly). In some examples, the adapter assembly may feature any known mounting system for attaching the optic to the adapter in combination with seals 3081 used with the fasteners that attach the adapter assembly to the firearm. In adapter assembly examples, a through opening in a bracket may be arranged to receive the seals 3081 similar to opening 3082, and/or to form a seal with the seals 3081. In direct mount examples, an opening below a through opening in a body of the firearm optic may be arranged to receive the seals 3081 in a similar way, and/or to form a seal with the seals 3081. In any of these examples, the fasteners for attaching the bracket or firearm optic to an optic mount (e.g., an optic mount on a firearm) may feature surfaces to seal with the seals (e.g., a non-threaded part of the length and/or a smooth underside of the head of the fasteners).

In this example, the opening 3082 in the bracket 3051 does not have a bottom (e.g., the seal 3081 may be in contact with an underside of the fastener 3080). In other examples, the seal 3081 may be located in a pocket that includes a bottom defined by the bracket 3051 (FIGS. 34A-D illustrate such other examples).

In various embodiments, a pocket or opening for a seal (e.g., a torus shaped seal) may be located on a bottom side of an adapter assembly (below a fastener opening in the adapter assembly). However, in other embodiments, the optic mount (e.g., a slide) may have a pocket for the seal instead of, or in addition to, the pocket or opening in the bottom of the adapter assembly. For example, the fastener holes in the optic mount may be counterbored to create a pocket for the seal. If the seal is locatable entirely in that counterbore when compressed, the adapter assembly may not have any pocket or opening for the seal (or if the seal is significantly taller than the depth of the counterbore, then the adapter assembly may have a shallow pocket or opening to receive a top section of the seal).

Figure 32E:
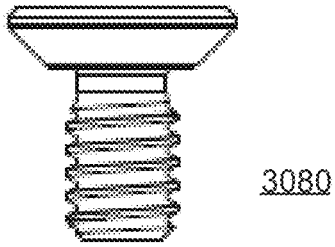
FIG. 32E is a side view of the fastener shown in FIG. 32D.

FIG. 32E is a side view of the fastener 3080 shown in FIG. 32D. As illustrated, the fastener has a head, threading, and a non-threaded section located between the head and the threading (this is section may seal with the seal 3081). A width of the non-threaded section may be approximately the same as the width of the inner diameter of the threading, but this is not required (the width of the non-threaded section may correspond to the corresponding dimension, e.g., an inner diameter, of the seal 3081).

Figure 33A:
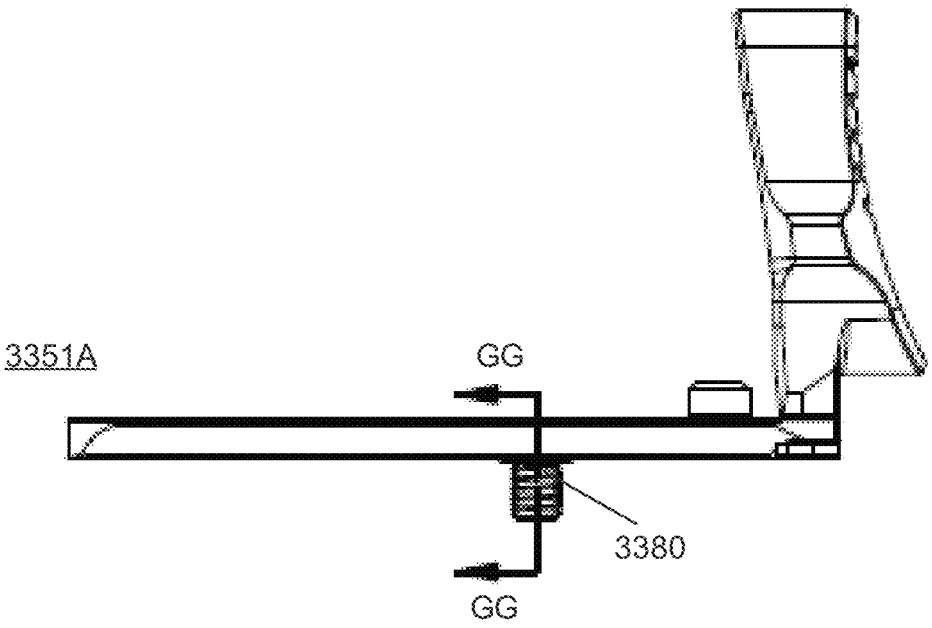
FIG. 33A is a side view of another bracket with sealing features, according to various embodiments.
Figure 33B:
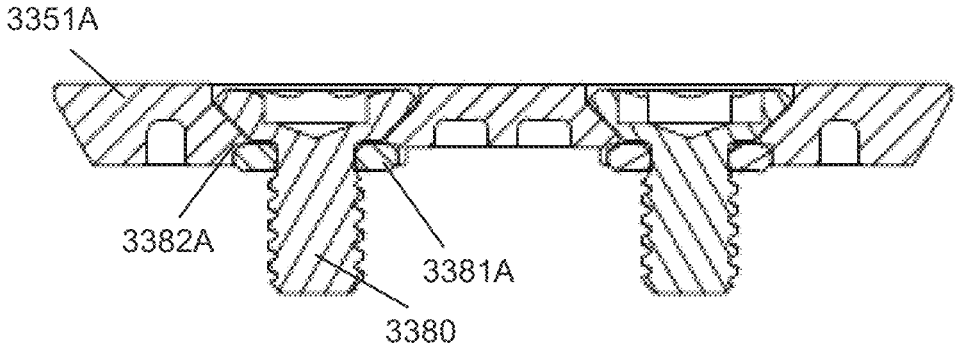
FIG. 33B is a section view of the bracket of FIG. 33A taken along section line GG.

FIG. 33A is a side view of another bracket 3351A with sealing features, according to various embodiments. FIG. 33B is a section view of the bracket 3351A of FIG. 33A taken along section line GG. In this embodiment, a pocket 3382A is provided by a counter bore on a bottom side of the bracket 3351A. The seal 3381A is in sealing contact with the underside of the head of the fastener, part of the length of the fastener, and the part of the bracket 3351A that defines the pocket 3382A (the seal 3381A is shown under compression—flattened from its uncompressed torus shape).

Figure 33C:
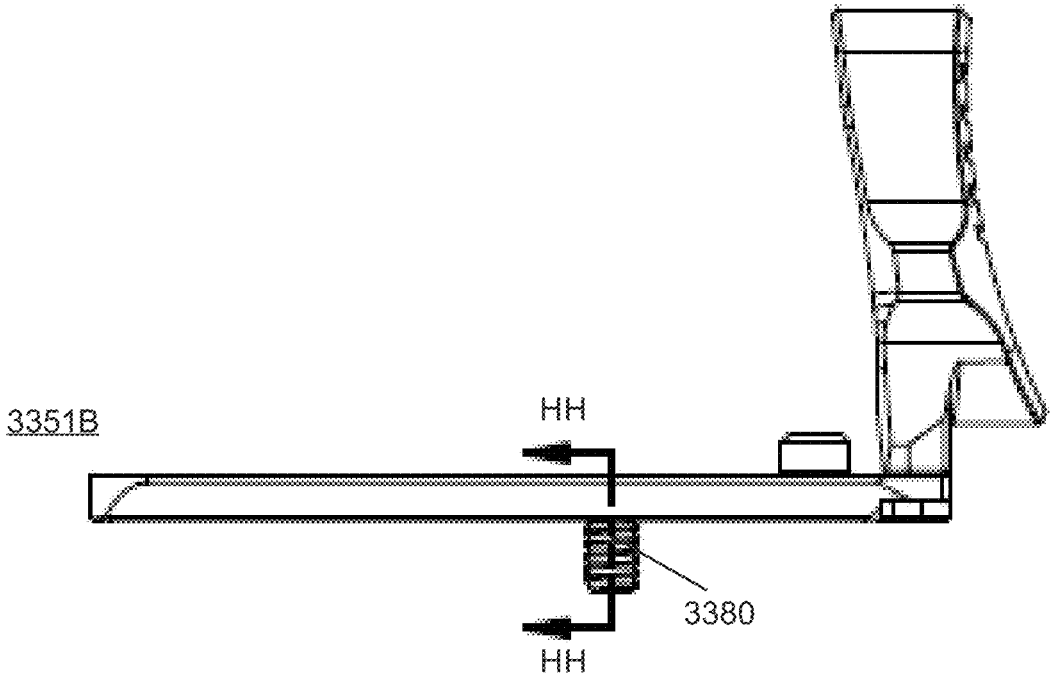
FIG. 33C is a side view of another bracket with sealing features, according to various embodiments.
Figure 33D:
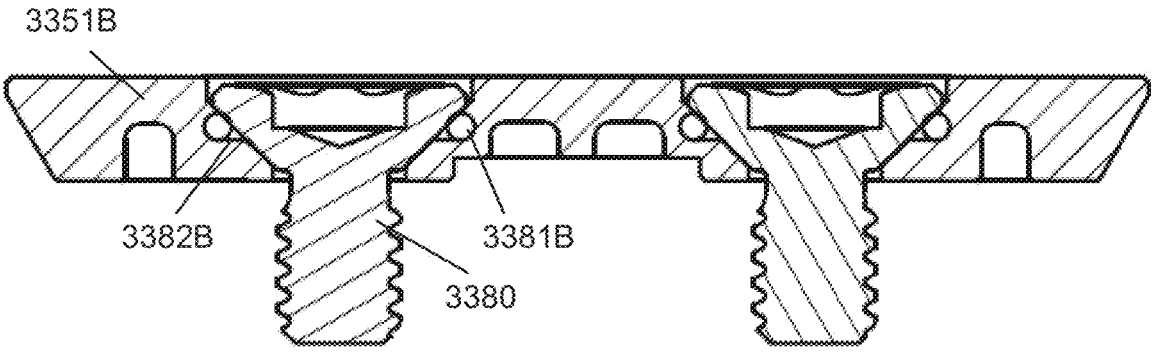
FIG. 33D is a section view of the bracket of FIG. 33C taken along section line HH.

FIG. 33C is a side view of another bracket 3351B with sealing features, according to various embodiments. FIG. 33D is a section view of the bracket 3351B of FIG. 33C taken along section line HH. In this embodiment, a pocket 3382B is provided by a counter bore in a counter sink on the top side of the bracket 3051B. The seal 3381B is in sealing contact with part of the head of the fastener 3080 and with the part of the bracket 3351B that defines the pocket 3382B.

In this embodiment, the seal 3381B is compressed by the fastener 3380. In another embodiment, a pocket may be formed around a top of a head of the fastener 3380. In such embodiment, the seal may be around of top of fastener and compressed by the optic when the optic is mounted to the adapter assembly (the pocket may be formed by making a counter opening that is larger than the head of the fastener—to provide the pocket for the seal).

Figure 34A:
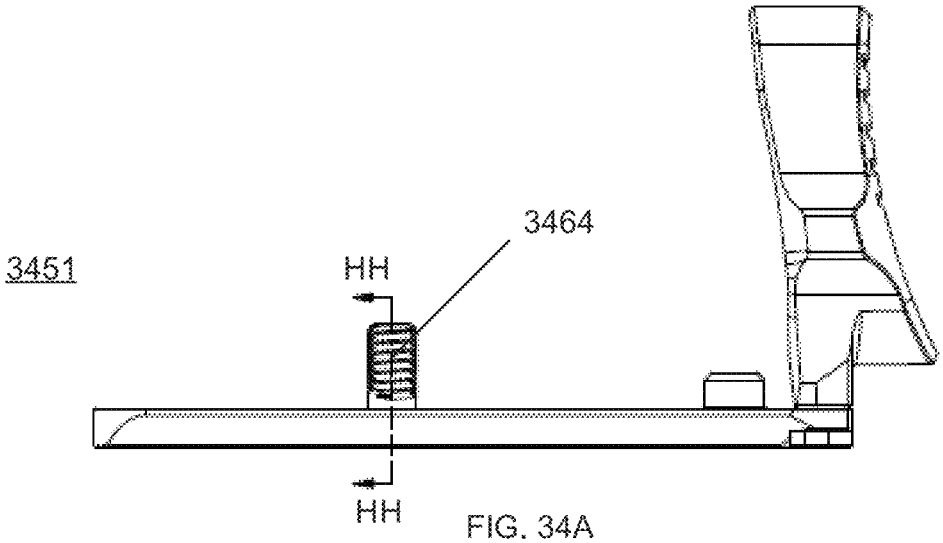
FIG. 34A shows a side view of another bracket similar in various respects to the bracket of FIG. 32A, according to various embodiments.
Figure 34B:
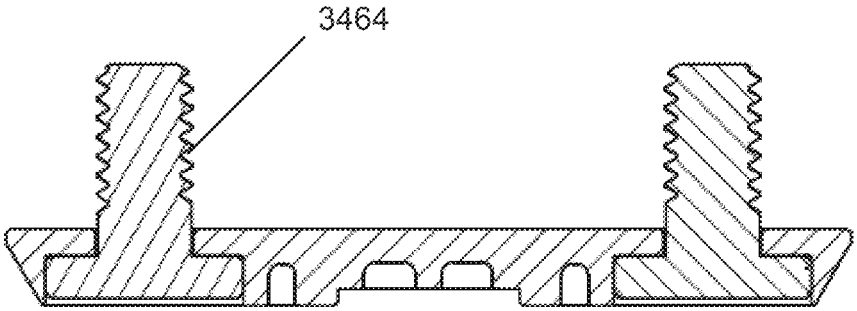
FIG. 34B shows a section view of the bracket of FIG. 34A taken along section line HH of FIG. 34A.
Figure 34C:
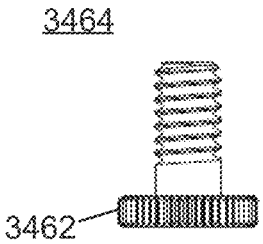
FIGS. 34C-E show side, isometric, and top views, respectively, of the stud of the bracket of FIG. 34A.
Figure 34D:
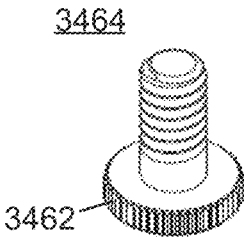
Figure 34E:
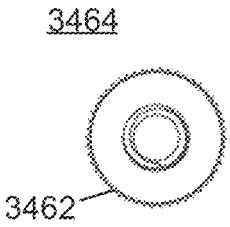

FIG. 34A shows a side view of another bracket 3451 similar in various respects to the bracket of FIG. 32A, according to various embodiments. FIG. 34B shows a section view of the bracket 3451 taken along section line HH of FIG. 34A. FIGS. 34C-E show side, isometric, and top views, respectively, of the stud 3464 of the bracket 3451.

The stud 3464 has a round head, as illustrated. The bracket 3451 includes a round pocket (not shown) arranged to receive the round head, which prevents the stud 3464 from moving vertically relative to the bracket 3451 when a nut (not shown) is being tightened onto the stud threading. A side of the round head has knurling (e.g., straight knurling, which may be formed using any known knurling tool (in this example, the straight knurling may be formed by a straight knurling tool, but other knurling formed with other knurling tools may be possible and practical). The knurling is arranged to prevent to the stud 3464 from rotational movement when the nut (not shown) is being tightened onto the stud threading.

The head of the stud 3464 may be pressed into the bracket 3451, which may compress the knurling into the round opening thereby fixably mounting the stud 3464 into the round opening. A nut (not shown), which may be similar to any nut described herein such as nut 3075 (FIGS. 30A-D) may be arranged to fasten to a threaded length of the stud 3464.

Figure 35A:
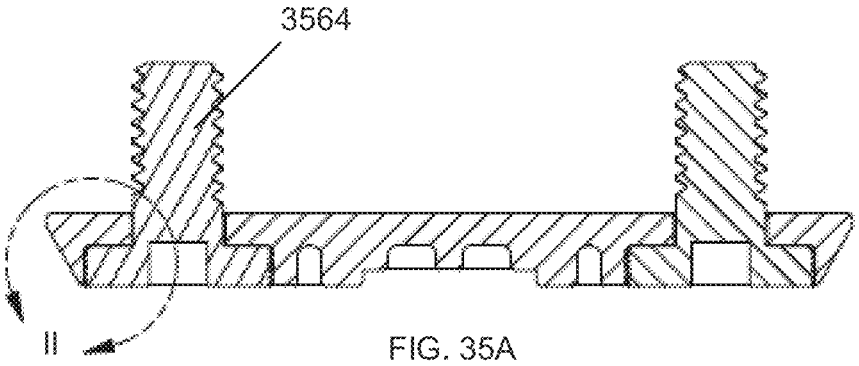
FIG. 35A shows is sectional view of another bracket, according to various embodiments.
Figure 35B:
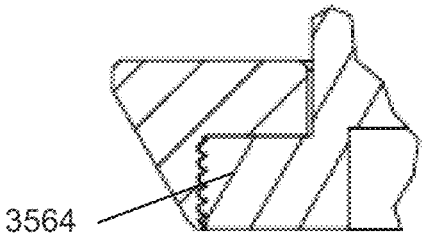
FIG. 35B is a detailed view II of FIG. 35A.
Figure 35C:
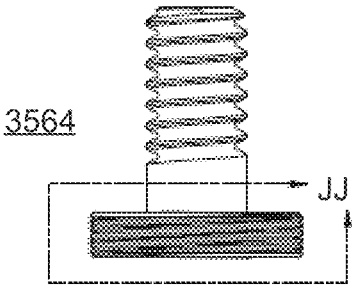
FIG. 35C is a side view of the fastener shown in FIG. 35A.
Figure 35D:
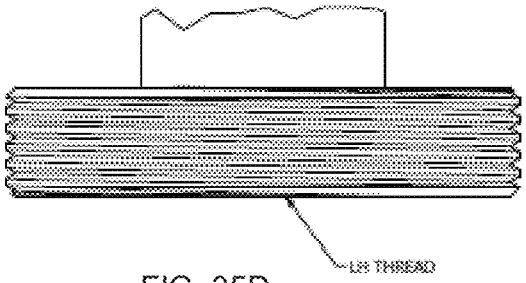
FIG. 35D is a detailed view JJ of FIG. 35C.

In another embodiment, illustrated in FIGS. 35A-D (FIG. 35A illustrates a section view similar to section view 34B), threading may be used instead of knurling. In these embodiments, the stud 3564 may have threading similar to threading of stud 3464 (e.g., one of right-hand or left-hand threading) on one end, a non-threaded section similar to stud 3464, and an oppositely threaded section (e.g., the other of right-hand or left-hand threading) on the other end. A bracket may have a through opening similar to any bracket through opening described herein, and a threaded opening. The threaded opening may have a threading to mate with the oppositely threaded section on the head of the stud 3564. The threaded opening may have a width of any size, such as slightly larger than the width of the through opening. The oppositely threaded section on the head of the stud 3564 may prevent rotational movement of the stud 3564 so that a nut may be tightened onto the threading. In the illustrated example, left hand threading is used on the head of the stud 3564 (and right hand threading is used on the length of the stud 3564).

In other embodiments, a threaded post having dimensions similar to the threaded length of the stud 3464 may be integrally formed on a bracket similar to bracket 3451 or any bracket herein (e.g., integrally formed above a solid section of the bracket, rather than passing through a through opening). In such an embodiment, removable fasteners and/or seals similar to any embodiment described herein may be used to attach the bracket with the integrally formed threaded posts to a slide. Any nut described herein may be used with such an integrally formed threaded post.

Figure 36:
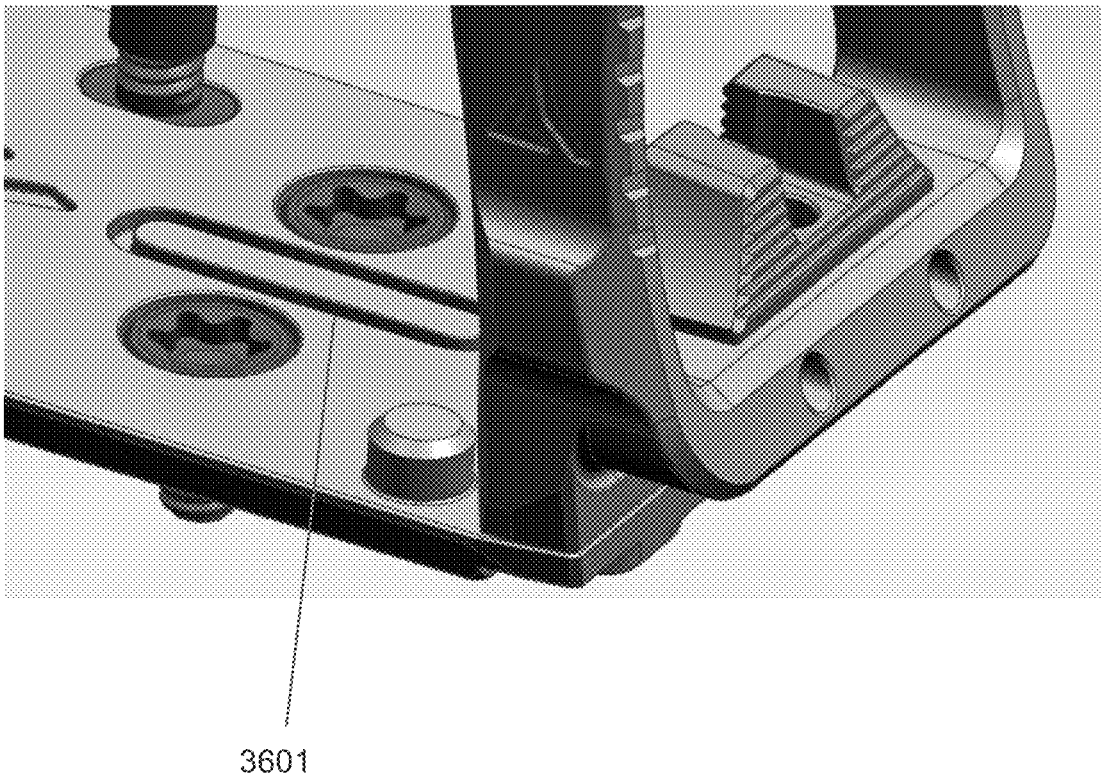
FIG. 36 illustrates a partial isometric view of a top of an adapter assembly to illustrate a seal channel, according to various embodiments.
Figure 37A:
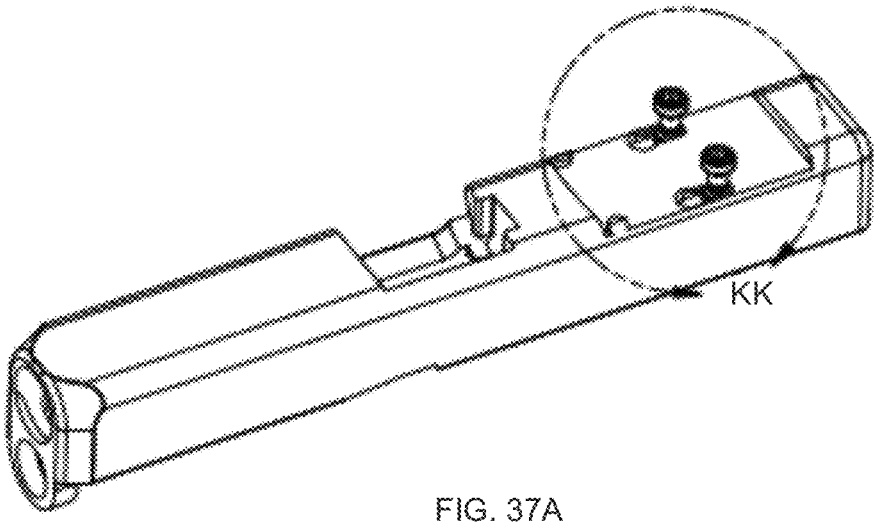
FIG. 37A illustrates a slide assembly with a bolt and sleeve nut for direct mounting an optic to a firearm, according to various embodiments.
Figure 37B:
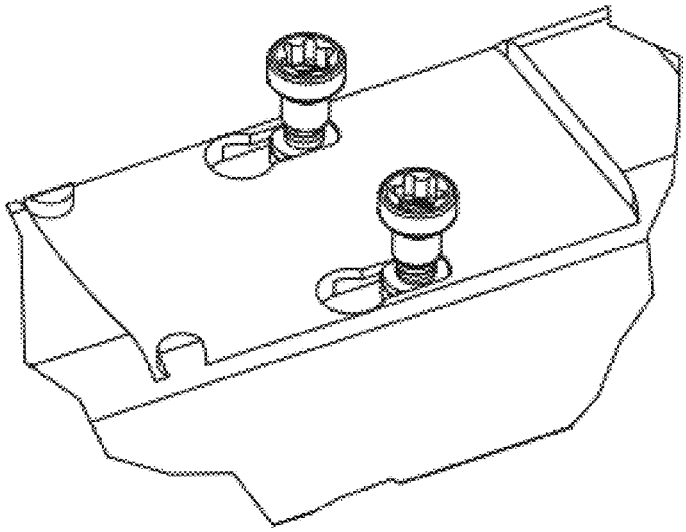
FIG. 37B is a detailed view KK of FIG. 37A.
Figure 37C:
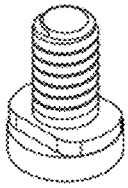
FIG. 37C is an isometric view of the bolt of FIG. 37A.
Figure 37D:
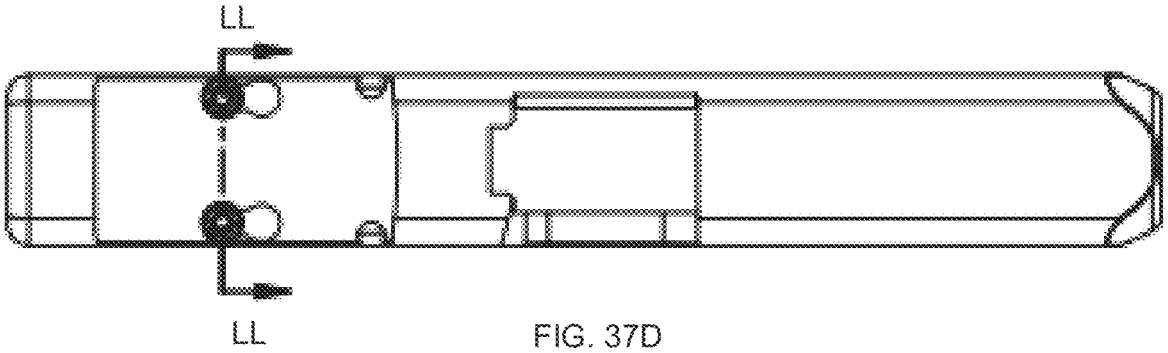
FIG. 37D is a top view of the slide assembly of FIG. 37A.
Figure 37E:
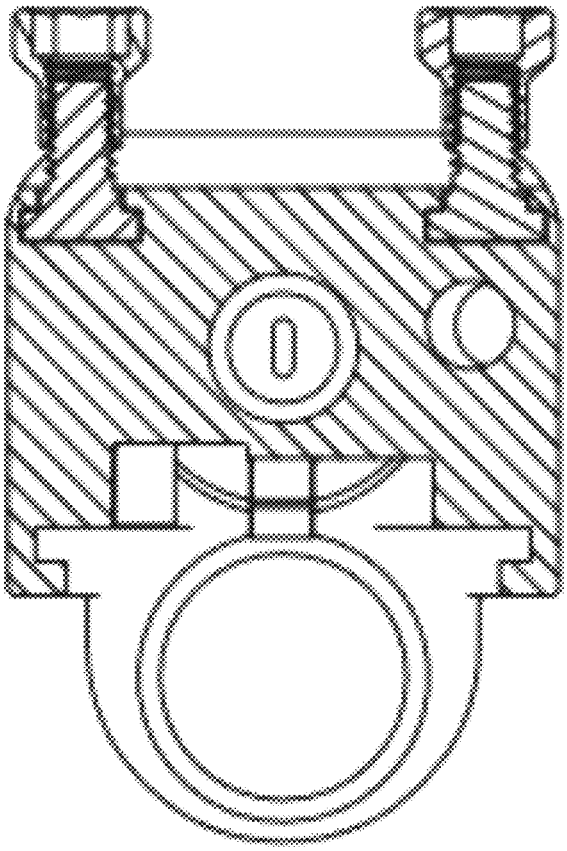
FIG. 37E is a section view of the slide assembly of FIG. 37D taken along section line LL.
Figure 38A:
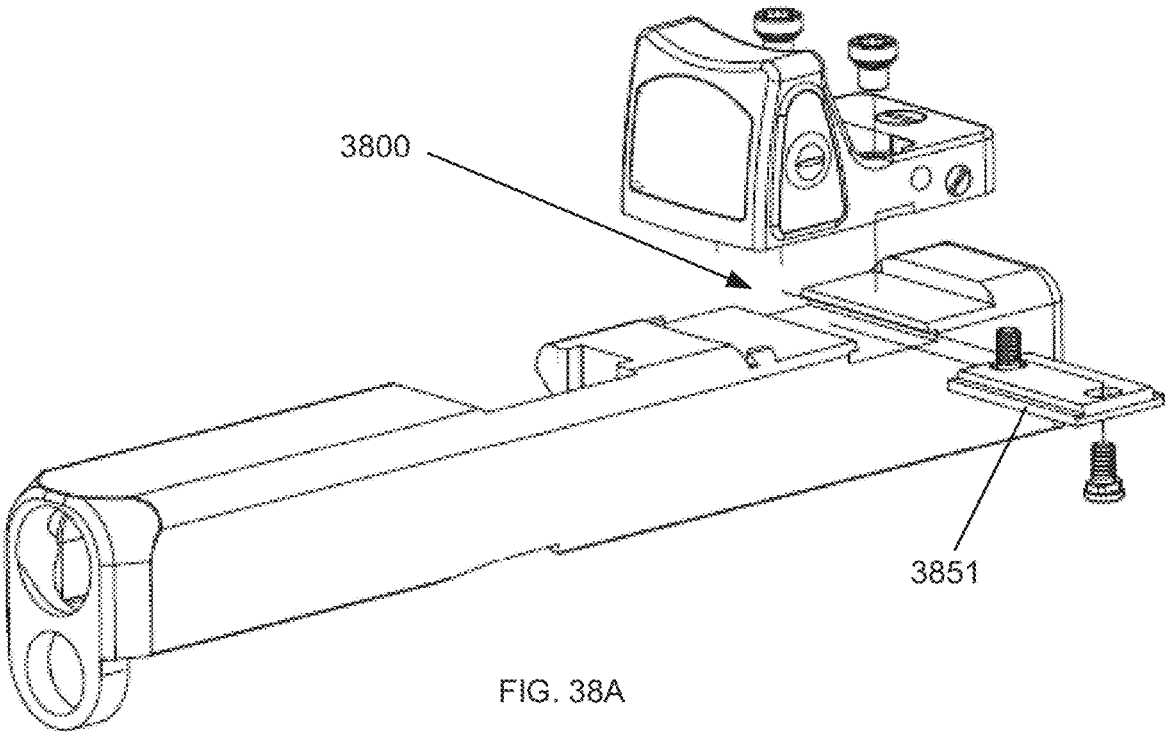
FIG. 38A illustrates a slide assembly including an adapter assembly that is slot-mounted to the slide, according to various embodiments.
Figure 38B:
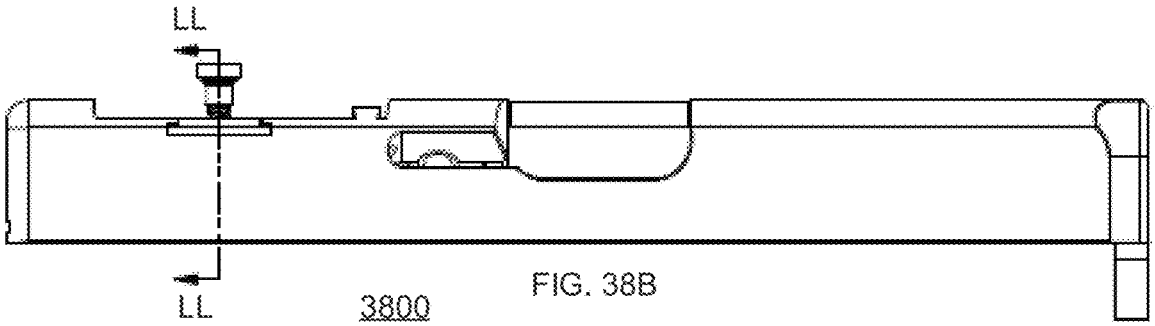
FIG. 38B illustrates a side view of the slide assembly of FIG. 38A.
Figure 38C:
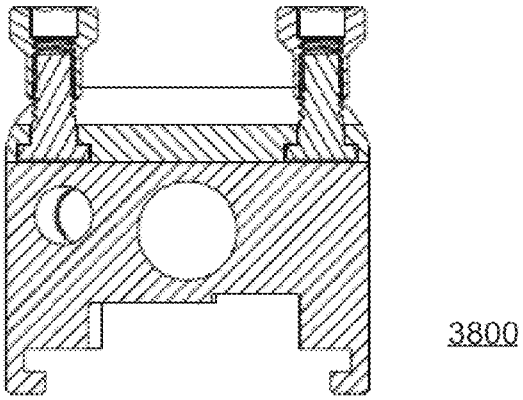
FIG. 38C illustrates a section view taken along section line LL of FIG. 38A.
Figure 38D:
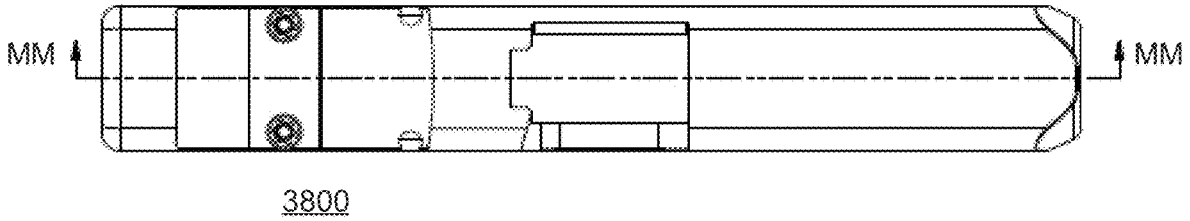
FIG. 38D illustrates a top view of the slide assembly of FIG. 38A.
Figure 38E:
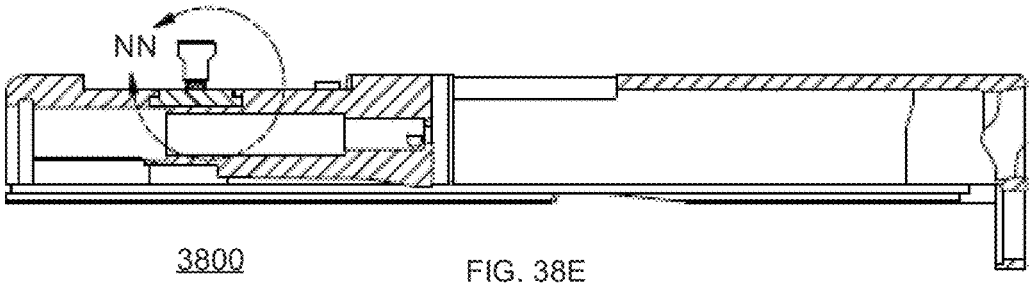
FIG. 38E illustrates a sectional view taken along section line MM of FIG. 38D.
Figure 38F:
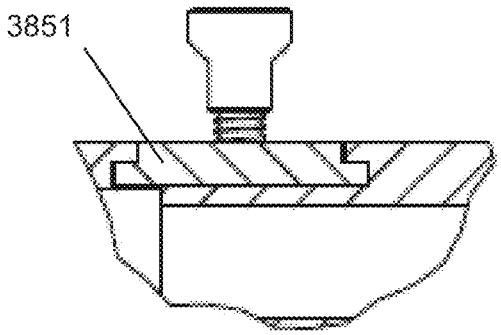
FIG. 38F illustrates a detailed view NN of FIG. 38E.

The seals 3081 (FIG. 32D) or any other similar seals described herein may combinationally seal the optic to the optic mount or the adapter assembly with a face groove seal of the firearm optic (e.g., a battery seal). However, some firearm optics may require pressure applied to a battery section of the firearm optic, which may not be provided when a sealing plate or other intermediary layer is omitted. To provide optimal operability with these firearm optics, a top side of any optic mount described herein may define a pocket 3601 (FIG. 36), e.g., a seal channel, locatable below a battery section of a firearm optic. A seal (e.g., a face groove seal) for the seal channel 3601 may have a lower section locatable in the seal channel 3601 and an upper section outside the seal channel 3601 and arranged to partially protrude from the seal channel 3051 when installed therein, when the battery section pressure is needed. The protruding part of the face groove seal may apply pressure to a battery section of the firearm optic when the firearm optic is mounted to the firearm optic without a sealing plate or other intermediary layer that would raise a position of the firearm optic relative to the firearm. This may eliminate the need for a sealing plate even with firearm optics that specify pressure on the battery section, providing a lower profile optic mounting. In some embodiments, the seal channel 3601 may be used in combination with any other seal described herein. In yet other embodiments, the seal channel 3601 may be used without using the seals described herein.

Any of the mounting features described herein may be applied to embodiments in which an optic is directly mounted to a firearm. FIGS. 37A-E illustrate one such example in which the slide includes openings (e.g., key openings) to receive a bolt (FIG. 37C) similar to any bolt described herein. The illustrated nuts, which may be similar to any sleeve nut described herein, may thread onto the bolts to retain an optic (not shown) directly to the slide.

FIGS. 38A-F illustrates a slide assembly 3800 including an adapter assembly 3851 that is slot-mounted to the slide, according to various embodiments. The slot-mounting may eliminate a set of fasteners, and also may locate the optic at a same height as in a direct mount example. In this embodiment, the slot is a T-slot, but in other embodiments the slot can be any shape in which a width of a lower part of the adapter assembly 3851 is greater than a width of an upper part of the adapter assembly 3851. Also, in this embodiment the adapter assembly 3851 is side-mounted, however, this is not required (in other embodiments it may be possible and practical to mount a slot-mounted adapter assembly from any direction).

The illustrated optic may be similar to any optic described herein. In this embodiment, the optic is coupled to the adapter assembly 3051 using bolts (which may be similar to any bolts described herein), but in other examples the optic may be coupled to the adapter assembly 3851 using any fastening structure described herein (such as threaded posts, or threaded studs) in a slot-mounting embodiment. Any nuts described herein may be used, as well. In another embodiment, a slot-mountable bracket may have female threaded openings to receive screws inserted into a top of the optic.

We claim all modifications and variations coming within the spirit and scope of the following claims.

The invention claimed is:

1. An apparatus comprising:

a body attachable to a firearm part, the body including a top surface defining an optic mount; and a nut to retain an optic sight on the optic mount, the nut to mount on an externally threaded part;

wherein the body further includes:

a slot or other opening defined, at least in part, by the top surface of the body; and a pocket or threaded opening, a first portion of the externally threaded part to pass through the slot or other opening when a second different portion of the externally threaded part is located in the pocket or threaded opening;

wherein the slot or other opening, or the pocket or the threaded opening, is configured to fix a rotational position of the externally threaded part.

2. The apparatus of claim 1, wherein the nut comprises a sleeve nut and the body further includes a back end, wherein when the sleeve nut is fully tightened, a top end of the sleeve nut is not above a plane defined by a top of the back end of the optic sight.

3. The apparatus of claim 1, further comprising a seal located between the optic mount and the optic sight, wherein the seal is torus shaped.

4. The apparatus of claim 1, further comprising:

a face groove seal located between the optic mount and the optic sight; and an additional seal, wherein the additional seal and the face groove seal combinationally seal the optic sight to the optic mount.

5. The apparatus of claim 1, further comprising a seal located between the optic mount and the optic sight, wherein the externally threaded part includes a threaded exterior to mount the nut, and a non-threaded exterior, wherein the non-threaded exterior sealingly contacts the seal.

6. The apparatus of claim 1, further comprising a seal located between the optic mount and the optic sight;

part of the second portion of the externally threaded part to sealingly contact the seal.

7. The apparatus of claim 1, further comprising a seal located between the optic mount and the optic sight, wherein the top surface of the body includes smooth surfaces around holes, wherein the smooth surfaces sealingly contact the seal.

8. The apparatus of claim 1, wherein the first portion of the externally threaded part comprises a non-threaded sheer resistant solid portion, wherein a width of the non-threaded sheer resistant solid portion is not less than an outside diameter of threading to mate with threading of the nut.

9. The apparatus of claim 1, further including a seal located between the body and the optic sight, and a seal channel located on the top surface of the body, the seal comprising a face groove seal having a lower portion located in the seal channel and an upper portion outside the seal channel, wherein the upper portion of the face groove seal is arranged to apply pressure to a battery of the optic sight.

10. The apparatus of claim 1, wherein a bottom of the body is configured to mate with a slot of the firearm part.

11. The apparatus of claim 1, wherein the body comprises an adapter.

12. The apparatus of claim 1, wherein the body comprises a slide.

13. An optic assembly including the apparatus of claim 1, wherein the optic assembly includes the optic sight and the body.

14. The apparatus of claim 1, wherein the externally threaded part includes a head having two different sections, wherein each of said first and second portions are parts of a different section of the two different sections.

15. The apparatus of claim 14, wherein the externally threaded part further includes a shank.

16. The apparatus of claim 1, wherein the externally threaded part comprises a threaded stud.

17. The apparatus of claim 16, where the second portion is configured to press fit into the pocket, wherein the second portion includes knurling to compress when the second portion is press fit into the pocket.

18. The apparatus of claim 16, wherein threading of the threaded opening and threading of the externally threaded part are oppositely threaded.

19. The apparatus of claim 1, wherein the externally threaded part comprises a bolt.

20. The apparatus of claim 19, wherein the first portion comprises a shank or other non-threaded portion of the bolt.

21. The apparatus of claim 1, wherein the pocket or the threaded opening comprises a space, and the apparatus further comprises:

an additional space, wherein the additional space is arranged to receive a seal, the seal is in sealing contact with the body or the optic sight.

22. The apparatus of claim 1, wherein the body comprises a plurality of bodies, the plurality of bodies including a 1) slide defining an adapter slot, and 2) an adapter to slot-mount in the adapter slot, wherein the slot or the other opening and the pocket or the threaded opening are defined by the adapter.

23. A firearm including the apparatus of claim 1, the firearm including a frame assembly, wherein the firearm part comprises at least one part of the frame assembly.

24. An apparatus comprising:

an optic mount; and a space arranged to attach, to the optic mount, an optic sight or an adapter assembly to receive the optic sight, the space defined by a body of the optic sight or the adapter assembly; and an additional space defined by the optic mount, the body, or the adapter assembly, wherein the additional space is arranged to receive a seal, the seal is in sealing contact with the body or the adapter assembly;

wherein:

1) the seal is further in contact with a head of an externally threaded part when the head is located in the space, 2) the seal is torus shaped, or 3) the apparatus further comprises a face groove seal located between the body and the optic mount or the adapter assembly, wherein the seal and the face groove seal combinationally seal the optic sight to the optic mount or the adapter assembly.

25. An apparatus comprising:

an optic mount; and a space arranged to attach, to the optic mount, an optic sight or an adapter assembly to receive the optic sight, the space defined by a body of the optic sight or the adapter assembly; and an additional space defined by the optic mount, the body, or the adapter assembly, wherein the additional space is arranged to receive a seal, the seal is in sealing contact with the body or the adapter assembly;

wherein:

the seal is further in contact with a head of an externally threaded part when the head is located in the space.

26. The apparatus of claim 25, the seal to contact an underside of the head.

27. The apparatus of claim 25, wherein the head comprises a tapered head.

28. An apparatus comprising:

an optic mount; and a space arranged to attach, to the optic mount, an optic sight or an adapter assembly to receive the optic sight, the space defined by a body of the optic sight or the adapter assembly; and an additional space defined by the optic mount, the body, or the adapter assembly, wherein the additional space is arranged to receive a seal, the seal is in sealing contact with the body or the adapter assembly;

wherein:

1) the seal is torus shaped, or 2) the apparatus further comprises a face groove seal located between the body and the optic mount or the adapter assembly, wherein the seal and the face groove seal combinationally seal the optic sight to the optic mount or the adapter assembly.

29. The apparatus of claim 28, further comprising an externally threaded part including a head;

the seal is further in contact with the head when the head is located in the space.

30. The apparatus of claim 29, wherein the head comprises a tapered head.

31. The apparatus of claim 28, wherein the space comprises a counterbore or a countersink.

32. The apparatus of claim 28, further comprising an externally threaded part including a tapered head, wherein the space comprises a tapered counter opening to receive at least a portion of the tapered head, the seal is further in contact with the tapered head when the tapered head is located in the counter opening.

* * * * *